US007399070B2

(12) United States Patent
Nakamura et al.

(10) Patent No.: US 7,399,070 B2
(45) Date of Patent: Jul. 15, 2008

(54) INK JET PRINTER

(75) Inventors: Hirotake Nakamura, Nagoya (JP); Masayuki Takata, Nagoya (JP); Takamasa Usui, Nagoya (JP); Bing Wang, Nagoya (JP); Yoichiro Shimizu, Kasugai (JP); Naoya Okazaki, Gifu-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 302 days.

(21) Appl. No.: 11/074,069

(22) Filed: Mar. 8, 2005

(65) Prior Publication Data

US 2006/0028519 A1 Feb. 9, 2006

(30) Foreign Application Priority Data

| | | |
|---|---|---|
| Mar. 9, 2004 | (JP) | 2004-065732 |
| Mar. 9, 2004 | (JP) | 2004-065735 |
| Mar. 17, 2004 | (JP) | 2004-076062 |
| Mar. 22, 2004 | (JP) | 2004-082644 |
| Mar. 22, 2004 | (JP) | 2004-082645 |
| Jul. 14, 2004 | (JP) | 2004-207208 |

(51) Int. Cl.
*B41J 2/17* (2006.01)
*B41J 2/175* (2006.01)

(52) U.S. Cl. ..... 347/84; 347/85

(58) Field of Classification Search ..... 347/7, 347/84, 85, 86, 87
See application file for complete search history.

(56) References Cited

U.S. PATENT DOCUMENTS

| | | | | |
|---|---|---|---|---|
| 5,903,295 | A * | 5/1999 | Swanson et al. | 347/87 |
| 6,024,443 | A | 2/2000 | Muhl et al. | |
| 6,102,533 | A | 8/2000 | Nozawa et al. | |
| 6,152,555 | A | 11/2000 | Nozawa et al. | |
| 6,220,697 | B1 | 4/2001 | Yamanaka et al. | |
| 6,270,211 | B1 | 8/2001 | Long et al. | |
| 6,293,652 | B1 | 9/2001 | Arashima et al. | |

(Continued)

FOREIGN PATENT DOCUMENTS

| | | |
|---|---|---|
| EP | 1 055 520 A1 | 11/2000 |

(Continued)

*Primary Examiner*—Stephen D. Meier
*Assistant Examiner*—Carlos A Martinez, Jr.
(74) *Attorney, Agent, or Firm*—Oliff & Berridge, PLC

(57) ABSTRACT

An ink jet printer including a stationary frame; a tank supporter which is provided in the stationary frame and which supports at least one ink storing tank storing at least one sort of ink; a recording head which records an image on a recording medium by ejecting a droplet of the ink, and which has at least one ink flow inlet; at least one ink delivering tank which delivers the ink and has at least one ink flow outlet; at least one ink supply tube which is provided between the tank supporter and the ink delivering tank and through which the ink is supplied from the ink storing tank to the recording head via the ink delivering tank, wherein the delivering tank provides at least a portion of at least one ink delivering channel connecting between the ink supply tube and the recording head; a head holder which includes a main portion holding the recording head and the ink delivering tank, and which is movable relative to the stationary frame so that the recording head records the image on the recording medium; and an ink-contact preventing portion which prevents the ink that leaks from the ink delivering channel, from contacting the recording head.

43 Claims, 28 Drawing Sheets

U.S. PATENT DOCUMENTS

| | | | | |
|---|---|---|---|---|
| 6,378,971 | B1 * | 4/2002 | Tamura et al. | 347/7 |
| 6,652,081 | B2 | 11/2003 | Shimizu | |
| 6,726,316 | B2 | 4/2004 | Shimizu | |
| 2002/0149646 | A1 | 10/2002 | Pawlowski, Jr. et al. | |
| 2003/0076389 | A1 * | 4/2003 | Shimizu | 347/85 |
| 2003/0122909 | A1 * | 7/2003 | Ogura et al. | 347/86 |
| 2003/0156173 | A1 | 8/2003 | Yamaguchi et al. | |
| 2004/0125180 | A1 * | 7/2004 | Koga | 347/85 |
| 2005/0012792 | A1 * | 1/2005 | Kumagai et al. | 347/85 |

FOREIGN PATENT DOCUMENTS

| | | | |
|---|---|---|---|
| EP | 1 097 814 | A2 | 5/2001 |
| JP | A 59-73953 | | 4/1984 |
| JP | B2 7-121583 | | 12/1995 |
| JP | B2 2592799 | | 12/1996 |
| JP | A 10-119314 | | 5/1998 |
| JP | A 2001-260388 | | 9/2001 |
| JP | A 2003-127415 | | 5/2003 |
| JP | A 2003-145791 | | 5/2003 |
| WO | WO 03/041964 | A1 | 5/2003 |

* cited by examiner

INK JET PRINTER

The present application is based on Japanese Patent Applications No. 2004-065735 filed on Mar. 9, 2004, No. 2004-065732 filed on Mar. 9, 2004, No. 2004-076062 filed on Mar. 17, 2004, No. 2004-082644 filed on Mar. 22, 2004, No. 2004-082645 filed on Mar. 22, 2004, and No. 2004-207208 filed on Jul. 14, 2004, the contents of which are incorporated herein by reference.

BACKGROUND OF THE INVENTION

1. Field of the Invention

The present invention relates to an ink jet printer and particularly to such an ink jet printer in which ink is supplied from an ink storing tank via an ink supply tube to a recording head mounted on a movable head holder.

2. Discussion of Related Art

Recently there has been a demand to decrease a thickness of a carriage for the purpose of decreasing a thickness of an ink jet printer as a whole. That is, there has been a demand to construct an ink jet printer such that no ink storing tanks are mounted on a carriage. To this end, it is needed to provide one or more ink storing tanks on a stationary frame (e.g., a housing) and supply one or more sorts of inks from the ink storing tank or tanks via one or more ink supply tubes to a recording head mounted on the carriage.

For example, Japanese Patent Publication No. 7-121583 discloses a tube-supply-type ink jet printer including a housing; an ink storing tank detachably attached to the housing; a flexible ink supply tube; a movable carriage; and a recording head which is mounted on the carriage and to which ink is supplied from the ink storing tank via the ink supply tube.

However, when the above-indicated ink jet printer is checked for maintenance and, for example, the recording head is replaced with a new one, or when the ink supply tube is temporarily detached from a tube joint on the carriage during an assembling operation in a factory, the ink may leak from the ink supply tube and fall onto the carriage. If the carriage is moved, in a recording operation, with the ink remaining on the carriage, the ink may be moved because of inertia and accordingly the recording head may be wetted by the ink and fail to perform the recording operation. More specifically described, the ink may wet an adhered portion or portions of the recording head and lower the adhering force, or may wet an electronic component or components such as a flexible flat cable and cause an electric short circuit.

SUMMARY OF THE INVENTION

If a connection portion where an ink supply tube is connected and accordingly ink may leak is located remote from a portion where a recording head is mounted, then the recording head is effectively prevented from being adversely affected by the ink that may leak from an end of the ink supply tube.

It is therefore an object of the present invention to provide an ink jet printer which can prevent a recording head from being adversely affected by ink. It is another object of the present invention to provide an ink jet printer which can prevent one or more portions (e.g., an adhered portion or an electronic component) susceptible to ink, from being wetted by the ink.

Hereinafter, some examples of various modes of the present invention that are recognized as being claimable in the present application (hereinafter, referred to as the claimable modes, where appropriate) will be described and explained. The claimable modes include at least respective modes corresponding to the appended claims, but may additionally include broader or narrower modes of the present invention or even one or more different inventions than the present invention. Each of the following modes (1) through (11) is numbered like the appended claims, and depends from the other mode or modes, where appropriate, so as to help understand the claimable modes and to indicate and clarify possible combinations of elements or technical features thereof. It is, however, to be understood that the present invention is not limited to the elements or technical features of the following modes, or the combinations thereof, that will be described below for illustrative purposes only. It is to be further understood that each of the following modes should be construed in view of not only the explanations directly associated therewith and but also the detailed description of the preferred embodiments of the invention, and that in additional claimable modes, one or more elements or one or more technical features may be added to, or deleted from, any of the following specific modes.

(1) An ink jet printer, comprising:

a stationary frame;

a tank supporter which is provided in the stationary frame and which supports at least one ink storing tank storing at least one sort of ink;

a recording head which records an image on a recording medium by ejecting a droplet of said at least one sort of ink, and which has at least one ink flow inlet;

at least one ink delivering tank which delivers said at least one sort of ink and has at least one ink flow outlet;

at least one ink supply tube which is provided between the tank supporter and said at least one ink delivering tank and through which said at least one sort of ink is supplied from said at least one ink storing tank to the recording head via said at least one ink delivering tank, wherein said at least one ink delivering tank provides at least a portion of at least one ink delivering channel connecting between said at least one ink supply tube and the recording head;

a head holder which includes a main portion holding the recording head and said at least one ink delivering tank, and which is movable relative to the stationary frame so that the recording head records the image on the recording medium; and an ink-contact preventing portion which prevents the ink that leaks from said at least one ink delivering channel, from contacting the recording head.

In this ink jet printer, even if the ink may leak, the ink-contact preventing portion prevents the ink from wetting the recording head. Thus, when the ink may leak from the ink delivering channel, the present ink jet printer can prevent the ink from damaging the function of the recording head.

(2) An ink jet printer, comprising:

a stationary frame:

a tank supporter which supports at least one ink storing tank storing at least one sort of ink;

a recording head which records an image on a recording medium by ejecting a droplet of said at least one sort of ink;

at least one ink delivering tank which delivers said at least one sort of ink to the recording head;

at least one ink supply tube through which said at least one sort of ink is supplied from said at least one ink storing tank to the recording head via said at least one ink delivering tank; and a head holder which includes a main portion holding the recording head and said at least one ink delivering tank, and which is movable relative to the stationary frame so that the recording head records the image on the recording medium, wherein said at least one ink delivering tank includes at least one connection portion to which said at least one ink supply tube is connected and which is located outside the main portion of the head holder.

In this ink jet printer, the connection portion where the ink supply tube is connected to the ink delivering tank and accordingly the ink may leak, is located remote from the main portion of the head holder that holds the recording head. Therefore, even if the ink may leak, the ink does not wet the holding portion of the head holder. In addition, even if the ink that has leaked may be moved toward the holding portion, the ink would dry up before the ink reaches the main portion. Eventually, the recording head is effectively prevented from being wetted by the ink. Thus, when the ink may leak from the connection portion where the ink supply tube is connected to the ink delivering tank, the present ink jet printer can prevent the ink from damaging the function of the recording head.

(3) An ink jet printer, comprising:

a stationary frame:

a tank supporter which supports at least one ink storing tank storing at least one sort of ink;

a recording head which records an image on a recording medium by ejecting a droplet of said at least one sort of ink;

at least one ink delivering tank including a first main portion which delivers said at least one sort of ink to the recording head;

at least one ink supply tube through which said at least one sort of ink is supplied from said at least one ink storing tank to the recording head via said at least one ink delivering tank; and a head holder which includes a second main portion holding the recording head and said at least one ink delivering tank, and which is movable relative to the stationary frame so that the recording head records the image on the recording medium, wherein said at least one ink delivering tank additionally includes a first extension portion which extends outward from the first main portion and is located outside the second main portion of the head holder, and wherein the first extension portion of said at least one ink delivering tank includes at least one connection portion to which said at least one ink supply tube is connected.

In this ink jet printer, the connection portion where the ink supply tube is connected to the ink delivering tank is provided in the first extension portion of the ink delivering tank that is located outside the second main portion of the head holder that holds the recording head. Thus, the connection portion where the ink may leak is located remote from the recording head. Therefore, even if the ink may leak from the connection portion where the ink supply tube is connected to the ink delivering tank, the present ink jet printer can effectively prevent the ink from wetting the recording head.

(4) An ink jet printer, comprising:

a stationary frame:

a tank supporter which supports at least one ink storing tank storing at least one sort of ink;

a recording head which records an image on a recording medium by ejecting a droplet of said at least one sort of ink;

at least one ink delivering tank which delivers said at least one sort of ink to the recording head;

at least one ink supply tube through which said at least one sort of ink is supplied from said at least one ink storing tank to the recording head via said at least one ink delivering tank;

a head holder which holds the recording head and which is movable relative to the stationary frame so that the recording head records the image on the recording medium, wherein the head holder includes a bottom wall and holds the recording head below the bottom wall and supports said at least one ink delivering tank above the bottom wall, and wherein the bottom wall has at least one opening formed through a thickness thereof; and an ink-movement preventing portion which prevents the ink from moving into said at least one opening.

In this ink jet printer, the ink-movement preventing portion may include a surrounding wall or groove which fully or partly surrounds the opening of the bottom wall, or may include a surrounding portion which fully or partly surrounds the opening and is coated with an ink-repellent or water-repellent agent. Thus, the ink-movement preventing portion may either completely or incompletely (i.e., partly) prevent the ink from moving into the opening. The ink-movement preventing portion prevents the ink from moving into the opening formed through the thickness of the bottom wall of the head holder. Therefore, even if a small amount of ink may flow into the head holder, the ink can hardly enter the opening. That is, even if the ink that has leaked may flow into the head holder, the ink can be prevented from entering the opening. If portions or elements (e.g., an adhered portion or an electronic component) susceptible to ink are provided under the bottom wall, those portions or elements can be prevented from being wetted by the ink. For example, in the case where an adhered portion is provided under the opening, the adhered portion can be prevented from being wetted by the ink, and the lowering of the adhering force can be avoided. In addition, in the case where an electronic component such as a flexible flat cable is provided under the opening, the electronic component can be prevented from being wetted by the ink, and the occurrence of an electric short circuit can be avoided.

(5) An ink jet printer, comprising:

a stationary frame:

a tank supporter which supports at least one ink storing tank storing at least one sort of ink;

a recording head which records an image on a recording medium by ejecting a droplet of said at least one sort of ink;

at least one ink delivering tank which delivers said at least one sort of ink to the recording head;

at least one ink supply tube through which said at least one sort of ink is supplied from said at least one ink storing tank to the recording head via said at least one ink delivering tank;

a head holder which holds the recording head and which is movable relative to the stationary frame so that the recording head records the image on the recording medium, wherein the head holder includes a bottom wall and holds the recording head below the bottom wall and supports said at least one ink delivering tank above the bottom wall, and wherein the bottom wall has at least one opening formed through a thickness thereof; and at least one projecting wall which at least partly surrounds said at least one opening and prevents the ink from moving into said at least one opening.

In this ink jet printer, the projecting wall fully or partly surrounds the opening formed through the thickness of the bottom wall of the head holder. Therefore, even if the ink that has leaked may flow into the head holder, the wall can prevent the ink from entering the opening. Since the wall can be easily provided around the opening, the ink can be easily prevented from entering the opening. Thus, if portions or elements (e.g., an adhered portion or an electronic component) susceptible to ink are provided under the bottom wall, those portions or elements can be prevented from being wetted by the ink.

(6) An ink jet printer, comprising:

a recording head having a plurality of ink ejection nozzles arranged in a plurality of arrays, and a plurality of ink flow inlets to which a plurality of sorts of inks are supplied, respectively, and which communicate with the arrays of ink ejection nozzles, respectively;

a plurality of ink delivering tanks having a plurality of ink flow outlets from which the inks flow toward the ink flow inlets of the recording head, respectively;

an elastic member having a plurality of through-holes having respective shapes corresponding to respective shapes of the ink flow outlets and respective shapes of the ink flow inlets, wherein the elastic member is interposed between the recording head and the ink delivering tanks, such that the ink flow outlets communicate with the ink flow inlets via the through-holes, respectively;

a plurality of inner ribs which project from one of (a) the ink delivering tanks and (b) the recording head, surround respective open ends of corresponding ones of (a) the ink flow outlets of the ink delivering tanks and (b) the ink flow inlets of the recording head, and cooperate with each other to define at least one first space therebetween; and at least one outer rib which projects from said one of (a) the ink delivering tanks and (b) the recording head and cooperates with at least one portion of at least one of the inner ribs to define at least one second space therebetween, wherein the elastic member includes a plurality of sealing portions which continuously surround the through-holes thereof, respectively, and fit in said at least one first space and said at least one second space such that the through-holes of the elastic member are aligned with the respective open ends of said corresponding ones of (a) the ink flow outlets of the ink delivering tanks and (b) the ink flow inlets of the recording head.

In this ink jet printer, (a) the ink flow outlets of the ink delivering tanks and/or (b) the ink flow inlets of the recording head are sounded by the double ribs, and the sealing portions of the elastic member fit in the spaces provided between the double ribs. Thus, the sealing portions of the elastic member can be effectively prevented from coming off the double ribs or tilting outward. Thus, the ink jet printer can enjoy a high degree of liquid tightness around the ink flow outlets of the ink delivering tanks and the ink flow inlets of the recording head.

(7) A sealing structure, comprising:

a first flow-channel defining member defining a plurality of first flow channels having respective flow inlets;

a second flow-channel defining member defining a plurality of second flow channels having respective flow outlets corresponding to the flow inlets, respectively; and an elastic member which has a plurality of through-holes arranged in an array in a first direction, and which is sandwiched by the first and second flow-channel defining members such that the through-holes communicate with the flow outlets, respectively, and communicate with the flow inlets, respectively, wherein each of the through-holes of the elastic member is elongate in a second direction perpendicular to the first direction, wherein the elastic member includes a flat base portion through which the through-holes are formed such that respective axis lines of the through-holes are substantially perpendicular to a plane along which the base portion extends, and additionally includes at least one array of first annular projections which project, parallel to the respective axis lines of the through-holes, from at least one of opposite surfaces of the base portion that are opposed to the first and second flow-channel defining members, respectively, and which surround the through-holes, respectively, and wherein each of two outer first annular projections located at respective opposite ends of said at least one array of first annular projections in the first direction includes an outer portion which is located outside a corresponding one of two outer through-holes located at respective opposite ends of the array of through-holes in the first direction, extends along the corresponding outer through-hole, and has, at a substantially middle portion thereof in the second direction, a first thickness greater than a second thickness of an other portion of said each outer first annular projection, the first thickness being measured, in a vicinity of the base portion, in the first direction, the second thickness being measured, in the vicinity of the base portion, in a direction parallel to the base portion and perpendicular to said other portion.

In this sealing structure, the first annular projections of the elastic member are compressed around the corresponding through-holes thereof, respectively. Thus, the through-holes can enjoy a high degree of liquid tightness. In addition, each of the two outer first annular projections includes the outer portion which is located outside a corresponding one of the two outer through-holes, extends along the corresponding outer through-hole, and has, at the substantially middle portion thereof, the first thickness greater than the second thickness of another portion of the each outer first annular projection. Therefore, the outer portion cannot be easily tilted outward. Thus, even if, when the first annular projections are compressed, the compressing forces may be applied to the outer portion in a direction to tilt it outward, the outer portion of the each outer first annular projection can prevent the leakage of the fluid.

(8) A sealing structure, comprising:

a first flow-channel defining member which defines a plurality of first flow channels having respective flow inlets;

a second flow-passage defining member which defines a plurality of second flow channels having respective flow outlets corresponding to the flow inlets, respectively; and an elastic member which has a plurality of through-holes located adjacent to each other in a first direction and which is sandwiched by the first and second flow-channel defining members such that the flow outlets communicate with the flow inlets via the through-holes, respectively, wherein the elastic member includes a base portion through which the through-holes are formed such that respective axis lines of the through-holes are substantially perpendicular to a plane along which the base portion extends, wherein the elastic member additionally includes a plurality of first annular projections which project, parallel to the respective axis lines of the through-holes, from one of opposite surfaces of the base portion that are opposed to the first and second flow-channel defining members, respectively, and which surround the through-holes, respectively, such that an inner circumferential surface of each of the first annular projections is substantially continuous with an inner circumferential surface of a corresponding one of the through-holes, wherein the elastic member additionally includes a plurality of second annular projections which project, parallel to the respective axis lines of the through-holes, from an other of the opposite surfaces of the base portion and which surround the through-holes, respectively, such that an inner circumferential surface of each of the second annular projections is offset outward from the inner circumferential surface of a corresponding one of the through-holes, wherein one of the first and second flow-channel defining members that is opposed to the second annular projections of the elastic member has at least one groove which receives the second annular projections, wherein at least one of the first annular projections includes an outer portion which is opposite to an inner portion thereof adjacent to an other of the first annular projections in the first direction, and which has a first thickness greater than a second thickness of the inner portion, each of the first thickness and the second thickness being measured, in a vicinity of the base portion, in the first direction, and wherein in a state in which the elastic member is sandwiched by the first and second flow-channel defining members, the first annular projections are compressed by an other of the first and second flow-channel defining members, and the second annular projections are compressed by said at least one groove of said one of the first and second flow-channel defining members, so that the inner circumferential surface of each of the through-holes is substantially continuous with an inner circumferential surface of a corresponding one of the flow outlets and with an inner circumferential surface of a corresponding one of the flow inlets.

In this sealing structure, even if the other of the first and second flow-channel defining members that is opposed to the first annular projections may be flat, the inner circumferential surface of each of the through-holes is kept substantially continuous with the inner circumferential surface of a corresponding one of the flow outlets and with the inner circumferential surface of a corresponding one of the flow inlets and, in this state, both the first and second annular projections are compressed. Thus, the through-holes can enjoy a high degree of liquid tightness. In addition, since the inner circumferential surface of each of the second annular projections is offset outward from the inner circumferential surface of a corresponding one of the through-holes, the second annular projections may press the corresponding first annular projections in directions to tilt them toward the corresponding through-holes, when the first and second annular projections are compressed. However, since one or more of the first annular projections includes an outer portion which is opposite to the inner portion thereof adjacent to another of the first annular projections in the first direction, and which has the first thickness greater than the second thickness of the inner portion, the tilting of the outer portion can be prevented, and the inner circumferential surface of each of the through-holes is kept substantially continuous with the inner circumferential surface of a corresponding one of the flow outlets and with the inner circumferential surface of a corresponding one of the flow inlets. Thus, the through-holes can enjoy a high degree of liquid tightness.

(9) An ink jet printer, comprising:

a recording head having an actuator and at least one ink ejection nozzle which ejects, upon operation of the actuator, a droplet of at least one sort of ink toward a recording medium;

a head holder which holds the recording head and which is moved to move the recording head relative to the recording medium;

at least one ink storing tank which stores said at least one sort of ink;

at least one ink supply tube which is provided between said at least one ink storing tank and the recording head and which supplies said at least one sort of ink from said at least one ink storing tank to the recording head;

at least one ink delivering tank which is mounted on the head holder and which delivers, to the recording head, said at least one sort of ink supplied from said at least one ink storing tank via said at least one tube; and a connecting device which is provided between one of opposite ends of said at least one ink supply tube and said at least one ink delivering tank and connects said one end of said at least one ink supply tube to said at least one ink delivering tank, wherein the connecting device includes a first connecting portion which has at least one tube connection portion to which said one end of said at least one ink supply tube is connected, and at least one ink outlet port from which said at least one sort of ink flows, a second connecting portion which has at least one ink inlet port through which said at least one sort of ink flows from said at least one ink outlet port to said at least one ink delivering tank, and a spring member which applies an elastic force to pinch the first and second connecting portions, and thereby connects the first and second connecting portions to each other.

In this ink jet printer, the first and second connection portions are connected to each other owing to the elastic force of the spring member. Thus, the connecting device can enjoy a simple construction, and the time needed to manufacture the connecting device can be shortened.

(10) An ink jet printer, comprising:

a recording head having an actuator and at least one ink ejection nozzle which ejects, upon operation of the actuator, a droplet of at least one sort of ink toward a recording medium;

a head holder which holds the recording head and is moved to move the recording head relative to the recording medium;

at least one ink storing tank which stores said at least one sort of ink;

at least one ink supply tube which is provided between said at least one ink storing tank and the recording head and supplies said at least one sort of ink from said at least one ink storing tank to the recording head;

at least one ink delivering tank which is supported by the head holder and which has an upper opening and delivers, to the recording head, said at least one sort of ink supplied from said at least one ink storing tank via said at least one ink supply tube;

a flexible membrane which closes the upper opening of said at least one ink delivering tank;

an electric-circuit substrate which supports an electric circuit and is spaced from the flexible membrane;

an electric cable which extends through a space between the flexible membrane and the electric-circuit substrate and thereby electrically connects the actuator of the recording head to the electric circuit; and at least one cable supporting portion which supports the electric cable such that the cable extends through the space between the flexible membrane and the electric-circuit substrate, without contacting an upper surface of the flexible membrane.

In this ink jet printer, the cable supporting portion supports the electric cable such that the cable extends through the space between the flexible membrane and the electric-circuit substrate, without contacting the upper surface of the flexible membrane. Thus, the operation or displacement of the flexible membrane to damp the fluctuations of pressure of the ink is not restrained by the electric cable. In addition, the flexible membrane and the cable are prevented from being damaged.

(11) An ink jet printer, comprising:

a recording head having an actuator and at least one ink ejection nozzle which ejects, upon operation of the actuator, a droplet of at least one sort of ink toward a recording medium;

a head holder which holds the recording head and is moved to move the recording head relative to the recording medium;

at least one ink delivering tank which is supported by the head holder;

an electric-circuit substrate which is supported by the head holder such that the recording head and the electric-circuit substrate are located on either side of said at least one ink delivering tank, and which supports an electric circuit;

an electric cable which electrically connects the actuator of the recording head to the electric circuit; and at least one electronic component which is electrically connected to the electric circuit such that said at least one electronic component projects from the electric-circuit substrate and is located in a vicinity of said at least one ink delivering tank, wherein the electric cable electrically connects the actuator of the recording head to the electric circuit, while extending through a first space between said at least one ink delivering tank and said at least one electronic component and a second space between said at least one ink delivering tank and the electric-circuit substrate.

In this ink jet printer, the electronic component is connected to the electric circuit such that the component projects from the electric-circuit substrate and is located in the vicinity of the ink delivering tank, and the electric cable electrically connects the actuator of the recording head to the electric circuit, while extending through the first space between the ink delivering tank and the electronic component and the second space between the ink delivering tank and the electric-circuit substrate. Thus, the recording head, the ink delivering tank, the circuit substrate, and the electronic component can be provided in a small space and accordingly those elements as a whole can be reduced in size. In addition, the electric cable can be provided in the small space, without interfering with those elements.

Two or more of the above-described second through eleventh modes (2) through (11) may be arbitrarily combined with each other, i.e., may be embodied on a single ink jet printer. For example, all of the modes (2) through (11) may be combined altogether and embodied on a single ink jet printer.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described in detail preferred embodiments of the present invention by reference to the drawings.

Figure 1A:
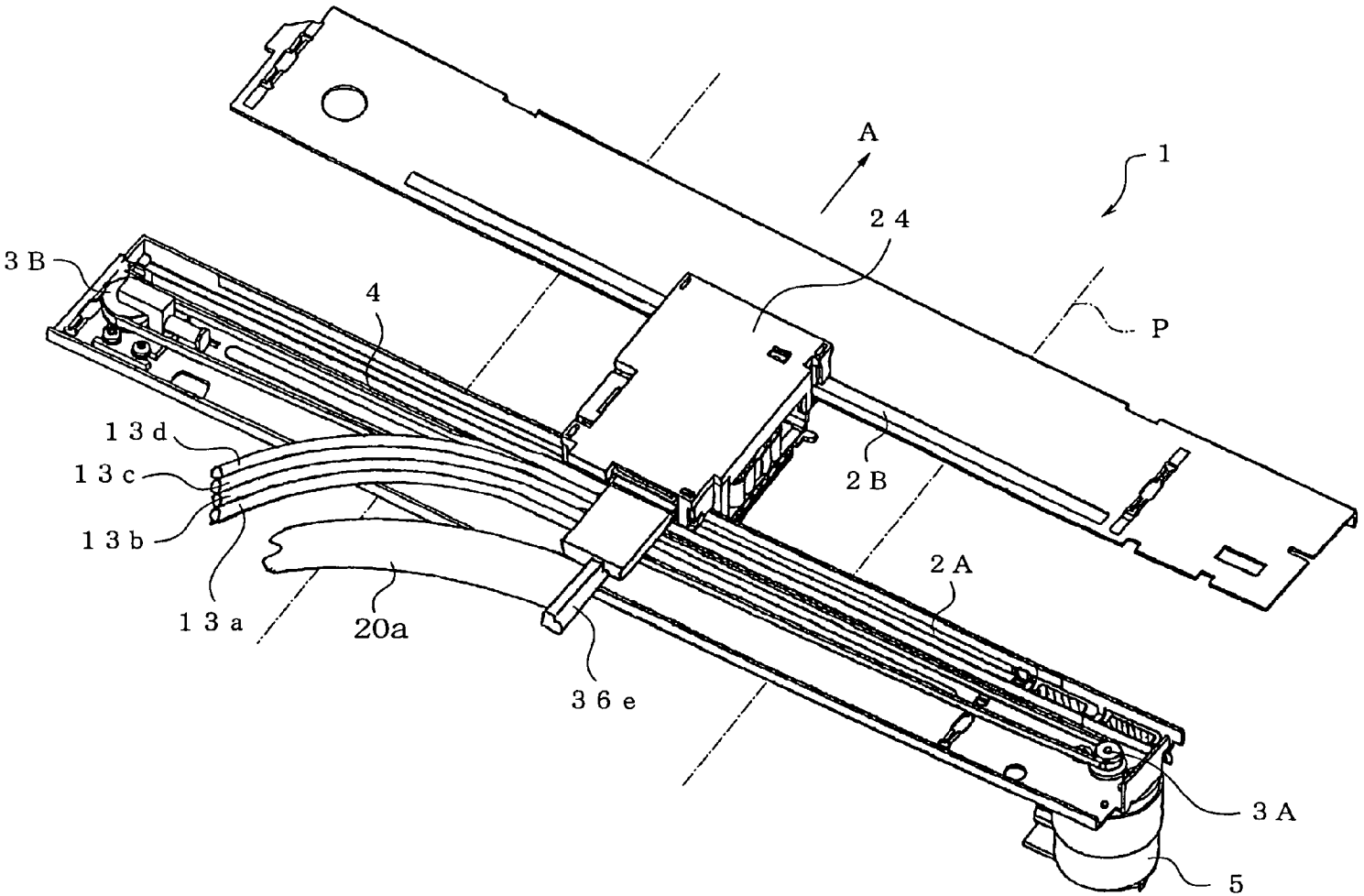
FIG. 1A is a schematic view of pertinent components of an ink jet printer 1 as a first embodiment of the present invention.
Figure 2:
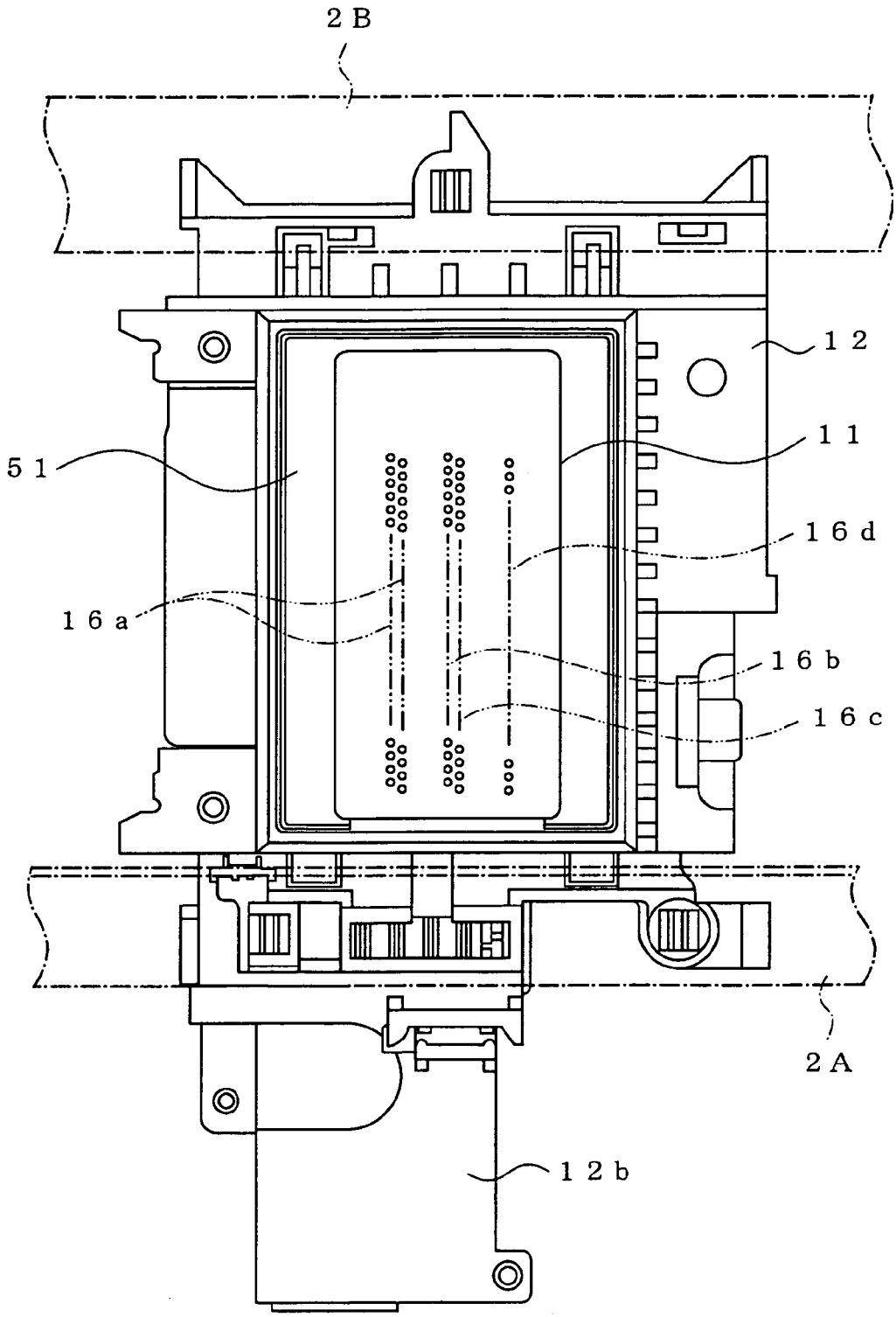
FIG. 2 is a bottom view of a recording head of the ink jet printer 1.
Figure 3:
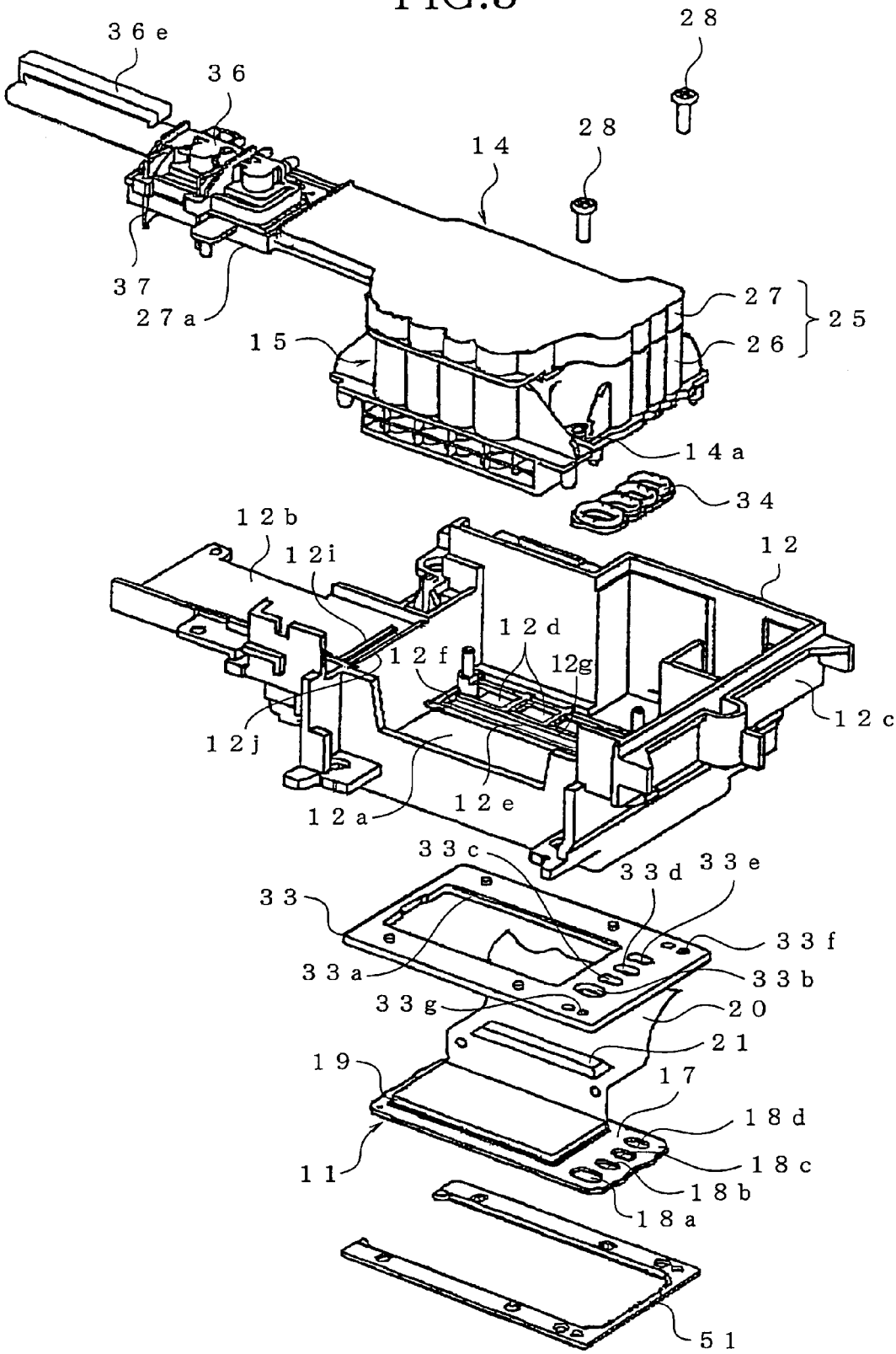
FIG. 3 is an exploded, perspective view of the recording head, a head holder, a damping device, and a reinforcing frame of the ink jet printer.

FIGS. 1A, 2, and 3 show an ink jet printer 1 as a first embodiment of the present invention. The ink jet printer 1 includes a recording head 11, a head holder 12, a damping device 14, and a reinforcing frame 33. The head holder 12 holds the recording head 11 and supports the damping device 14, and also functions as a movable carriage.

The head holder 12 as the carriage holds the recording head 11, and is movable relative to a recording sheet P as a sort of recording medium. The recording head 11 is of an ink jet type wherein a droplet of ink is ejected from each of ink ejection nozzles 16*a*, 16*b*, 16*c*, 16*d*, and has a plate-like shape. The head holder 12 is formed of a synthetic resin, and supports the damping device 14. Four sorts of inks are supplied from four ink storing tanks, not shown, respectively, via respective ink supply tubes 13*a*, 13*b*, 13*c*, 13*d*, to the damping device 14, and are reserved by the same 14. Then, the four inks are delivered from the damping device 14 to the recording head 11. The ink storing tanks are detachably attached to a tank supporter, not shown, provided in a housing, not shown, of the printer 1 (the housing is a stationary frame of the printer 1), and each of the ink storing tanks stores a large amount of ink to be supplied to the recording head 11. The present ink jet printer 1 prints or records a full-color image and, to this end, the four ink storing tanks store black, cyan, magenta, and yellow inks, respectively.

The head holder 12 as the carriage is slideably supported by a front and a rear guide member 2A, 2B that are provided in a front and a rear portion of the housing such that the two guide members 2A, 2B extend in a lengthwise direction of the housing. The front guide member 2A has a generally L-shaped cross section taken along a plane perpendicular to a direction of sliding or moving of the head holder 12; and the rear guide member 2B has a horizontal surface extending in the direction of sliding or moving of the head holder 12. The head holder 12 is connected to a portion of an endless timing belt 4 that is wound on a drive and a driven pulley 3A, 3B. When the drive pulley 3A is rotated by an electric motor 5 and the timing belt 4 is moved, the head holder 12 is reciprocated on the two guide members 2A, 2B in the lengthwise direction of the housing. An upper end of the head holder 12 is covered by a cover member 24. A sheet feeding device, not shown, feeds the recording sheet P, below the recording head 11, in a direction, A, perpendicular to the direction of movement of the head holder 12, in such a manner that a full-color image is recorded on the recording sheet P by the recording head 11. The present ink jet printer 1 additionally includes an ink collecting portion, not shown, for collecting the inks that are periodically ejected or flushed by the recording head 11 to prevent clogging of the nozzles 16*a* through 16*d*, during a recording operation of the head 11; and a maintenance unit, not shown, for performing a cleaning operation to clean a nozzle-support surface of the recording head 11, a recovering operation to suck selectively each sort of ink from the head 11, and a removing operation to remove air bubbles (or air) from the damping device 14.

As shown in FIG. 3, the recording head 11 includes a cavity unit 17 that has, in one end portion thereof, four ink flow inlets 18*a*, 18*b*, 18*c*, 18*d* that correspond to the four inks, respectively, are arranged in an array, and open in an upper surface of the unit 17. The four inks are supplied from the four ink flow inlets 18*a* through 18*d* via respective ink supply channels, not shown, to the four groups of ink ejection nozzles 16*a* through 16*d*, respectively. The recording head 11 additionally includes a piezoelectric actuator 19 that drives or operates the cavity unit 17 to eject, from each of the nozzles 16*a* through 16*d*, a droplet of ink. As shown in FIG. 3, an area of the upper opening of the ink flow inlet 18*a* corresponding to the black ink (BK) is larger than that of the upper opening of each of the other ink flow inlets 18*b*, 18*c*, 18*d* corresponding to the cyan, magenta, and yellow inks (C, M, Y), respectively.

In the recording head 11, a plan-view contour of the piezoelectric actuator 19 is smaller than that of the cavity unit 17 and, when the actuator 19 is stacked on a back or upper surface of the cavity unit 17, an outer peripheral portion of the upper surface of the cavity unit 17 that surrounds the actuator 19 and includes the respective upper openings of the ink flow inlets 18*a* through 18*d* remains exposed as a portion of a back or upper surface of the recording head 11.

A flexible flat cable 20 that applies an electric voltage to the piezoelectric actuator 19 is fixed, at one end portion thereof, to an upper surface of the actuator 19, and a driver IC (integrated circuit) 21 is electrically connected to the cable 20. The cable 20 is electrically connected to an electric-circuit substrate 22 (FIG. 5) that is provided above the damping device 14. The circuit substrate 22 is connected via another flexible flat cable 20*a* to another electric-circuit substrate, not shown, that is provided in the housing. Since the driver IC 21 generates heat, a heat sink 23 (FIG. 7) formed of an aluminum alloy is held in contact with the driver IC 21, so that the IC 21 cools down owing to the heat sink 23.

As shown in FIGS. 4 through 7, the damping device 14 includes, as a main portion thereof, a case unit 25 whose inner space is separated by partition walls into a plurality of damping chambers 31*a*, 31*b*, 31*c*, 31*d* as ink delivering tanks that correspond to the black ink (BK), the cyan ink (C), the magenta ink (M), and the yellow ink (Y), respectively.

The case unit 25 of the damping device 14 includes a box-like lower case 26 that opens upward; and an upper case 27 that is fixed to the lower case 26 while covering the upper opening of the same 26. The lower and upper cases 26, 27 are each formed, by injection molding, of a synthetic resin, and are liquid-tightly fixed to each other by, e.g., supersonic welding. In the state in which the two cases 26, 27 are fixed to each other, the above-indicated four damping chambers 31*a* through 31*d* are defined. Each of the damping chambers 31*a* through 31*d* may be constituted by a single room, or alternatively two or more rooms that communicate with each other via one or more flow passages. The four damping chambers 31*a* through 31*d* communicate with four ink flow outlets 32*a*, 32*b*, 32*c*, 32*d*, respectively.

The heat holder 12 includes a bottom wall 12*a* to a lower surface of which the recording head 11 is adhered such that the back or upper surface of the head 11 extends substantially parallel to the bottom wall 12*a*. Above the bottom wall 12*a* of the head holder 12, there are provided the damping device 14 that temporarily stores the four inks, and an air-discharging-valve device 15 that discharges air bubbles (i.e., air) collected by the damping chambers 31*a* through 31*d* of the damping device 14.

As shown in FIG. 2, the recording head 11 has, in the lower surface thereof, the two arrays of nozzles 16*a* corresponding to the black ink (BK), the array of nozzles 16*b* corresponding to the cyan ink (C), the array of nozzles 16*c* corresponding to the magenta ink (M), and the array of nozzles 16*d* corresponding to the yellow ink (Y), in the order of description, in a direction from the left to the right in the figure. The arrays of nozzles 16*a* through 16*d* extend in a direction perpendicular to the direction of movement of the head holder 12 as the carriage, and each of the nozzles 16*a* through 16*d* opens downward to face an upper surface of the recording sheet P.

The four ink flow outlets 32*a* through 32*d* of the damping device 14 are arranged in an array in a lower surface of the lower case 26, such that each of the flow outlets 32*a* through 32*d* opens downward at a height position lower than the bottom wall 12*a* of the head holder 12. Meanwhile, the cavity unit 17 of the recording head 11 has, in the upper surface thereof, the four ink flow inlets 18*a* through 18*d* that communicate with respective one ends of the ink supply channels (or manifolds), not shown, corresponding to the four inks, respectively. The four ink flow inlets 18*a* through 18*d* of the cavity unit 17 are aligned with the four ink flow outlets 32*a* through 32*d* of the damping device 14, respectively, such that the four flow outlets 32*a* through 32*d* communicate with the four flow inlets 18*a* through 18*d* via four ink flow holes 33*b*, 33*c*, 33*d*, 33*e* of the reinforcing frame 33, respectively, and an elastic sealing member 34 such as a rubber packing member.

The recording head 11 is fixed to the bottom wall 12*a* of the head holder 12 in such a manner that the reinforcing frame 33 is provided between the back or upper surface of the head 11 and the lower surface of the bottom wall 12*a*. The reinforcing frame 33 has a flat thin shape extending along the upper surface of the recording head 11, and has a central opening 33*a* that is somewhat larger than the outer contour of the piezoelectric actuator 19 and somewhat smaller than the outer contour of the cavity unit 17. Thus, the reinforcing frame 33 is fixed, by adhesion, to the back or upper surface of the cavity unit 17, such that the actuator 19 and the flexible flat cable 20 are located in the central opening 33*a* of the frame 33.

The reinforcing frame 33 is made of metal (e.g., stainless steel SUS430 according to Japanese Industrial Standard), and is thicker and more rigid than the cavity unit 17. The reinforcing frame 33 has, in one end portion thereof corresponding to the ink flow inlets 18*a* through 18*d* of the cavity unit 17, the four ink flow holes 33*b* through 33*e* that are arranged in the array and connect between the four ink flow outlets 32*a* through 32*d* of the damping device 14 and the four ink flow inlets 18*a* through 18*d* of the cavity unit 17.

A protection cover 51 having a generally U-shaped configuration in its plan view is attached to the reinforcing frame 33 such that the protection cover 51 surrounds the recording head 11 and thereby fills a space left between the recording head 11 and the head holder 12.

Figure 4:
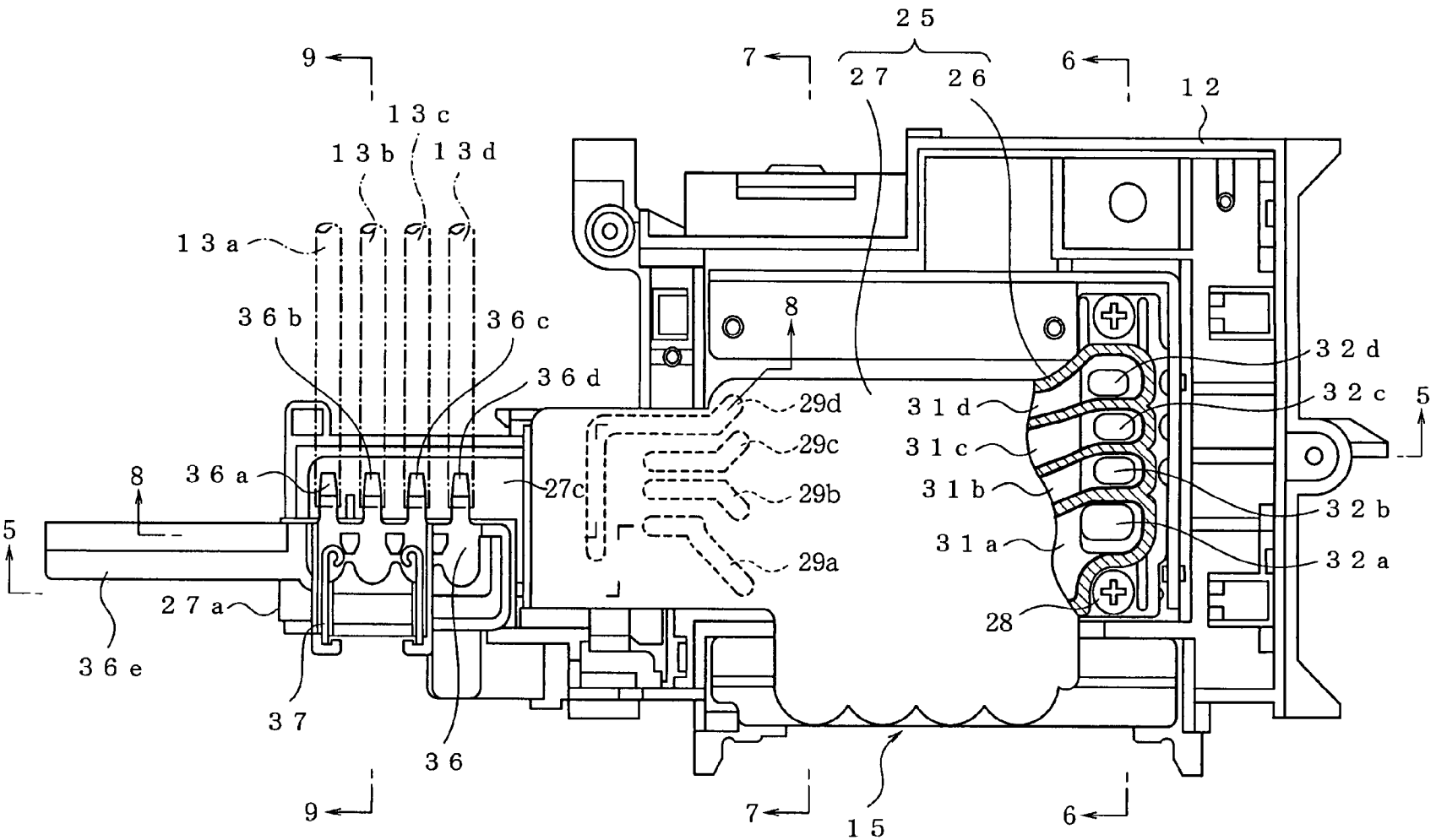
FIG. 4 is a partly cross-sectioned, plan view of the head holder and the components held thereby.
Figure 5:
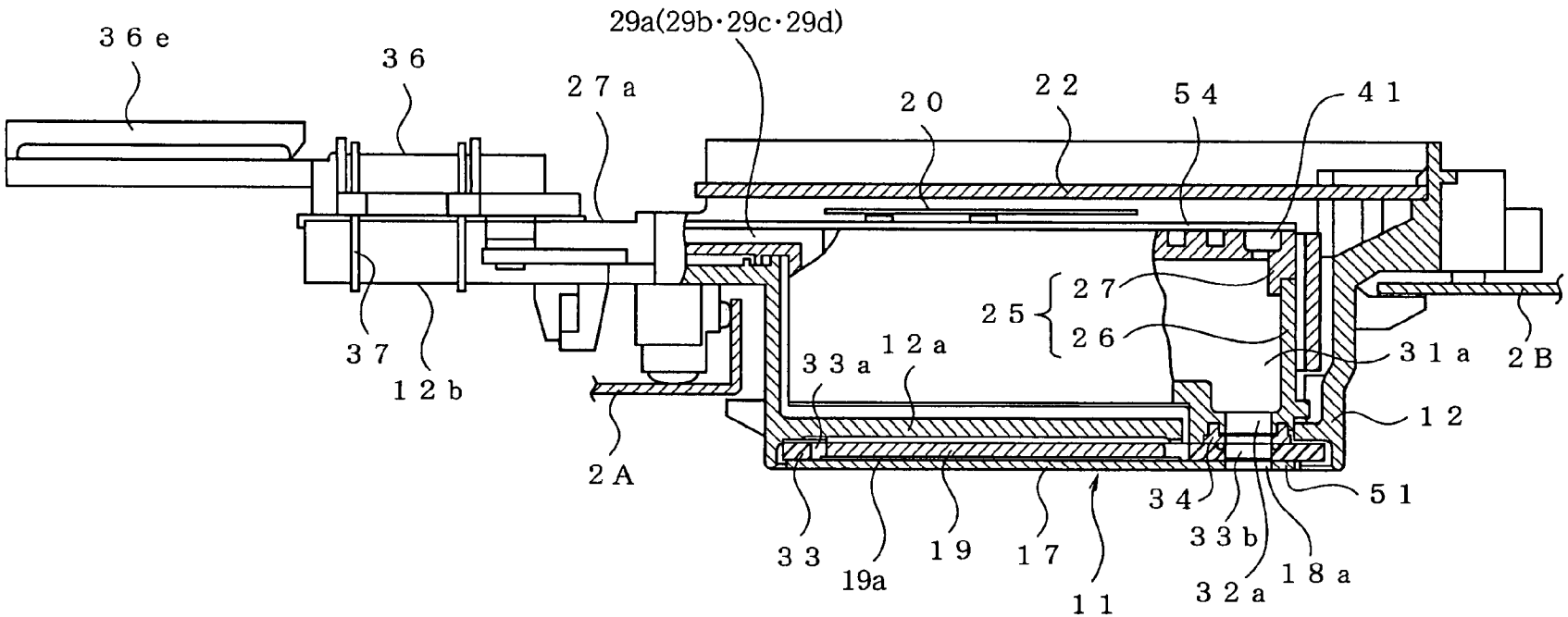
FIG. 5 is a cross-section view of the head holder, taken along 5-5 in FIG. 4.
Figure 8:
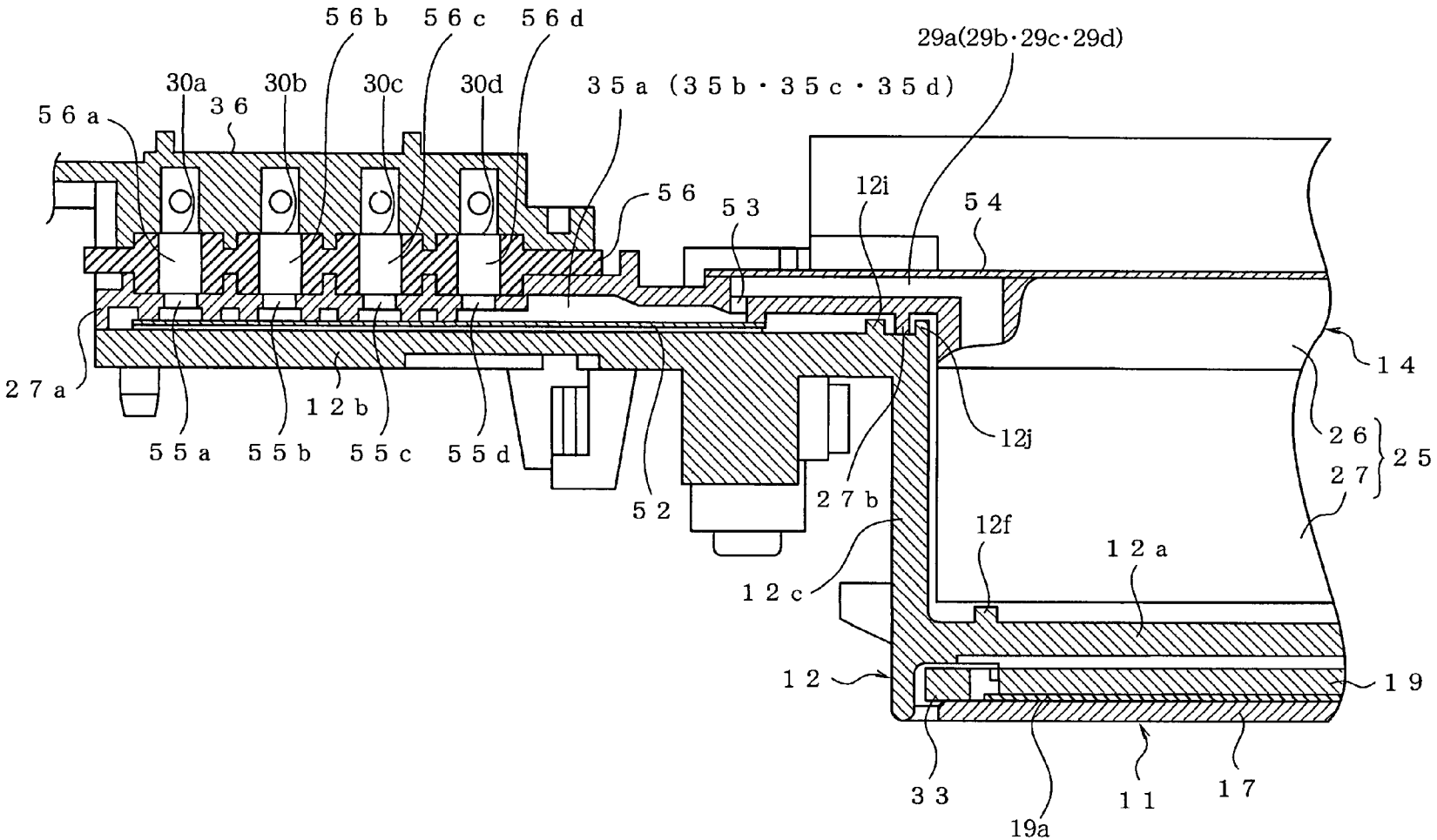
FIG. 8 is a cross-section view of the head holder, taken along 8-8 in FIG. 4.

The case unit 25 of the damping device 14 includes an extension portion 27*a* that laterally extends from one end portion of the upper case 27 that is opposite to another end portion thereof corresponding to the ink flow outlets 32*a* through 32*d*. As shown in FIGS. 4, 5, and 8, the extension portion 27*a* has four inner ink flow passages 29*a*, 29*b*, 29*c*, 29*d*, and four outer ink flow passages 35*a*, 35*b*, 35*c*, 35*d*, that correspond to the four inks, i.e., the black ink (BK), the cyan ink (C), the magenta ink (M), and the yellow ink (Y), respectively. The four inner ink flow passages 29*a* through 29*d* are independent of each other and communicate, at respective downstream-side ends thereof, with the four damping chambers 31*a* through 31*d*, respectively, and communicate, at respective upstream-side ends thereof, with the four outer ink flow passages 35*a* through 35*d*, respectively, that are also independent of each other.

As shown in FIG. 8, the four outer ink flow passages 35*a* through 35*d* are defined by closing, with a first flexible membrane 52, four grooves formed in a lower surface of the extension portion 27*a*; and the four inner ink flow passages 29*a* through 29*d* are defined by closing, with a second flexible membrane 54, four grooves formed in an upper surface of the extension portion 27*a*. As shown in FIG. 8, the four outer ink flow passages 35*a* through 35*d* and the four inner ink flow passages 29*a* through 29*d* communicate with each other via four communication holes 53, respectively. The second flexible membrane 54 is extended to an area above four air-discharge passages 41, described later, so as to define the same 41.

Figure 11:
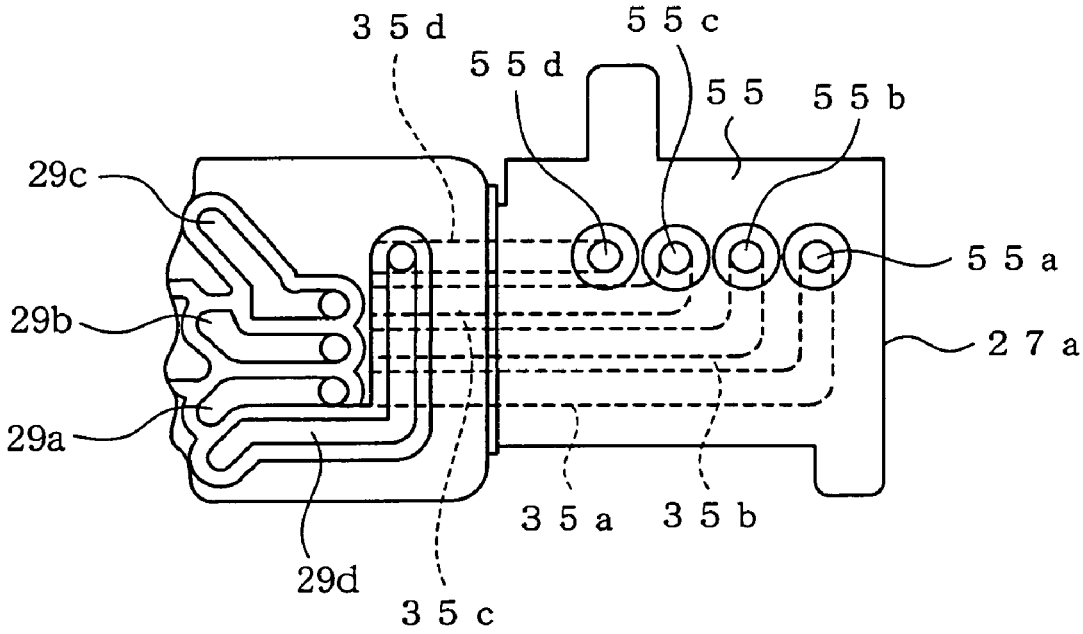
FIG. 11 is a schematic plan view of the extension portion of the damping device.

As shown in FIGS. 8 and 11, the four outer ink flow passages 35*a* through 35*d* communicate, at respective upstream-side ends thereof, with four ink inlet ports 55*a*, 55*b*, 55*c*, 55*d* that open in an upper surface 27*c* of an end portion 55 of the extension portion 27*a* of the damping device 14 (or the upper case 27 thereof). A tube joint 36 is provided on the upper surface of the end portion 55 of the extension portion 27*a* via an elastic sealing member 56 provided therebetween. Thus, the four ink inlet ports 55*a* through 55*d* of the extension portion 27*a* communicate with four ink outlet ports 30*a*, 30*b*, 30*c*, 30*d* of the tube joint 36 via four ink flow holes 56*a*, 56*b*, 56*c*, 56*d* of the sealing member 56, respectively.

As shown in FIG. 8, the head holder 12 includes an extension portion 12*b* that corresponds to, and is located below, the extension portion 27*a* of the upper case 27 of the damping device 14. The extension portion 12*b* of the head holder 12 extends laterally from an upper end portion of a holder case 12*c* as a main portion of the head holder 12 that supports or accommodates the damping device 14.

Figure 9:
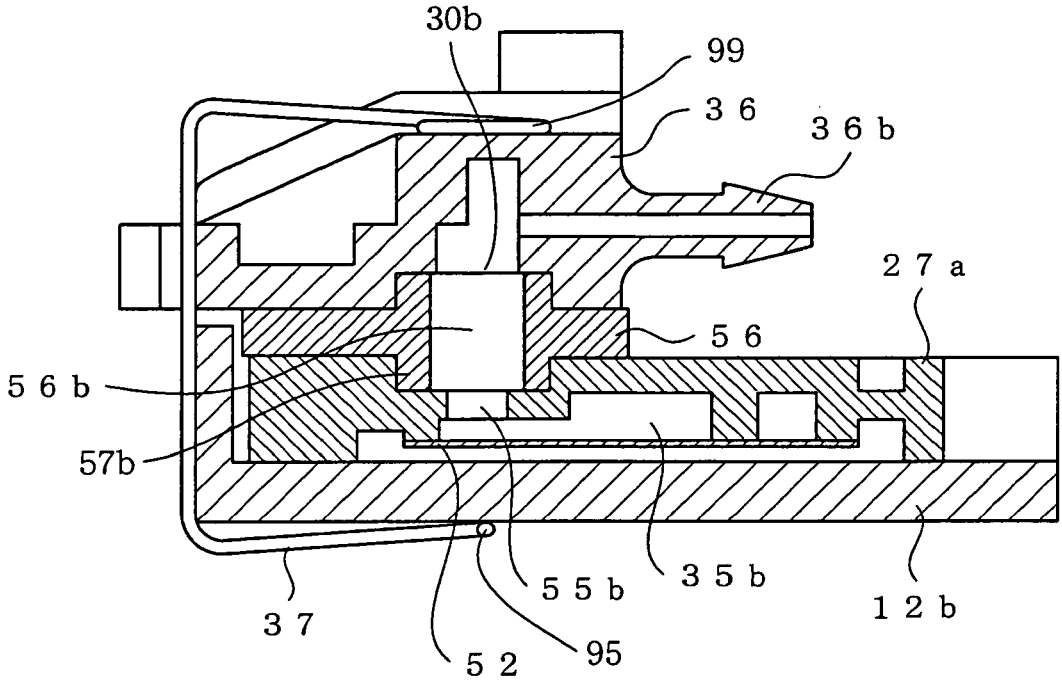
FIG. 9 is a cross-section view of the head holder, taken along 9-9 in FIG. 4.
Figure 10:
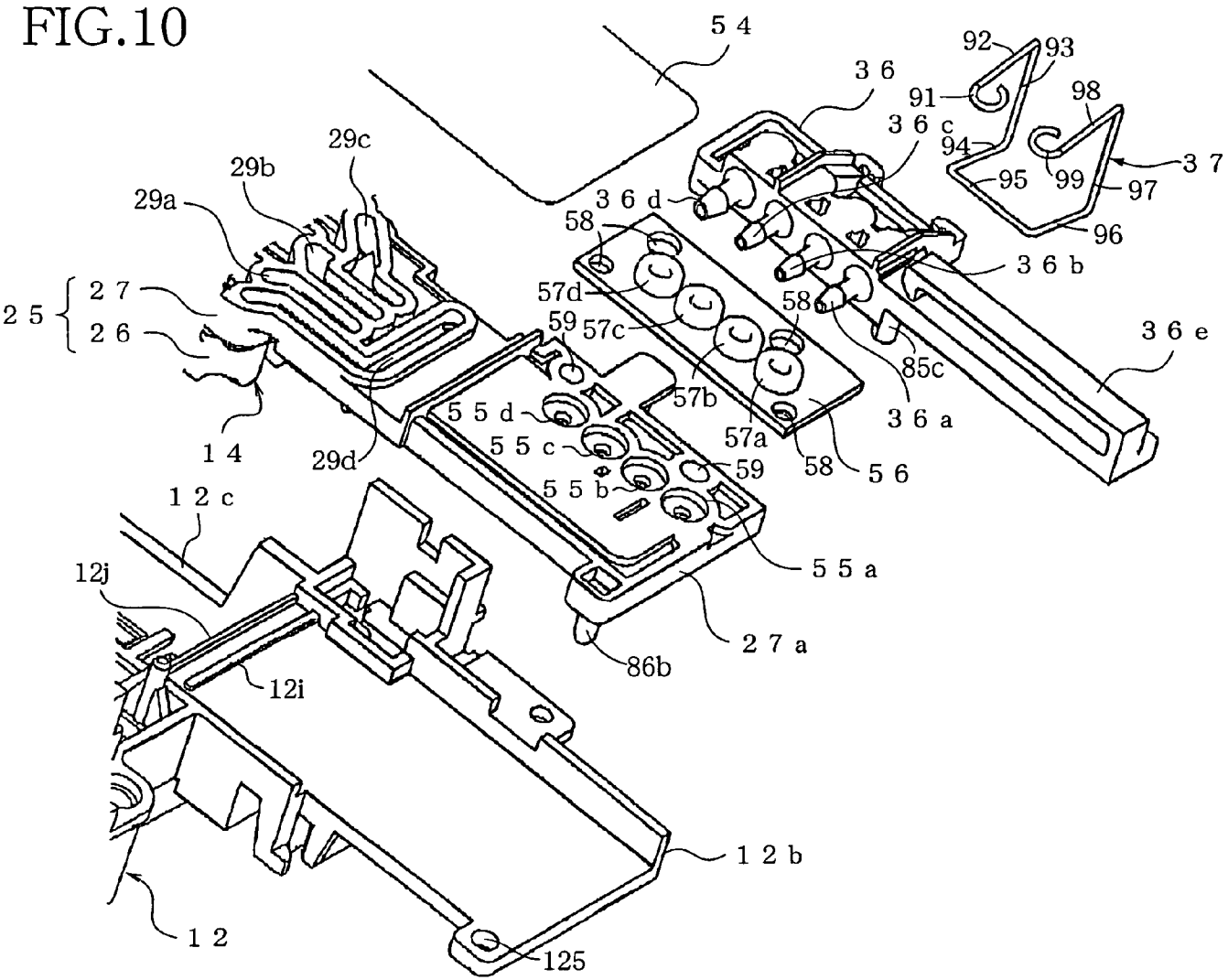
FIG. 10 is an exploded, perspective view of respective extension portions of the head holder and the damping device, an elastic sealing member, a tube joint, and a spring member of the ink jet printer 1.

As shown in FIGS. 9 and 10, a spring member 37 is used to attach, with an elastic force, the tube joint 36 having the four ink outlet ports 30*a* through 30*d*, to the respective extension portions 27*a*, 12*b* of the damping device 14 and the head holder 12.

Thus, the tube joint 36 includes four tube connection portions 36*a*, 36*b*, 36*c*, 36*d* where the four ink supply tubes 13*a* through 13*d* are connected to the four outer ink flow passages 35*a* through 35*d* and the four inner ink flow passages 29*a* through 29*d* that communicate with the four damping chambers 31*a* through 31*d* of the damping device 14, and is provided on the end portion 55 of the extension portion 27*a* of the damping device 14 that is remote from the holder case 12*c* as the main portion of the head holder 12 that holds the recording head 11. Thus, the tube joint 36 including the tube connection portions 36*a* through 36*d* is provided outside the main portion 12*c* of the head holder 12 that holds the recording head 11.

As shown in FIGS. 8 and 10, the extension portion 12*b* of the head holder 12 has, on an upper surface thereof, a first ink dam 12*i* as a projecting wall that prevents, when droplets of ink fall on the extension portion 12*b*, the ink from moving toward the holder case 12*c* of the head holder 12. In addition, as shown in FIG. 8, the extension portion 27*a* of the damping device 14 has, on a lower surface thereof, an elongate wall 27*b* as a projecting wall that is located at a position nearer to the holder case 12*c* than the first ink dam 12*i*, extends along the first ink dam 12*i*, and prevents the ink from moving toward the holder case 12*c*. Moreover, the extension portion 12*b* of the head holder 12 has, on the upper surface thereof, a second ink dam 12*j* as a projecting wall that is located at a position nearer to the holder case 12*c* than the elongate wall 27*b*, extends along the elongate wall 27*b*, and prevents the ink from moving toward the holder case 12*c*. Thus, the two ink dams 12*i*, 12*j* and the elongate wall 27*b* cooperate with each other to define a maze that prevents or restrains a smooth flow of the ink toward the holder case 12*c* of the head holder 12.

As shown in FIG. 10, the second ink dam 12*j* is formed such that two opposite end portions of the second dam 12*j* are integral with two opposite side walls of the extension portion 12*b* of the head holder 12. Thus, the second ink dam 12*j* can substantially completely prevent the movement of the ink from the extension portion 12*b* toward the holder case 12*c*.

Figure 13:
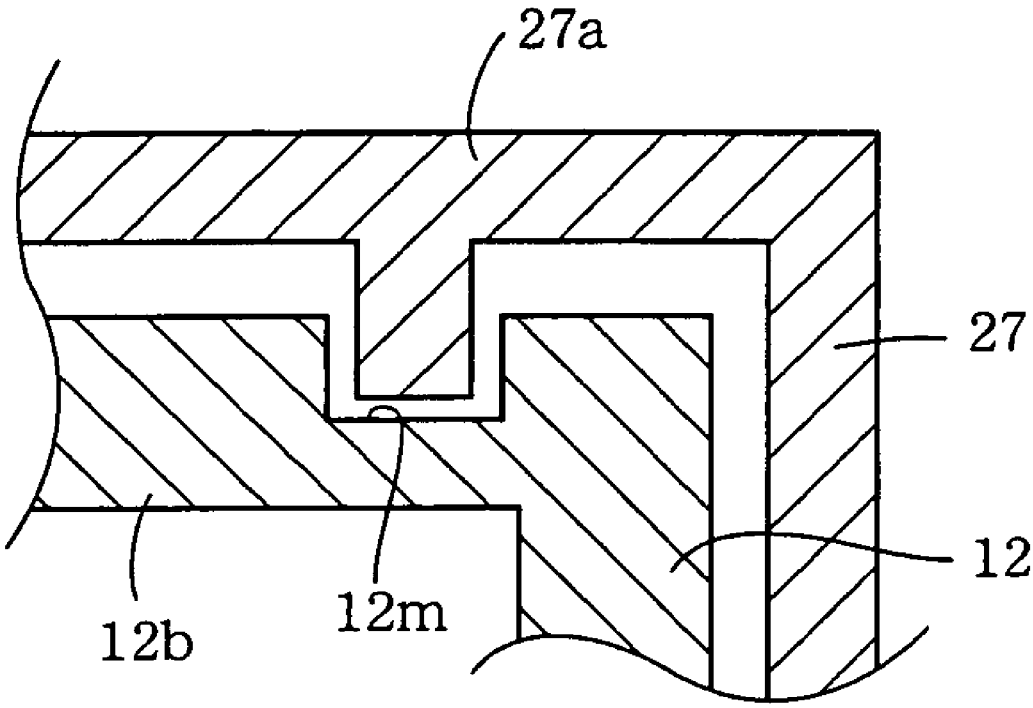
FIG. 13 is a cross-section view of a head holder of a modified embodiment of the ink jet printer 1.

As shown in FIG. 13, the first and second ink dams 12*i*, 12*j* may be replaced with an ink trapping groove 12*m* that extends over an entire distance between the two opposite side walls of the extension portion 12*b* of the head holder 12. In this case, the elongate wall 27*b* of the extension portion 27*a* of the damping device 14 extends into the ink trapping groove 12*m*, such that an appropriate space is left between outer surfaces of the wall 27*b* and inner surfaces of the groove 12*k*. The ink trapping groove 12*m* and the elongate wall 27*b* can substantially completely prevent the movement of the ink from the extension portion 12*b* toward the holder case 12*c*.

Thus, between the respective extension portions 12*b*, 27*a* of the head holder 12 and the damping device 14, and in the vicinity of the holder case 12*c* of the head holder 12, the dams and wall 12*i*, 12*j*, 27*b* and/or the groove 12*m* cooperate with each other to provide an ink-movement preventing portion that prevents the movement of the ink toward the holder case 12*c* of the head holder 12.

As shown in FIG. 4, the tube joint 36 includes the four tube connection portions 36*a* through 36*d*, and has the four ink outlet ports 30*a* through 30*d*. The four ink supply tubes 13*a* through 13*d* that communicate, at respective one ends thereof, with the above-described four ink tanks, respectively, are detachably connected, at the respective other ends thereof, to the four tube connection portions 36*a* through 36*d*, respectively. Below the tube connection portions 36*a* through 36*d* to which the ink supply tubes 13*a* through 13*d* are connected and from which the inks may leak, the two extension portions 12*b*, 27*a* are provided so as to receive the droplets of inks that may leak and fall from the tube connection portions 36*a* through 36*d* and the ink supply tubes 13*a* through 13*d*. However, the head holder 12 and the damping device 14 may be modified such that only one of the two extension portions 12*b*, 27*a* receives the inks leaking from the tube connection portions 36*a* through 36*d* and/or the ink supply tubes 13*a* through 13*d*. The tube joint 36 additionally includes, as an integral portion thereof, a guide portion 36*e* that guides the flexible flat cable 20*a* that connects the first electric-circuit board 22 provided on the head holder 12, to the second electric-circuit board, not shown, provided in the housing.

Figure 7:
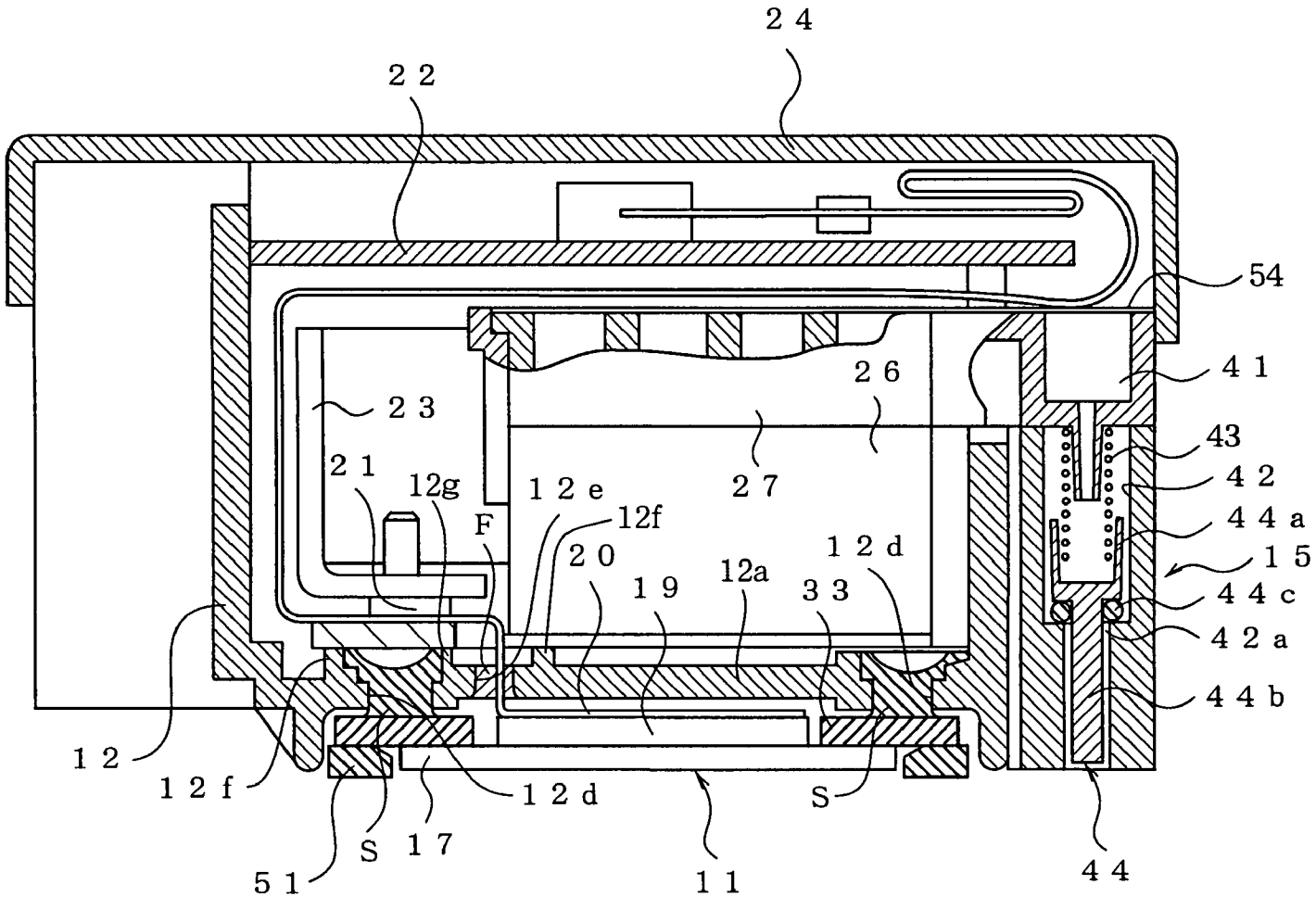
FIG. 7 is a cross-section view of the head holder, taken along 7-7 in FIG. 4.

As shown in FIGS. 3 and 7, the recording head 11 is provided below the bottom wall 12*a* of the holder case 12*c* of the head holder 12, and the bottom wall 12*a* has a plurality of rectangular openings 12*d*, and an elongate opening or a slit 12*e*, and additionally has a plurality of surrounding walls 12*f*, 12*g* each of which entirely or partially surrounds a corresponding one of the openings or slit 12*d*, 12*e*, so as to prevent the inks from entering the openings or slit 12*d*, 12*e*. Thus, each of the surrounding walls 12*f*, 12*g* provides an ink-entering preventing portion which prevents the ink from entering a corresponding one of the openings or slit 12*d*, 12*e*.

The rectangular openings 12*d* are each filled with an adhesive S to fix, by adhesion, the upper surface of the recording head 11 to the lower surface of the bottom wall 12*a* of the head holder 12. The slit 12*e* is used to allow the flexible flat cable 20 to extend through the bottom wall 12*a* so as to be electrically connected to the piezoelectric actuator 19 of the recording head 11. Since each of the surrounding walls 12*f*, 12*g* prevents the inks from entering a corresponding one of the openings 12*d*, the adhesive S that is chemically weak to the components of the inks is not wetted by the inks, and accordingly the adhesive force of the adhesive S is not lowered. In addition, since respective portions of the flexible flat cable 20 and the piezoelectric actuator 19 that are electrically connected to each other are not wetted by the inks, an electric short circuit does not occur.

The bottom wall 12*a* of the head holder 12 has the rectangular openings 12*d*, such that the rectangular openings 12*d* are arranged in two arrays along two long sides of the recording head 11, respectively. One 12*g* of the surrounding walls 12*f*, 12*g* is provided between one array of rectangular openings 12*d* and the slit 12*e*, and prevents the inks from moving into each of the slit 12*e* and the rectangular openings 12*d* of the one array. Thus, the surrounding walls 12*f*, 12*g* enjoy a simple construction.

The slit 12*e* as the opening of the bottom wall 12*a* is entirely surrounded by the surrounding walls 12*f*, 12*g*, and a flat portion 12*h* (FIG. 12) is located between the slit 12*e* and the walls 12*f*, 12*g*. A space left between the flexible flat cable 20 and the slit 12*e* is filled with a sealing material F that fixes the cable 20 to the bottom wall 12*a* and additionally prevents the inks from moving downward to the underside of the bottom wall 12*a*. Since the inks are effectively prevented from moving downward to the underside of the bottom wall 12*a*, the recording head 11 is reliably avoided from being wetted by the inks.

The upper case 27 of the case unit 25 of the damping device 14 has, in the upper surface thereof, four grooves whose upper open ends are closed by the second flexible membrane 54 to define the four air-discharge passages 41 that correspond to the four inks, respectively, are independent of each other, and communicate, at respective one ends thereof, with respective upper portions of the four damping chambers 31*a* through 31*d*. The four air-discharge passages 41 extend across the case unit 25, and communicate, at the respective other ends thereof, respective upper ends of four air-discharge holes 42 that correspond to the four inks, respectively, and are formed through a thickness of the lower case 26.

Figure 6:
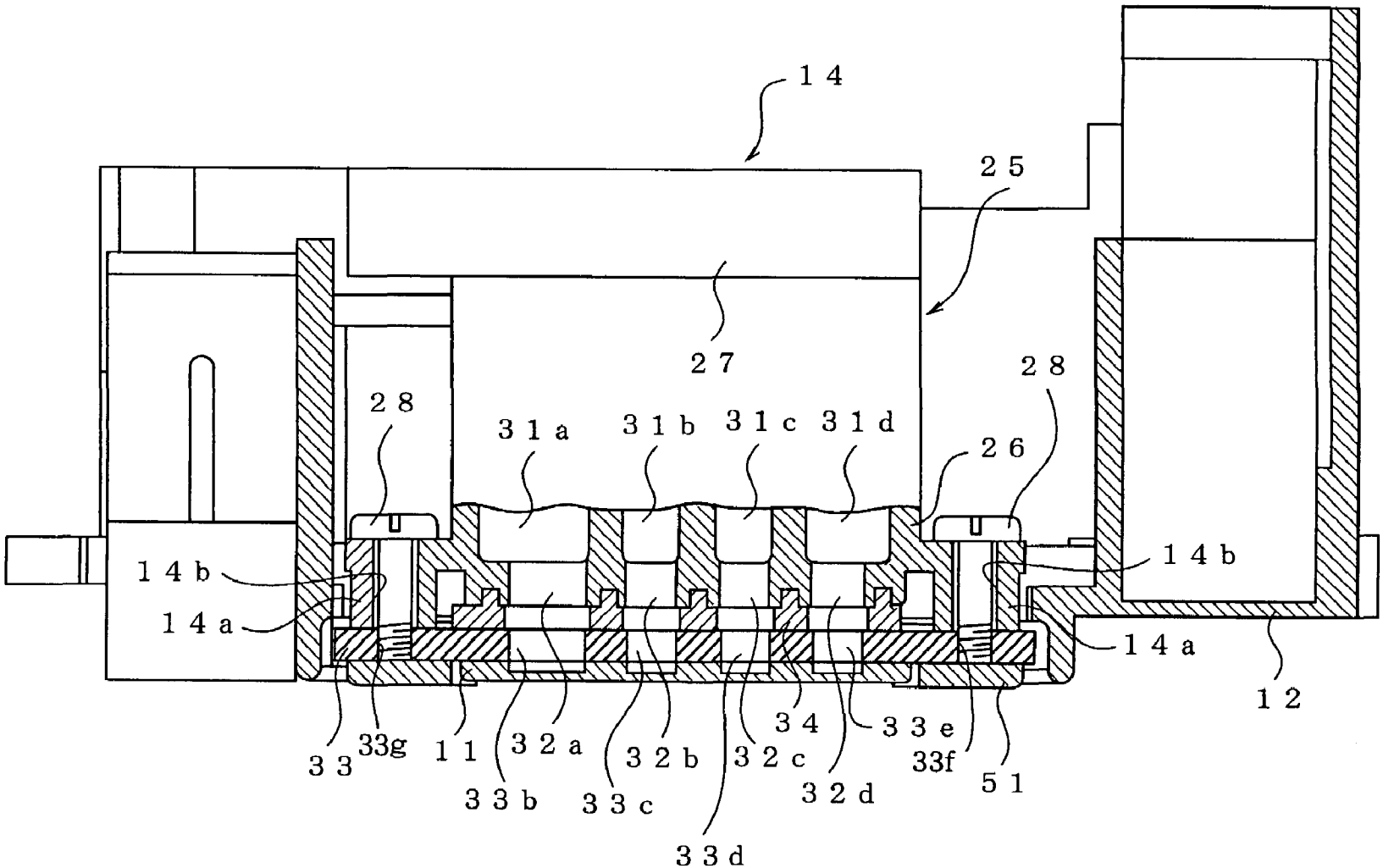
FIG. 6 is a cross-section view of the head holder, taken along 6-6 in FIG. 4.

As shown in FIGS. 3 and 6, the reinforcing frame 33 has, in two corners thereof, two screw holes 33*f*, 33*g*, respectively, and the damping device 14 includes two attaching portions 14*a* that correspond to the two screw holes 33*f*, 33*g*, respectively, and have respective attaching holes 14*b*. Two screws 28 as fastening members are screwed into the two screw holes 33*f*, 33*g* via the two attaching holes 14*b*, respectively, so that the damping device 14 is fixed to the upper surface of the reinforcing frame 33 that is fixed to the lower surface of the bottom wall 12*a* of the head holder 12.

As shown in FIG. 7, each of the four air-discharge holes 42 accommodates a valve member 44 such that the valve member 44 is movable in the each air-discharge hole 42 so as to cause the each hole 42 to communicate with the atmosphere or shut off the each hole 42 from the atmosphere. The valve member 44 includes a large-diameter portion 44*a*, a small-diameter valve rod 44*b* integrally extending downward from a lower end of the large-diameter portion 44*a*, and a sealing portion 44*c* that fits on the valve rod 44*b* such that the sealing portion 44*c* is held in contact with the lower surface of the large-diameter portion 44*a*. Each air-discharge hole 42 has, in an axially intermediate portion thereof, a communication port 42*a* that is closed and opened by the large-diameter portion 44*a* of the valve member 44. Each air-discharge hole 42 additionally accommodates a spring member 45 that biases the valve member 44 in a direction in which the large-diameter portion 44*a* closes the communication port 42*a*.

The valve member 44 is normally pressed in a downward direction by the spring member 45, so that the communication port 42 is closed by the large-diameter portion 44*a* via the sealing portion 44*c* and accordingly the air discharging valve is closed. Meanwhile, when the head holder 12 as the carriage is moved to a waiting position, the respective valve rods 44*b* of the four valve members 44 are pushed upward by four projecting bars of a maintenance unit, not shown, so that the respective large-diameter portions 44*a* and respective sealing portions 44*c* of the four valve members 44 are moved away from the respective communication ports 42*a* of the corresponding air-discharge holes 42 and accordingly the four air discharging valves are opened. In this state, a suction pump, not shown, is driven or operated to suck concurrently the air (or air bubbles) collected by the four damping chambers 31*a* through 31*d* of the damping device 14 and discharge the sucked air into the atmosphere.

Thus, when the four inks are supplied from the four ink storing tanks to the recording head 11 via the four ink supply tubes 13*a* through 13*d*, the four inks are temporarily stored by the four damping chambers 31*a* through 31*d* provided between the four ink supply tubes 13*a* through 13*d* and the recording head 11, so that air bubbles naturally separate from the inks and move upward into the respective upper portions (i.e., air chambers) of the damping chambers 31*a* through 31*d*. Thus, the air (or air bubbles) collected by the damping chambers 31*a* through 31*d* can be discharged by the suction pump.

The cavity unit 17 as part of the recording head 11 includes a nozzle sheet having the arrays of nozzles 16*a* through 16*d*; and a plurality of thin sheets that are provided on the nozzle sheet such that the thin sheets are stacked on, and adhered to, each other to define the ink supply channels communicating with the nozzles 16*a* through 16*d*. The nozzle sheet is made of a synthetic resin such as a polyimide resin, and the thin sheets are each formed of a nickel alloy steel sheet and have a thickness of from 50 μm to 150 μm. The nozzle sheet has the large number of nozzles 16 each of which has a small diameter of about 25 μm and which are arranged in the five arrays 16*a* through 16*d* (FIG. 2) in each of which the nozzles are distant from each other by a small distance. The five arrays of nozzles 16*a* through 16*d* extend in the lengthwise direction of the nozzle sheet or the cavity unit 17, such that in the two arrays of nozzles 16*a* or the two arrays of nozzles 16*b*, 16*c*, the nozzles are arranged in a staggered or zigzag fashion.

An entire lower surface of the sheet-type piezoelectric actuator 19 is pre-coated with an adhesive sheet 19*a* that is formed of an ink-impermeable synthetic resin as a sort of adhesive. This piezoelectric actuator 19 is fixed, by adhesion, to an upper surface of the cavity unit 17 such that the actuator 19 and the cavity unit 17 have an appropriate positional relationship. The flexible flat cable 20 is connected to the upper surface of the piezoelectric actuator 19, such that a large number of electric wirings of the cable 20 are electrically connected to a large number of electrodes of the actuator 19.

Figure 12:
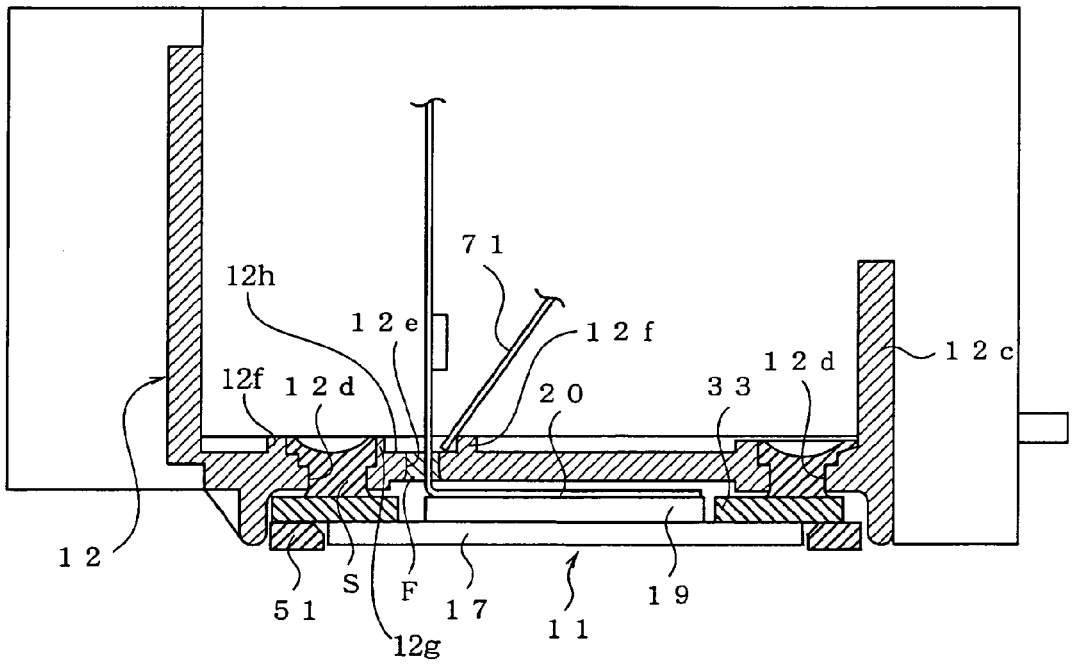
FIG. 12 is a view for explaining a manner in which a sealing material is applied to a slit-like opening 12*e* of a bottom wall of the head holder.

FIG. 12 illustrates a manner in which the space left between the flexible flat cable 20 and the slit 12*e* is filled with the sealing material F. More specifically described, a lower end of a needle 71 such as a metal needle or a hard-resin needle is placed on the flat portion 12*h* located between the slit 12*e* and the surrounding walls 12*f*, 12*g*, and an intermediate portion of the needle 71 is supported on an upper end of the surrounding wall 12*f*. Thus, the flat portion 12*h* and the wall 12*f* function as guide portions for smoothly guiding the movements of the needle 71 to apply the sealing material F to the entire space left between the cable 20 and the slit 12*e*. Thus, the sealing material F can be stably applied using the needle 71, while the needle 71 is prevented from being inadvertently moved to even damage the cable 20.

In case the inks might enter the slit 12*e*, the sealing material F filling the slit 12*e* can prevent the inks from moving downward to the underside of the bottom wall 12*a* of the head holder 12 through the slit 12*e*.

In the present embodiment, when the printer head 1 is replaced with new one, or when the ink supply tubes 13*a* through 13*d* are temporarily detached from the tube joint 36 when the ink jet printer 1 is assembled in a factory, the inks might leak from the tube connection portions 36*a* through 36*d* where the ink supply tubes 13*a* through 13*d* have been attached. Since, however, the tube connection portions 36*a* through 36*d* are located, on the respective extension portions 27*a*, 12*b* of the damping device 14 and the head holder 12, at the respective positions remote from electronic components such as the piezoelectric actuator 19 of the recording head 11, the flexible flat cable 20 connected to the actuator 19, or the driver IC 21 connected to the cable 20, those electronic components are not wetted by the inks. In addition, the inks that have fallen onto the extension portion 12*b* of the head holder 12 are prevented by the ink dams 12*i*, 12*j* and the elongate wall 27*b* from moving toward the electronic components, even if the head holder 12 may be tilted such that the holder case 12*c* is positioned below the extension portion 12*b*. In case the inks might move over the second ink dam 12*j*, the surrounding walls 12*f*, 12*g* prevent the inks from entering the openings and slit 12*d*, 12*e*. Thus, the adhesive S and the sealing material F filling the openings and slit 12*d*, 12*e* are not wetted by the inks, and accordingly the respective portions of the piezoelectric actuator 19 and the flexible flat cable 20 that are electrically connected to each other are not wetted by the inks.

Thus, the recording head 11, in particular, the electronic components thereof are freed of disorders such as an electric short circuit caused by the wetting thereof by the inks.

Figure 1B:
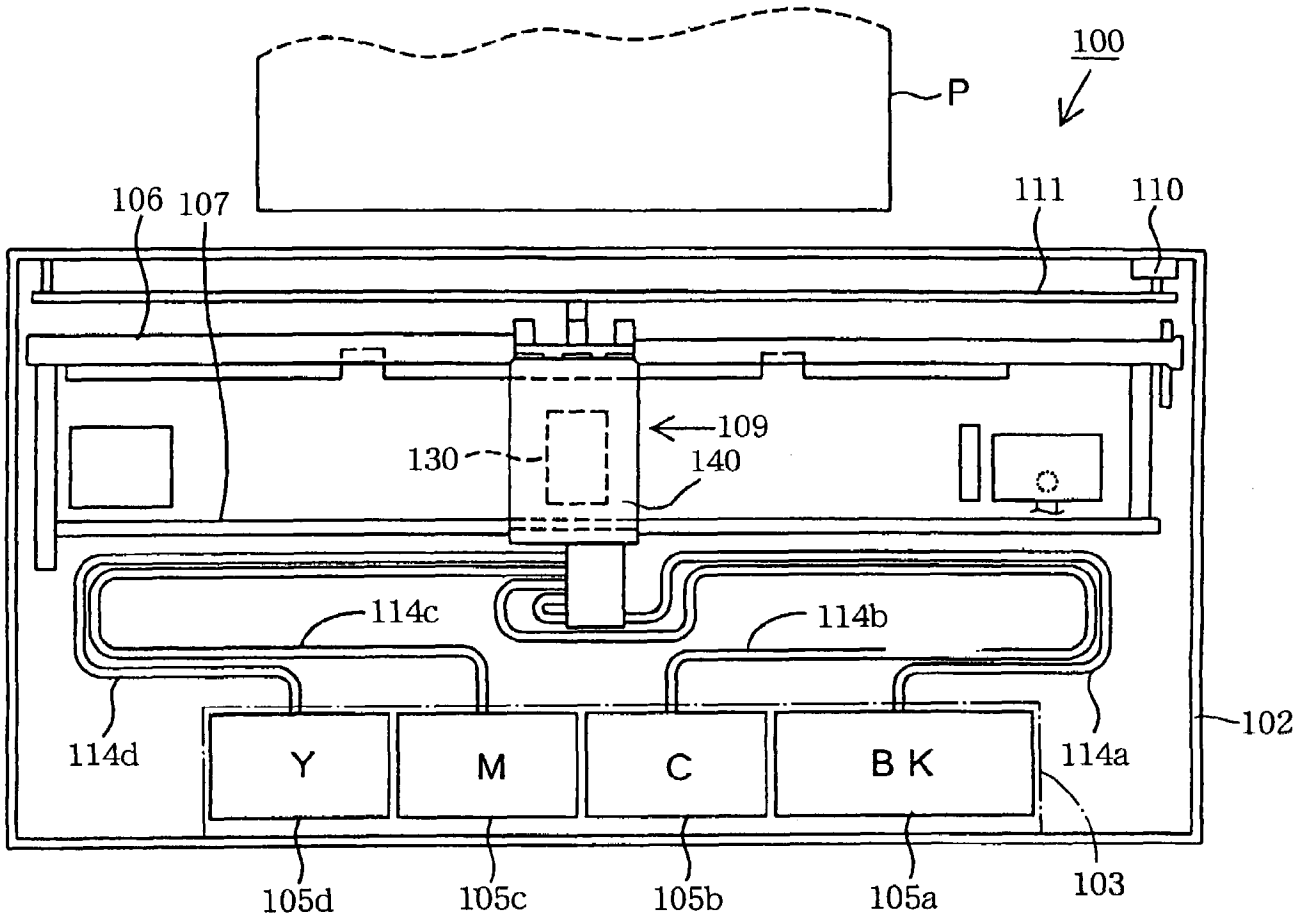
FIG. 1B is a schematic view of pertinent components of another ink jet printer 100 as a second embodiment of the present invention.

FIG. 1B shows a second of the present invention that relates to an ink jet printer 100. In this printer 100, two guide shafts 106, 107 are provided in an inner space of a housing 102 as a stationary frame of the printer 1, and cooperate with each other to support a head holder 109 that also functions as a movable carriage. The head holder 109 holds a recording head 130, and is attached to an endless belt 111 that is moved by an electric motor 110. When the motor 110 is driven or operated, the head holder 109 is moved on the guide shafts 106, 107.

Four ink storing tanks 105*a*, 105*b*, 105*c*, 105*d* are detachably attached to a tank holder or supporter 103 fixed to the housing 102, and are connected to a damping device 140 supported by the head holder 109, via respective flexible ink supply tubes 114*a*, 114*b*, 114*c*, 114*d*. The four ink storing tanks 105*a*, 105*b*, 105*c*, 105*d* store a black ink (BK), a cyan ink (C), a magenta ink (M), and a yellow ink (Y), respectively.

The head holder 109, the recording head 130, and the damping device 140 of the ink jet printer 100 as the second embodiment have respective constructions identical with those of the head holder 12, the recording head 11, and the damping device 14 of the ink jet printer 1 as the first embodiment, and accordingly the description of those elements 109, 130, 140 is omitted.

Next, the ink jet printer 1 as the first embodiment will be described in more detail by reference to FIGS. 14, 15A, 15B, 16, 17, 18A, 18B, and 18C. In the following description, a surface of the recording head 11 from which the inks are ejected will be referred to as the lower surface thereof, and an opposite surface of the head 11 will be referred to as the upper surface thereof.

Here, a construction of a portion of the damping device 14 (or the lower case 26 thereof) that surrounds the four ink flow outlets 32*a*, 32*b*, 32*c*, 32*d* is described. In the following description, a direction in which respective lower open ends of the four ink flow outlets 32*a* through 32*d* are arranged will be referred to as a first direction, and a direction perpendicular to the first direction will be referred to as a second direction. In addition, a direction radially away from a center of the lower open end of each of the four ink flow outlets 32*a* through 32*d* will be referred to as the outward direction of the each ink flow outlet.

Figure 16:
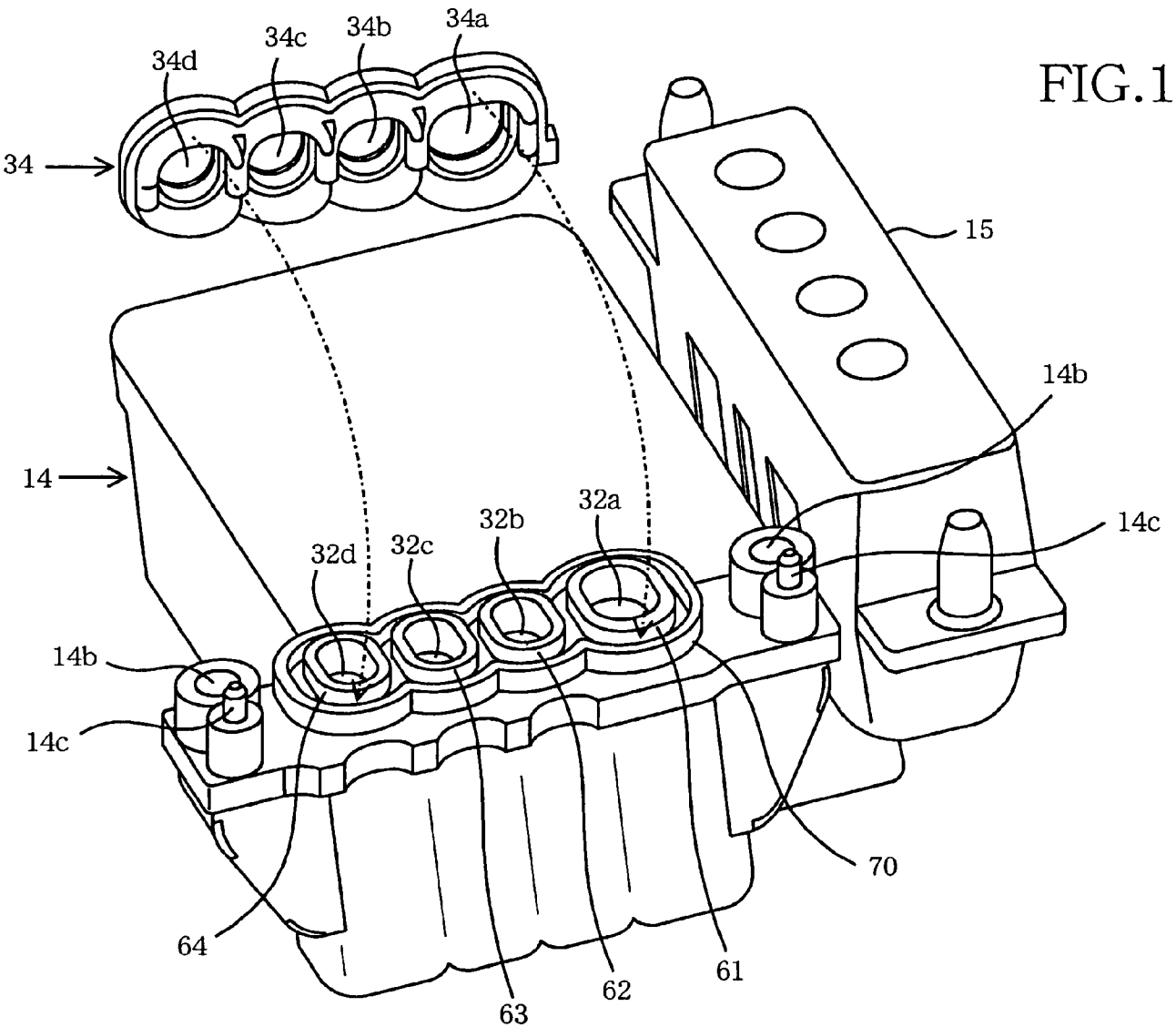
FIG. 16 is a perspective bottom view of the damping device.
Figure 17:
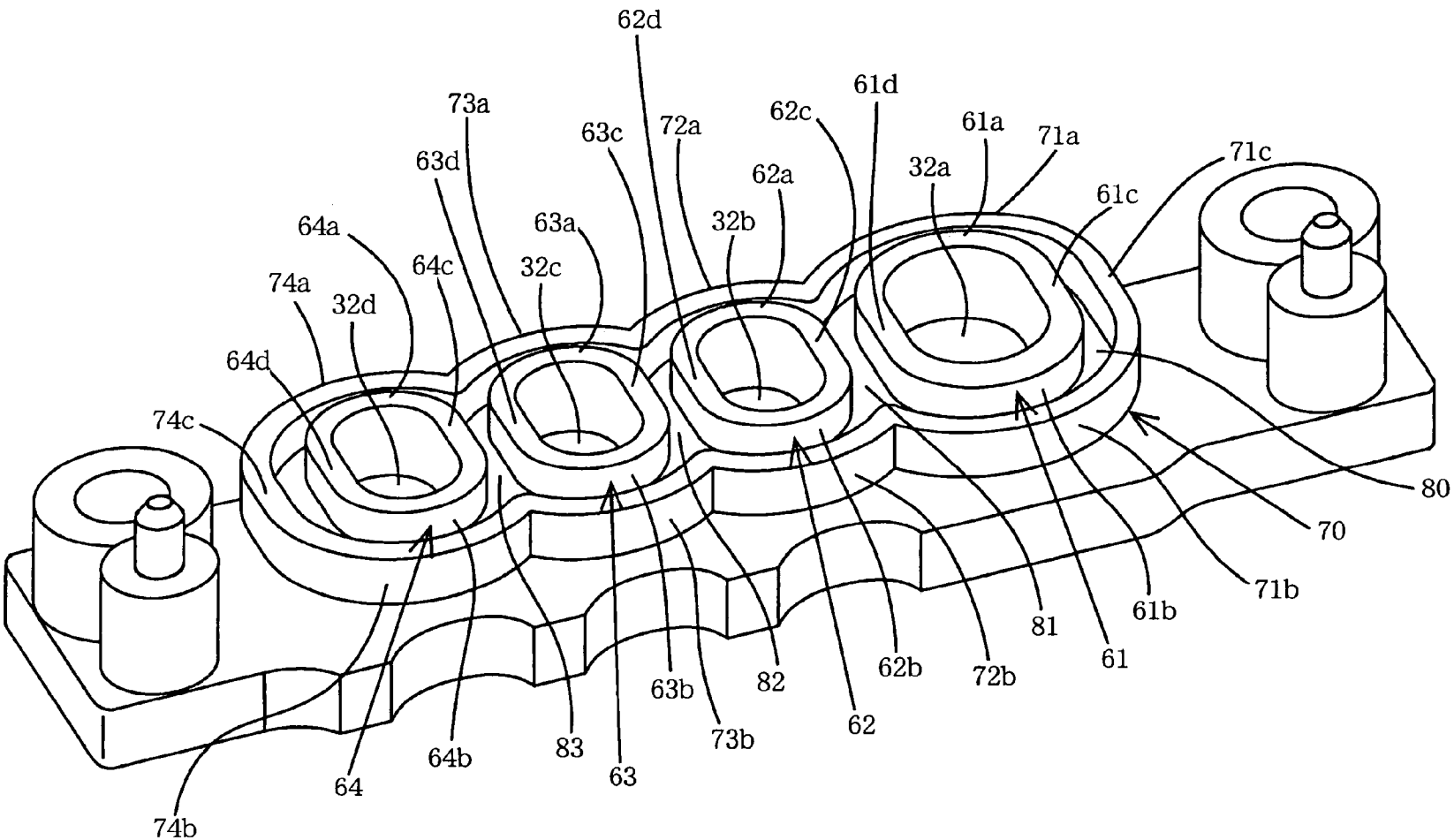
FIG. 17 is a perspective bottom view of ink flow outlets of the damping device.

As shown in FIG. 16, the damping device 14 has, in the lower surface thereof, the generally elliptic, four ink flow outlets 32*a* through 32*d* that communicate with the four damping chambers 31*a* through 31*d*, respectively, and are arranged at a regular interval of distance in a single array such that respective major axes of the four outlets 32*a* through 32*d* extend parallel to each other. The respective lower open ends of the four ink flow outlets 32*a* through 32*d* are surrounded by respective inner ribs 61, 62, 63, 64 having respective elliptic shapes corresponding to the ink flow outlets 32*a* through 32*d*. The four inner ribs 61 through 64 project downward from the lower surface of the damping device 14. As shown in FIG. 17, the first inner rib 61 includes two arcuate portions 61*a*, 61*b* which are opposed to the second direction and each of which is curved in the outward direction, and two straight portions 61*c*, 61*d* which are opposed to each other in the first direction. Similarly, the second inner rib 62 includes two arcuate portions 62*a*, 62*b* which are opposed to the second direction and each of which is curved in the outward direction, and two straight portions 62*c*, 62*d* which are opposed to each other in the first direction; the third inner rib 63 includes two arcuate portions 63*a*, 63*b* which are opposed to the second direction and each of which is curved in the outward direction, and two straight portions 63*c*, 63*d* which are opposed to each other in the first direction; and the fourth inner rib 64 includes two arcuate portions 64*a*, 64*b* which are opposed to the second direction and each of which is curved in the outward direction, and two straight portions 64*c*, 64*d* which are opposed to each other in the first direction.

Thus, three pairs of adjacent straight portions, i.e., the pair of straight portions 61*d*, 62*c*, the pair of straight portions 62*d*, 63*c*, and the pair of straight portions 63*d*, 64*c* are arranged at a regular interval of distance in the first direction, and define three straight inner grooves 81, 82, 83, respectively, therebetween.

The lower open end of the first ink flow outlet 32*a* from which the black ink flows has an area larger than those of the respective lower open ends of the other ink flow outlets 32*b*, 32*c*, 32*d* from which the other inks flow, and accordingly the first inner rib 61 defines an opening having an area larger than those of respective openings of the other inner ribs 62, 63, 64 that are equal to each other in size.

Respective outer surfaces of the four inner ribs 61 through 64 are surrounded by a single common outer rib 70 that is distant by a pre-determined distance from those outer surfaces and projects downward from the lower surface of the damping device 14. More specifically described, the outer rib 70 is formed such that the outer rib 70 is opposed to all the arcuate portions 61*a*, 61*b*, 62*a*, 62*b*, 63*a*, 63*b*, 64*a*, 64*b* and the two straight portions 61*c*, 64*d*, except for the six straight portions 61*d*, 62*c*, 62*d*, 63*c*, 63*d*, 64*c*, i.e., the above-described three pairs of adjacent straight portions.

In other words, the lower open end of each of the four ink flow outlets 32*a* through 32*d*, except for one or two portions of the lower open end that is or are adjacent to one or more adjacent lower open ends, is surrounded by the double ribs 61 through 64, 70. More specifically described, the outer rib 70 includes two straight portions 71*c*, 74*c* that are distant in the outward direction from the respective straight portions 61*c*, 64*d* of the two inner ribs 61, 64 surrounding the respective lower open ends of the two ink flow outlets 32*a*, 32*d* located at respective opposite end positions in the first direction. The respective straight portions 61*c*, 64*d* of the two inner ribs 61, 64 are not adjacent to any of the other open ends. The two straight portions 71*c*, 74*c* generally extend in the second direction perpendicular to the first direction. In addition, the outer rib 70 includes eight arcuate portions 71*a*, 71*b*, 72*a*, 72*b*, 73*a*, 73*b*, 74*a*, 74*b* that are distant in the outward direction from the respective arcuate portions 61*a*, 61*b*, 62*a*, 62*b*, 63*a*, 63*b*, 64*a*, 64*b* of the four inner ribs 61 through 64 that generally extend in the first direction.

The eight arcuate portions 71*a*, 71*b*, 72*a*, 72*b*, 73*a*, 73*b*, 74*a*, 74*b* and the two straight portions 71*c*, 74*c* of the outer rib 70 are formed such that the outer rib 70 has a single continuous shape in its plan view. Thus, the four inner ribs 61 through 64 cooperate with the outer rib 70 to define, therebetween, a single continuous outer groove 80 that is also continuous with the three straight inner grooves 81, 82, 83 defined by the three pairs of adjacent straight portions, i.e., the pair of straight portions 61*d*, 62*c*, the pair of straight portions 62*d*, 63*c*, and the pair of straight portions 63*d*, 64*c*. The elastic sealing member 34, e.g., a rubber bush fits in the grooves 80, 81, 82, 83.

Figure 14:
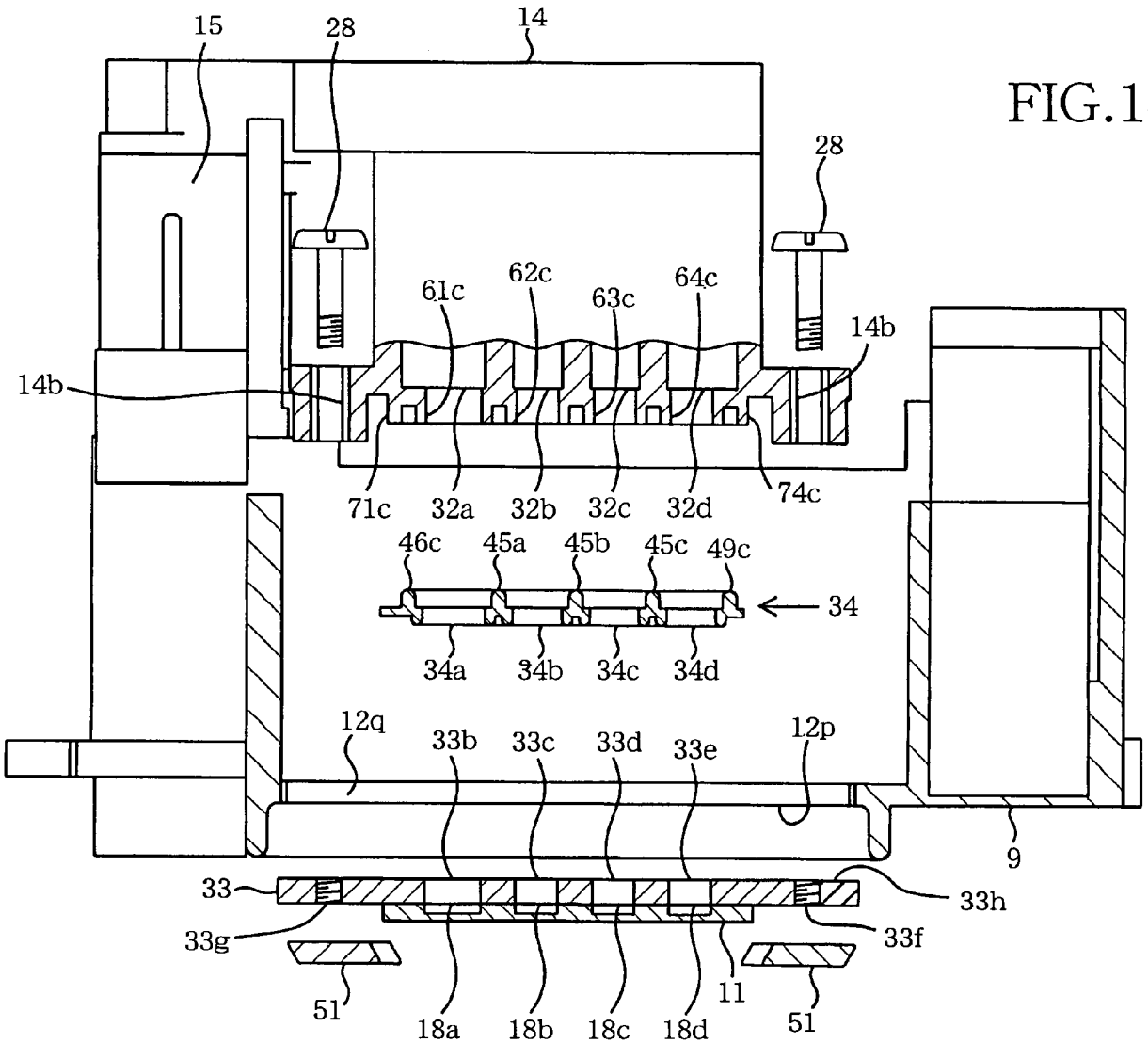
FIG. 14 is a cross-sectioned view for explaining a manner in which the damping device, a rubber bush, the reinforcing frame, and the recording head are connected to each other on the head holder.
Figure 18A:
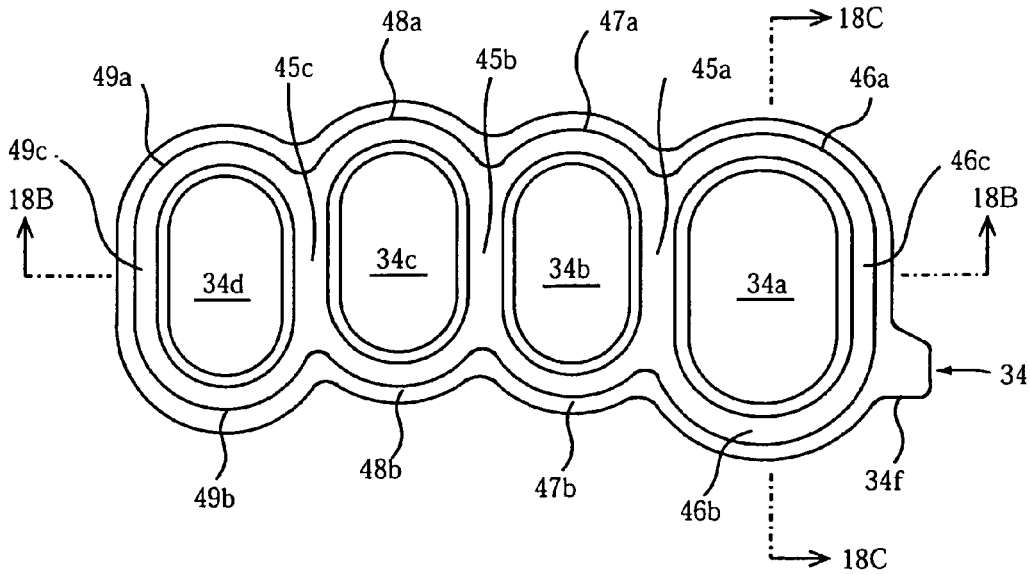
FIG. 18A is a plan view of the rubber bush.
Figure 18B:
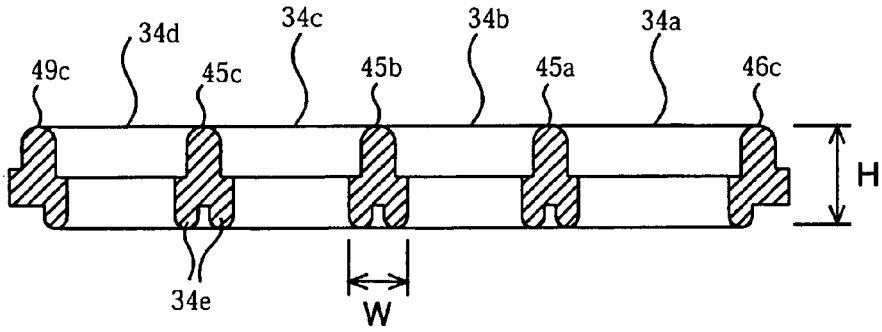
FIG. 18B is a cross-sectioned view taken along 18B-18B in FIG. 18A.
Figure 18C:
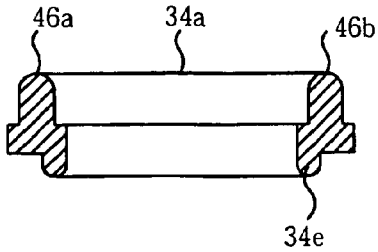
FIG. 18C is a cross-sectioned view taken along 18C-18C in FIG. 18A.

As shown in FIGS. 14 and 16, the rubber bush 34 has four through-holes 34*a*, 34*b*, 34*c*, 34*c* that communicate with the respective lower open ends of the four ink flow outlets 32*a* through 32*d*, and have respective inner surfaces whose shapes correspond to the respective shapes of respective outer surfaces of the four inner ribs 61 through 64. As shown in FIG. 18A, the four through-holes 34*a* through 34*d* are surrounded by eight arcuate sealing portions 46*a*, 46*b*, 47*a*, 47*b*, 48*a*, 48*b*, 49*a*, 49*b* and five straight sealing portions 46*c*, 49*c*, 45*a*, 45*b*, 45*c*, all of which projects from an upper surface of the rubber bush 34 and are continuous with each other. The eight arcuate sealing portions 46*a*, 46*b*, 47*a*, 47*b*, 48*a*, 48*b*, 49*a*, 49*b* cooperate with the two straight sealing portions 46*c*, 49*c*, located at the two opposite end positions, to have a shape corresponding to the shape of the outer groove 80 provided between the four inner ribs 61 through 64, and the outer rib 70, of the damping device 14. The three straight sealing portions 45*a*, 45*b*, 45*c* provided between the four through-holes 34*a* through 34*d* have respective shapes corresponding to the three straight inner grooves 81, 82, 83 provided between the three pairs of adjacent straight portions 61*d*, 62*c*, 62*d*, 63*c*, 63*d*, 64*c* of the four inner ribs 61 through 64.

The rubber bush 34 includes four annular ribs 34*e* that project from a lower surface thereof that is to contact the reinforcing frame 33, and surround respective lower ends of the four through-holes 34*a* through 34*d* of the bush 34. In the state in which the rubber bush 34 contacts the reinforcing frame 33, the four annular ribs 34*e* surround the four ink flow holes 33*a* through 33*d* of the frame 33, independent of each other. A distance W between each pair of adjacent annular ribs 34*e* is smaller than a height H of the rubber bush 34.

The rubber bush 34 additionally includes a projecting portion 34*f* that is provided in a lengthwise end portion of the bush 34. If a person grasps, with fingers, the projecting portion 34*f*, then the person can efficiently fit the rubber bush 34 in the grooves 80 through 83 or remove the bush 34 from the grooves 80 through 83.

The rubber bush 34 is assembled with the damping device 14 and the recording head 11, in an assembling process described below.

As shown in FIG. 14, first, an upper surface 33*h* of the reinforcing member 33 is adhered to a lower surface 9*p* of the bottom wall 12*a* of the head holder 12. The recording head 11 is adhered, in advance, to a lower surface of the reinforcing frame 33.

Subsequently, the rubber bush 34 is attached to the damping device 14, such that the sealing portions 46*a*, 46*b*, 47*a*, 47*b*, 48*a*, 48*b*, 49*a*, 49*b*, 46*c*, 49*c*, 45*a*, 45*b*, 45*c* of the bush 34 fit in the grooves 80, 81, 82, 83 formed between the inner ribs 61, 62, 63, 64 of the damper 14 and between the inner ribs 61 through 64 and the outer rib 70 of the damper 14. Then, the damping device 14 is inserted, in a downward direction, into the head holder 12, such that the ink flow outlets 32*a* through 32*d* of the damper 14 are located in an opening 12*q* formed through the bottom wall 12*a* of the holder 12, and the two positioning pins 14*c* (FIG. 16) projecting downward from two portions of the damping device 14, located on opposite sides of the array of ink flow outlets 32*a* through 32*d*, fit in two positioning holes of the reinforcing frame 33, respectively. Thus, the lower surface of the damping device 14 is opposed to the reinforcing frame 33, such that the through-holes 34*a* through 34*d* of the buffer bush 34 are aligned with the ink flow holes 33*b* through 33*e* of the frame 33, respectively. Subsequently, the two attaching screws 28 are inserted into the two attaching holes 14*b*, respectively, that are formed in the vicinity of the two positioning pins 14*c* of the damping device 14, and respective portions of the two screws 28 that project downward from the two holes 14*b* are screwed into the two screw holes 33*f*, 33*g* of the reinforcing frame 33, respectively.

Figure 15A:
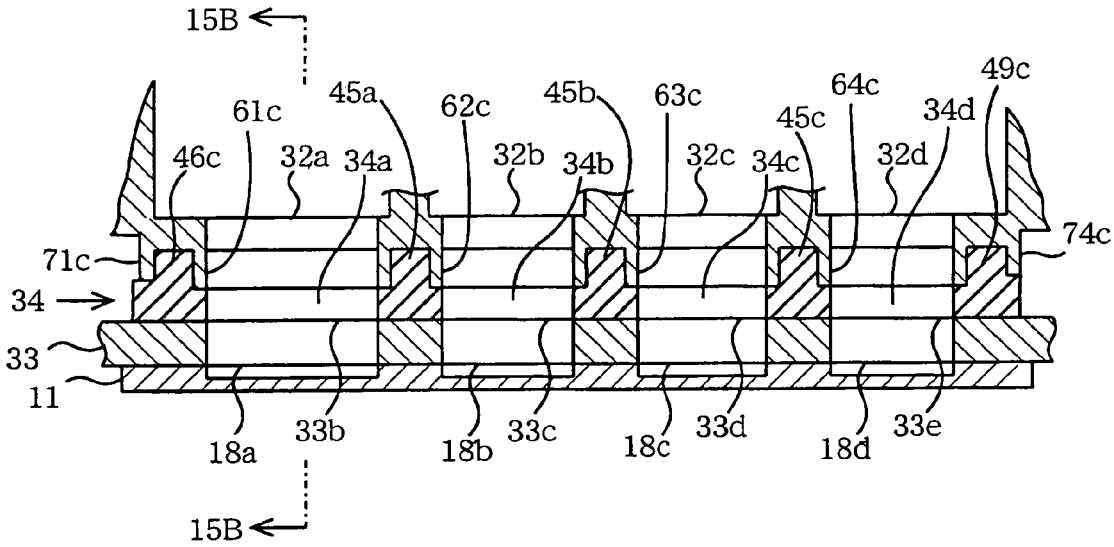
FIG. 15A is a cross-sectioned view showing a state in which the damping device, the rubber bush, the reinforcing frame, and the recording head are connected to each other.
Figure 15B:
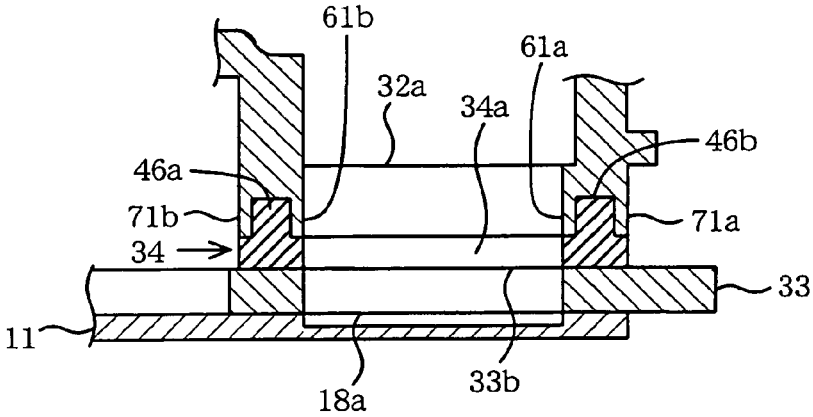
FIG. 15B is a cross-sectioned view taken along 15B-15B in FIG. 15A.

Thus, as shown in FIGS. 15A and 15B, the damping device 14 and the recording head 11 are fixed to each other via the rubber bush 34.

When the attaching screws 28 are screwed into the screw holes 33*f*, 33*g* of the reinforcing frame 33, the damping device 14 and the recording head 11 cooperate with each other to apply a compressing force to the rubber bush 34, so that the bush 34 is compressed in a vertical direction. Consequently the two straight sealing portions 46*c*, 49*c* of the rubber bush 34 are caused to tilt in opposite outward directions, respectively, in the above-indicated first direction, and the four arcuate sealing portions 46*a*, 47*a*, 48*a*, 49*a*, and the four arcuate sealing portions 46*b*, 47*b*, 48*b*, 49*b* are caused to tilt in opposite outward directions in the second direction.

However, the two straight sealing portions 46*c*, 49*c* of the rubber bush 34 that are respectively located at the opposite end portions thereof in the first direction, fit in the groove 80 formed between the double ribs, i.e., the respective straight portions 61*c*, 64*c* of the two inner ribs 61, 64 and the two straight portions 71*c*, 74*c* of the outer rib 70. Thus, as shown in FIG. 15A, the two straight sealing portions 46*c*, 49*c* are effectively prevented from tilting outward in the first direction.

In addition, the eight arcuate sealing portions 46*a*, 46*b*, 47*a*, 47*b*, 48*a*, 48*b*, 49*a*, 49*b* of the rubber bush 34 also fit in the groove 80 formed between the double ribs, i.e., the respective arcuate portions 61*a*, 61*b*, 62*a*, 62*b*, 63*a*, 63*b*, 64*a*, 64*b* of the four inner ribs 61 through 64 and the eight arcuate portions 71*a*, 71*b*, 72*a*, 72*b*, 73*a*, 73*b*, 74*a*, 74*b* of the outer rib 70. Thus, as shown in FIG. 15B, the eight arcuate sealing portions 46*a*, 46*b*, 47*a*, 47*b*, 48*a*, 48*b*, 49*a*, 49*b* are effectively prevented from tilting outward in the second direction.

Moreover, the three straight sealing portions 45*a*, 45*b*, 45*c* of the rubber bush 34 fit in the three straight grooves 81, 82, 83, respectively, formed between the three pairs of adjacent straight portions 61*d*, 62*c*, 62*d*, 63*c*, 63*d*, 64*c* of the four inner ribs 61 through 64. Thus, each of the three straight sealing portions 45*a*, 45*b*, 45*c* is effectively prevented from tilting toward its adjacent ones of the through-holes 34*a* through 34*d*.

Since each of the sealing portions 46*a*, 46*b*, 47*a*, 47*b*, 48*a*, 48*b*, 49*a*, 49*b*, 46*c*, 49*c*, 45*a*, 45*b*, 45*c* of the rubber bush 34 is compressed in the vertical direction, the dimension of the each sealing portion in the outward direction of a corresponding one of the through-holes 34*a* through 34*d* is increased, so that the each sealing portion is held in close contact with a corresponding one of the inner ribs 61 through 64, and the outer rib 70. In addition, each of the ring-like ribs (i.e., annular projections) 34*e* provided on the lower surface of the rubber bush 34 is compressed around a corresponding one of the ink flow holes 33*b* through 33*e* of the reinforcing frame 33, so that the each ring-like rib 34*e* is held in close contact with the frame 33. Thus, the four ink flow outlets 32*a* through 32*d* of the damping device 14 highly liquid-tightly communicate with the four ink flow holes 33*b* through 33*e* of the reinforcing frame 33.

As is apparent from the foregoing description of the ink jet printer 1, the respective lower open ends of the four ink flow outlets 32*a* through 32*d* of the damping device 14 are surrounded by the double ribs that are distant from each other in the respective outward directions of the lower open ends, i.e., the four individual inner ribs 61 through 64 and the single common outer rib 70. Since the sealing portions 45*a*, 45*b*, 45*c*, 46*a*, 46*b*, 46*c*, 47*a*, 47*b*, 48*a*, 48*b*, 49*a*, 49*b*, 49*c* of the rubber bush 34 fit in the grooves 80, 81, 82, 83 formed between the double ribs 61 through 64, 70, the sealing portions are effectively prevented from tilting in the outward directions of the lower open ends of the ink flow outlets 32*a* through 32*d*. Thus, the ink jet printer 1 can enjoy the high liquid tightness around the lower open ends of the ink flow outlets 32*a* through 32*d* of the damping device 14.

The inner ribs 61 through 64 as part of the double ribs have the respective elliptic shapes surrounding the respective lower open ends of the ink flow outlets 32*a* through 32*d*, and the respective inner circumferential surfaces of the through-holes 34*a* through 34*d* of the rubber bush 34 fit on the respective outer surfaces of those elliptic inner ribs 61 through 64. Since the outer surface of each of the elliptic inner ribs 61 through 64 has a larger area than that of an outer surface of an inner rib that does not have a ring-like continuous shape, the inner circumferential surface of each of the through-holes 34*a* through 34*d* of the rubber bush 34 can contact the large outer surface of a corresponding one of the elliptic inner ribs 61 through 64. Thus, the ink jet printer 1 can enjoy the high liquid tightness around the lower open ends of the ink flow outlets 32*a* through 32*d* of the damping device 14.

In particular, the portions of each one of the lower open ends of the ink flow outlets 32*a* through 32*d* which portions are not adjacent to the other open ends are surrounded by the double ribs, i.e., the portions 61*a*, 61*b*, 62*a*, 62*b*, 63*a*, 63*b*, 64*a*, 64*b*, 61*c*, 64*d* of the inner ribs 61 through 64 and the portions 71*a*, 71*b*, 72*a*, 72*b*, 73*a*, 73*b*, 74*a*, 74*b*, 71*c*, 74*c* of the outer rib 70. Since the sealing portions 46*a*, 46*b*, 47*a*, 47*b*, 48*a*, 48*b*, 49*a*, 49*b*, 46*c*, 49*c* of the rubber bush 34 fit in the groove 80 between the above-indicated portions 61*a*, 61*b*, 62*a*, 62*b*, 63*a*, 63*b*, 64*a*, 64*b*, 61*c*, 64*d* of the inner ribs 61 through 64 and the above-indicated portions 71*a*, 71*b*, 72*a*, 72*b*, 73*a*, 73*b*, 74*a*, 74*b*, 71*c*, 74*c* of the outer rib 70, those sealing portions can be effectively prevented from tiling outward and accordingly the lowering of degree of liquid tightness around the lower open ends of the ink flow outlets 32*a* through 32*d* can be effectively prevented.

Above all, the respective lower open ends of the first and fourth ink flow outlets 32*a*, 32*d*, located at the opposite end positions in the first direction, are protected by the double ribs, i.e., the respective straight portions 61*c*, 64*d* of the two inner ribs 61, 64 and the two straight portions 71*c*, 74*c* of the outer rib 70. The two pairs of straight portions 61*c* and 71*c*, 64*d* and 74*c* are located in the vicinity of the respective first portions of the above-indicated two lower open ends that are opposite, in the first direction, to the respective second portions thereof adjacent to the respective lower open ends of the second and third ink flow outlets 32*b*, 32*c*, such that the two pairs of straight portions extend in the second direction perpendicular to the first direction. Since the sealing portions 46*c*, 49*c* of the rubber bush 34 fit in the groove 80 between the above-indicated portions 61*c*, 64*d* of the inner ribs 61, 64 and the above-indicated portions 71*c*, 74*c* of the outer rib 70, those sealing portions can be effectively prevented from tiling outward and accordingly the lowering of degree of liquid tightness around the lower open ends of the ink flow outlets 32*a*, 32*d* can be effectively prevented.

In addition, the respective arcuate portions 61*a*, 61*b*, 62*a*, 62*b*, 63*a*, 63*b*, 64*a*, 64*b* of the four inner ribs 61 through 64 that extend generally in the first direction are protected by the respective arcuate portions 71*a*, 71*b*, 72*a*, 72*b*, 73*a*, 73*b*, 74*a*, 74*b* of the outer rib 70. Since the sealing portions 46*a*, 46*b*, 47*a*, 47*b*, 48*a*, 48*b*, 49*a*, 49*b* of the rubber bush 34 fit in the groove 80 between the above-indicated portions 61*a*, 61*b*, 62*a*, 62*b*, 63*a*, 63*b*, 64*a*, 64*b* of the inner ribs 61 through 64 and the above-indicated arcuate portions 71*a*, 71*b*, 72*a*, 72*b*, 73*a*, 73*b*, 74*a*, 74*b* of the outer rib 70, those sealing portions can be effectively prevented from tiling outward and accordingly the lowering of degree of liquid tightness around the lower open ends of the ink flow outlets 32*a* through 32*d* can be effectively prevented.

Moreover, the outer rib 70, located outside the four inner ribs 61 through 64 surrounding the respective lower open ends of the four ink flow outlets 32*a* through 32*d*, continuously surrounds all the inner ribs 61 through 64. Since the sealing portions 36*a*, 36*b*, 47*a*, 47*b*, 48*a*, 48*b*, 49*a*, 49*b*, 46*c*, 49*c* of the rubber bush 34 fit in the continuous groove 80 formed between the four inner ribs 61 through 64 and the continuous outer rib 70, those sealing portions can be effectively prevented from tiling outward. Thus, the ink jet printer 1 can enjoy the high degree of liquid tightness around the respective lower open ends of the ink flow outlets 32*a* through 32*d*.

Next, a modified embodiment of the ink jet printer 1 will be described by reference to FIG. 19. The same reference numerals as used in the embodiment shown in FIGS. 17 and 18A are used to designate the corresponding elements or parts of the following two modified embodiments of the ink jet printer 1, and the description of those elements or parts is omitted.

Figure 19:
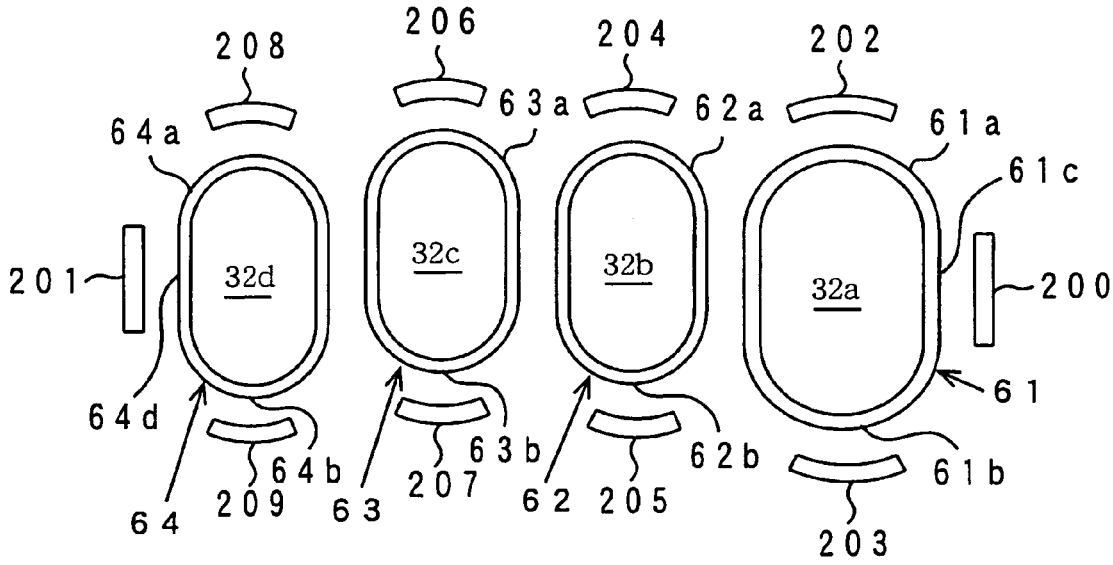
FIG. 19 is a plan view of a modified embodiment of the ink jet printer 1.

In the first modified embodiment shown in FIG. 19, the single continuous outer rib 70 shown in FIG. 17 is replaced with a group of (i.e., ten) discontinuous outer ribs 200, 201, 202, 203, 204, 205, 206, 207, 208, 209. The group of outer ribs include a straight rib 200 that is located outside the straight portion 61*c* of the inner rib 61 and is opposed to the same 61*c*; two arcuate ribs 202, 203 that are located outside the two arcuate portions 61*a*, 61*b* of the inner rib 61, and are opposed to the same 61*a*, 61*b*, respectively; two arcuate ribs 204, 205 that are located outside the two arcuate portions 62*a*, 62*b* of the inner rib 62, and are opposed to the same 62*a*, 62*b*, respectively; two arcuate ribs 206, 207 that are located outside the two arcuate portions 63*a*, 63*b* of the inner rib 63, and are opposed to the same 63*a*, 63*b*, respectively; two arcuate ribs 208, 209 that are located outside the two arcuate portions 64*a*, 64*b* of the inner rib 64, and are opposed to the same 64*a*, 64*b*, respectively; and a straight rib 201 that is located outside the straight portion 64*d* of the inner rib 64 and is opposed to the same 64*d*. The ten outer ribs 200 through 209 project downward from the lower surface of the damping device 14.

When the rubber bush 34 is compressed in the vertical direction by the damping device 14 and the recording head 11, the end portions of the bush 34 are forced to tilt outward and, in particular, the two end portions 46*c*, 49*c* of the bush 34 as seen in the first direction and the four pairs of end portions 46*a*, 46*b*, 47*a*, 47*b*, 48*a*, 48*b*, 49*a*, 49*b* of the bush 34 as seen in the second direction are strongly forced to tilt outward.

However, the modified embodiment shown in FIG. 11 employs the ten outer ribs 200 through 209, and accordingly ten pairs of double ribs 61 through 64, 200 through 209, at only respective locations where the two end portions 46*c*, 49*c* of the bush 34 as seen in the first direction and the four pairs of end portions 46*a*, 46*b*, 47*a*, 47*b*, 48*a*, 48*b*, 49*a*, 49*b* of the bush 34 as seen in the second direction are located, so that those end portions of the bush 34 fit in respective grooves defined by the ten pairs of double ribs. Thus, all the end portions of the bush 34 as seen in the first and second directions can be effectively prevented from tilting outward.

Since the modified embodiment shown in FIG. 19 differs from the ink jet printer 1 only in that the single continuously outer rib 70 of the printer 1 is replaced with the ten discontinuous outer ribs 200 through 209 in the modified embodiment, the modified embodiment can enjoy the same advantages as the above-described advantages of the ink jet printer 1.

Next, another modified embodiment of the ink jet printer 1 will be described by reference to FIGS. 20A, 20B, and 20C.

This modified embodiment employs a damping device 290 in place of the damping device 14 employed by the ink jet printer 1, and a recording head 300 substantially equivalent to two recording heads each of which is similar to the recording head 11 of the printer 1.

Figure 20A:
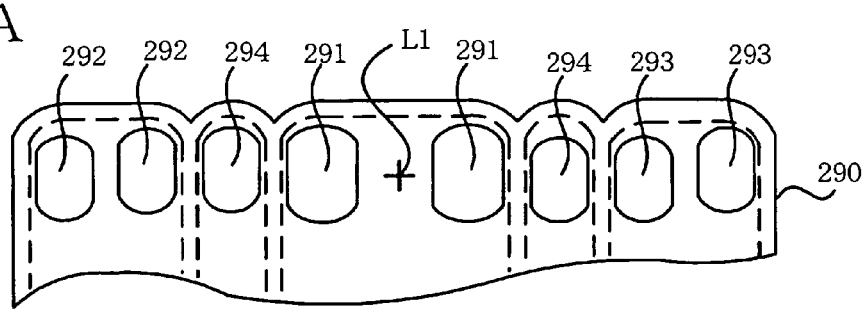
FIG. 20A is a plan view of a damping device of another embodiment of the ink jet printer 1.

As shown in FIG. 20A, the damping device 290 has, in a lower surface thereof, respective lower open ends of two ink flow outlets 291 from which a black ink (BK) flows and which belong to two groups of ink flow outlets, respectively; two ink flow outlets 292 from which a cyan ink (C) flows and which belong to the first group of ink flow outlets (i.e., the left-hand group in FIG. 20A); two ink flow outlets 293 from which a magenta ink (M) flows and which belong to the second group of ink flow outlets (i.e., the right-hand group in FIG. 20A); and two ink flow outlets 294 from which a yellow ink (Y) flows and which belong to the first and second groups of ink flow outlets, respectively. The first group of ink flow outlets 291, 294, 292, 292 and the second group of ink flow outlets 291, 294, 293, 293 are symmetric with each other with respect to a middle point L1 between the two ink flow outlets 291. That is, if the first group of ink flow outlets 291, 294, 292, 292 are rotated by 180 degrees about the point L1, then the first group of ink flow outlets coincide with the second group of ink flow outlets 291, 294, 293, 293.

Though the damping device 290 employed by this modified embodiment has, for each group of ink flow outlets, four inner ribs and a single outer rib that are respectively identical with the four inner ribs 61 through 64 and the single outer rib 70 of the damping device 14 of the ink jet printer 1, those inner and outer ribs are not shown in FIG. 20A, for easier understanding purposes only. Therefore, if the first group of inner and outer ribs for the first group of ink flow outlets 291, 294, 292, 292 are rotated by 180 degrees about the point L1, then the first group of inner and outer ribs coincide with the second group of inner and outer ribs for the second group of ink flow outlets 291, 294, 293, 293.

Figure 20B:
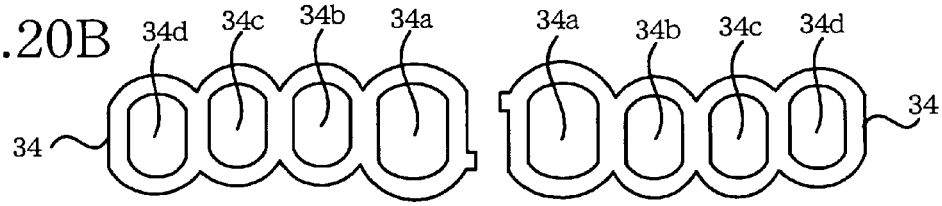
FIG. 20B is a plan view of rubber bushes employed by the modified ink jet printer of FIG. 20A.
Figure 20C:
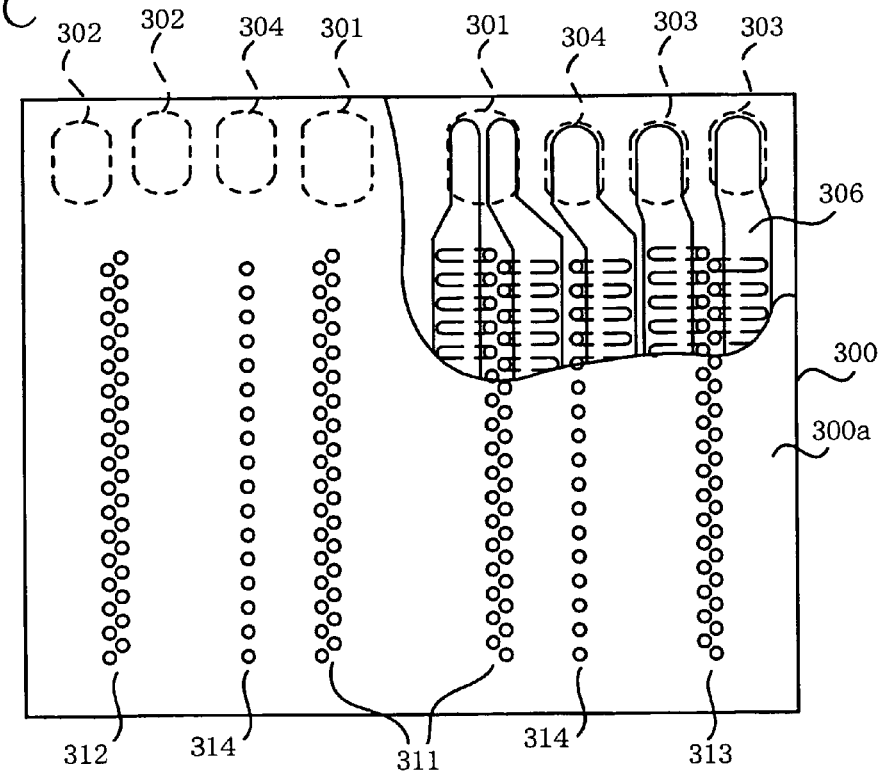
FIG. 20C is a plan view of a recording head employed by the modified ink jet printer of FIG. 20A.

As shown in FIG. 20C, the recording head 300 has, at respective positions corresponding to the eight ink flow outlets 291 through 294 of the damping device 14, two ink supply holes 301 corresponding to the black ink, two ink supply holes 302 corresponding to the cyan ink, two ink supply holes 303 corresponding to the magenta ink, and two ink supply holes 304 corresponding to the yellow ink. In addition, the recording head 300 has, in a nozzle-support surface 300*a* thereof, four central arrays of nozzles 311 corresponding to the black ink; two arrays of nozzles 314 corresponding to the yellow ink that are located on either side of the black-ink nozzles 311; two arrays of nozzles 312 corresponding to the cyan ink that are located outside one of the two arrays of nozzles 314; and two arrays of nozzles 313 corresponding to the magenta ink that are located outside the other array of nozzles 314. The four inks are supplied from the eight ink flow inlets 301 through 304 to the ten arrays of nozzles 311 through 314 via ten ink flow channels 306, respectively. As shown in FIG. 20C, each of the two ink flow inlets 291 corresponding to the black ink communicates with two ink flow channels 306; and each of the other, six ink flow inlets 292, 293, 294 corresponding to the cyan, magenta and yellow inks communicates with one ink flow channel 306.

A rubber bush 34 shown in a left-hand half portion of FIG. 20B fits in grooves defined by the above-described first group of inner and outer ribs, not shown, formed around the left-hand group of ink flow outlets 291, 294, 292, and another rubber bush 34 shown in a right-hand half portion of FIG. 20B fits in grooves defined by the above-described second group of inner and outer ribs formed around the right-hand group of ink flow outlets 291, 294, 293. The two rubber bushes 34 have an identical shape and, if the left-hand rubber bush 34 is rotated by 180 degrees about an axis line perpendicular to the drawing sheet of FIG. 20B, then the left-hand bush 34 coincides with the right-hand bush 34.

Since the respective lower open ends of the eight ink flow outlets 291 through 294 belonging to the two groups of ink flow outlets can be sealed with the two identical rubber bushes 34, the manufacturing cost of this modified ink jet printer can be reduced as compared with the case where two rubber bushes having different shapes are used.

The ink jet printer 1 may be otherwise modified. For example, the modified embodiment shown in FIG. 19 may be further modified by omitting the eight arcuate outer ribs 202 through 209, i.e., employing the two straight outer ribs 200, 201 only. Alternatively, this modified embodiment may be further modified by omitting the two straight outer ribs 200, 201 and employing the eight arcuate outer ribs 202 through 209 only. Otherwise, this modified embodiment may be further modified by omitting the four arcuate outer ribs 204, 205, 206, 207 and employing the two straight outer ribs 200, 201 and the other, four arcuate outer ribs 202, 203, 208, 209 only. In the case where only a particular end portion of the rubber bush 34 highly tends to tilt outward when the bush 34 is compressed, the damping device 14 may be formed to have double ribs at only a location corresponding to the particular end portion of the rubber bush 34.

In addition, in the modified embodiment shown in FIG. 19, the straight or arcuate outer ribs 200 through 209 may be replaced with a plurality of cylindrical ribs, triangle-pole ribs, square-pole ribs, or prismatic ribs that extend in the vertical direction. That is, the outer ribs 200 through 209 may be modified to have any shape so long as one or more end portions of the rubber bush 34 can be effectively prevented from tilting outward.

Moreover, each of the inner ribs 61 through 64 may be modified to have a different shape than the elliptic shape, such as a circular shape. In this case, the outer rib 70 or the outer ribs 200 through 209 may be modified to have a shape or shapes corresponding to the modified shapes of the inner ribs 61 through 64. In addition, each of the continuous inner ribs 61 through 64 may be replaced with a plurality of discontinuous portions arranged around the lower open end of a corresponding one of the ink flow outlets 32*a* through 32*d*.

Figure 21A:
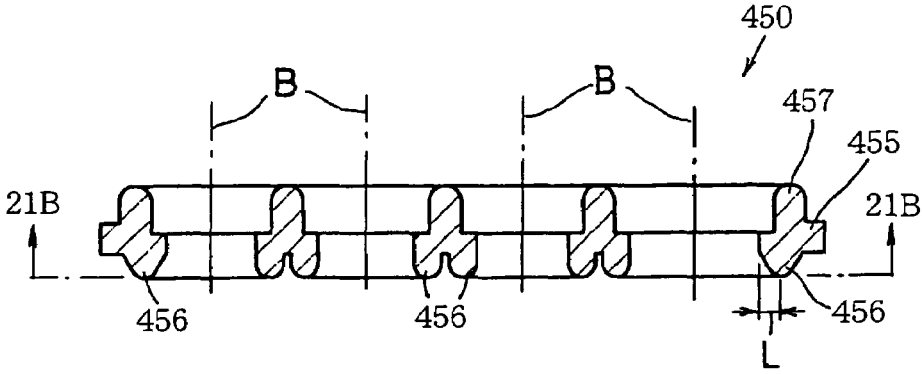
FIG. 21A is a cross-sectioned view of a rubber bush employed by another modified embodiment of the ink jet printer 1.
Figure 21B:
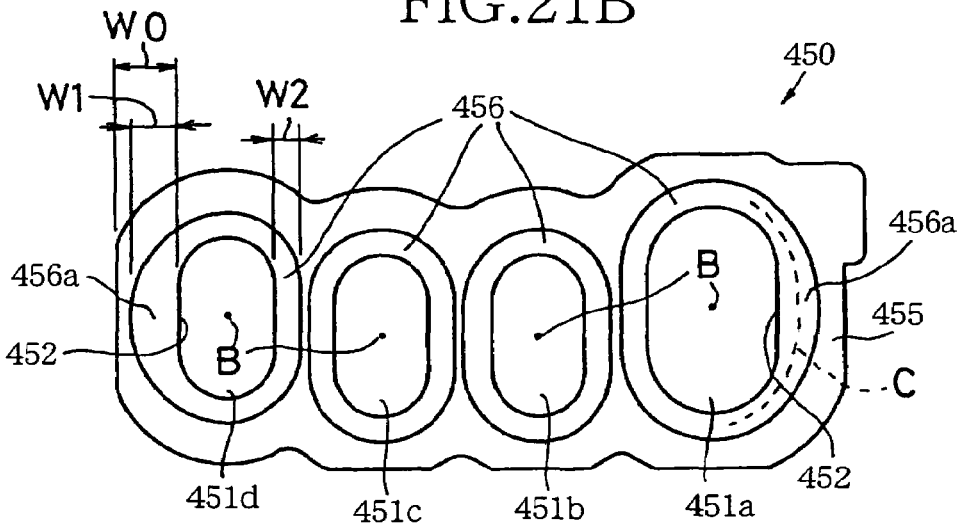
FIG. 21B is a plan view of the rubber bush of FIG. 21A

In a different embodiment of the present invention, the rubber bush 34 employed by the ink jet printer 1 is replaced with an elastic member (e.g., a rubber bush) 450 shown in FIGS. 21A, 21B, and 22C.

As shown in FIG. 21B, the elastic member 450 has four through-holes 451*a*, 451*b*, 451*c*, 451*d* that are arranged in an array in a first direction and communicate with the four ink flow inlets 18*a*, 18*b*, 18*c*, 18*d* of the recording head 11 (the cavity unit 17), respectively, and with the four ink flow outlets 32*a*, 32*b*, 32*c*, 32*d* of the damping device 14, respectively. Thus, the elastic member 450 is elongate in the first direction. Each of the through-holes 451*a* through 451*d* has a generally elliptic shape having a minor axis in the first direction and a major axis in a second direction perpendicular to the first direction.

Since, in the present embodiment, the ink flow outlet 32*a* from which the black ink (BK) flows has a larger area than those of the other ink flow outlets 32*b*, 32*c*, 32*d*, the through-hole 451*a* through which the black ink flows has a larger area than those of the other through-holes 451*b*, 451*c*, 451*d*. In addition, since the reinforcing frame 33 is provided on the upper surface of the recording head 11 and is integrated with the same 11, and accordingly the ink flow inlets 18*a* through 18*d* of the head 11 communicate with the ink flow holes 33*b* through 33*e* of the frame 33, respectively, the through-holes 451*a* through 451*d* of the elastic member 450 communicate with the ink flow inlets 18*a* through 18*d* of the recording head 11 via the ink flow holes 33*b* through 33*e* of the frame 33, respectively. However, the reinforcing frame 33 may be omitted.

More specifically described, the elastic member 450 includes a flat base portion 455 that defines the through-holes 451*a* through 451*d* and extends on a plane perpendicular to respective axis lines B of the through-holes 451*a* through 451*d*. The elastic member 450 additionally includes four first annular projections (ring-like ribs) 456 that project, parallel to the axis lines B, from the base portion 455 toward the four ink flow inlets 18*a* through 18*d*, respectively, and surround the four through-holes 451*a* through 451*d*, respectively. Since the first annular projections 456 surround the generally elliptic through-holes 451*a* through 451*d* arranged in the array in the first direction, the first annular projections 456 are arranged in an array in the first direction and each of the first annular projections 456 has a generally elliptic shape having a manor axis in the first direction and a major axis in the second direction.

Each of two outer first annular projections 456 located at respective opposite ends of the array of first annular projections 456 in the first direction has, in the vicinity of the base portion 455, a variable thickness as measured in radial directions from the axis line B of a corresponding one of the two outer through-holes 451*a*, 451*d*. More specifically described, each of the two outer first projections 456 includes a thick portion 456*a* that has, in the vicinity of a substantially middle portion of an elongate inner surface 452 of the corresponding outer through-hole 451*a*, 451*d*, a thickness W1 greater than a thickness W2 of a remaining portion of the each of the two outer first projections 456 and the entirety of each of the other, two inner first projections 456 corresponding to the two inner through-holes 451*b*, 451*c*, as shown in FIG. 21B. Thus, the thick portion 456*a* of each of the two outer first projections 456 is effectively prevented from tilting outward in the first direction.

The above-indicated remaining portion of each of the two outer first projections 456, and the entirety of each of the two inner first projections 456, that have the smaller thickness W2 include respective straight elongate portions that extend in the second direction and are adjacent to each other in the first direction, and respective pairs of arcuate short portions that extend in the first direction.

The thick portion 456*a* of each of the two outer first projections 456 has, in the vicinity of the middle portion of the elongate inner surface 452 of the corresponding outer through-hole 451*a*, 451*d*, an inverted-triangular tapered cross section whose thickness gradually decreases in a direction away from the base portion 455 toward a tip of the thick portion 456*a*, as shown in FIG. 21A. Thus, the thick portion 456*a* has an increased thickness in the first direction, and is not easily tilted outward in the first direction.

In addition, a distance L (FIG. 21A) in the first direction between the tip (ridge line) of each of the two thick portions 456*a* and the elongate inner surface 452 of the corresponding outer through-hole 451*a*, 451*d* gradually increases in a direction away from each of lengthwise opposite ends of the elongate inner surface 52 toward the middle portion of the same 52. In the present embodiment, the elongate inner surface 452 of each of the two outer through-holes 451*a*, 451*d* is substantially plane or flat, whereas the tip (ridge line) of the middle portion of each of the two thick portions 456*a* is curved outward in the first direction, as indicated at broken line in FIG. 21B. Thus, the outward tilting of the thick portion 456*a* can be effectively prevented.

The four first annular projections 456 have the respective annular shapes suitable for surrounding the four through-holes 451*a* through 451*d*, independent of each other, and cooperate with each other to include three pairs of straight elongate portions each pair of which are adjacent to each other in the first direction and extend in the second direction, as shown in FIGS. 21A and 21B.

Each of two opposite end portions of the base portion 455 in the first direction that extend along the two outer through-holes 451*a*, 451*d*, respectively, in the second direction has a width W0 in the first direction, and a corresponding one of the two thick portions 456*a* extending along the respective elongate inner surfaces 52 of the two outer through-holes 451*a*, 451*d* is provided on the each end portion having the width W0, such that the one thick portion 456*a* is located or biased on the side of the corresponding outer through-hole 451*a*, 451*d*, i.e., a wide free space is left opposite to the through-hole 451*a*, 451*d*.

A distance between the inner circumferential surface of each of the through-holes 451*a* through 451*d* and the outer circumferential surface (i.e., side surface) of the base portion 455 is substantially constant, i.e., substantially equal to the above-indicated width W0. In addition, a distance between each pair of through-holes adjacent to each other in the first direction, i.e., the pair of through-holes 451*a*, 451*b*, the pair of through-holes 451*b*, 451*c*, and the pair of through-holes 451*c*, 451*d*, is substantially equal to the width W0. Thus, the degree of contacting of the base portion 455 with the inner and outer ribs 61 through 64, 70 of the damping device 14 is substantially constant or uniform with respect to the entire inner circumference of each of the through-holes 451*a* through 451*d*.

Meanwhile, the elastic member 450 additionally includes four second annular projections 457 that project, parallel to the respective axis lines B of the four through-holes 451*a* through 451*d*, from the base portion 455 toward the four ink flow outlets 32*a* through 32*d*, respectively, and surround the four through-holes 451*a* through 451*d*, respectively. Thus, the four second annular projections 457 are arranged in an array in the first direction. Like the sealing portions 45*a*, 45*b*, 45*c*, 46*a*, 46*b*, 46*c*, 47*a*, 47*b*, 48*a*, 48*b*, 49*a*, 49*b*, 49*c* shown in FIG. 18A, the four second annular projections 457 are continuous with each other in the first direction. More specifically described, like each of the three straight portions 45*a*, 45*b*, 45*c* shown in FIG. 18A, each pair of second annular projections 457 adjacent to each other in the first direction are integrated with each other at respective inner straight portions thereof located between the corresponding pair of adjacent through-holes 451*a* and 451*b*, 451*b* and 451*c*, or 451*c* and 451*d*, such that the integrated straight portion of the each pair of adjacent second projections 457 is located right above a middle position between the respective inner, parallel straight portions of the corresponding pair of adjacent first projections 456. In addition, as shown in FIG. 21A, two outer second annular projections 457 located at the respective opposite ends of the array of second annular projections 457 in the first direction include respective outer portions corresponding to the respective thick portions 356*a* of the two outer first annular projections 456, and each of those outer portions of the two outer second projections 457 is located on a substantially middle portion of a corresponding one of the respective opposite end portions of the base portion 455 in the first direction. More specifically described, each of the respective outer portions of the two outer second projections 457 projects from the upper surface of the base portion 455, while being spaced from a corresponding one of the two outer through-holes 451*a*, 451*d* and the outer circumferential (or side) surface of the base portion 455.

The four second annular projections 457 fit in the three inner grooves 81, 82, 83 formed between the four inner ribs 61 through 64 and the single outer groove 80 that is formed between the inner ribs 61 through 64 and the outer rib 70 and is continuous with the inner grooves 81 through 83. The second projections 457 have a height greater than the depth of the grooves 80 through 83 and, in the state in which the elastic member 450 is assembled with, and sandwiched by, the damping device 14 and the reinforcing member 33, the bottom surface of the grooves 80 through 83 press the second projections 457 with a greater force than a force with which the inner and outer ribs 61 through 64, 70 press the base portion 455. Thus, the through-holes 451*a* through 451*d* of the elastic member 450 can be liquid-tightly sealed independent of each other.

The elastic member 450 is assembled with the damping device 14 and the recording head 11 (or the reinforcing member 33), in the same manner as described above by reference to FIG. 14.

Figure 21C:
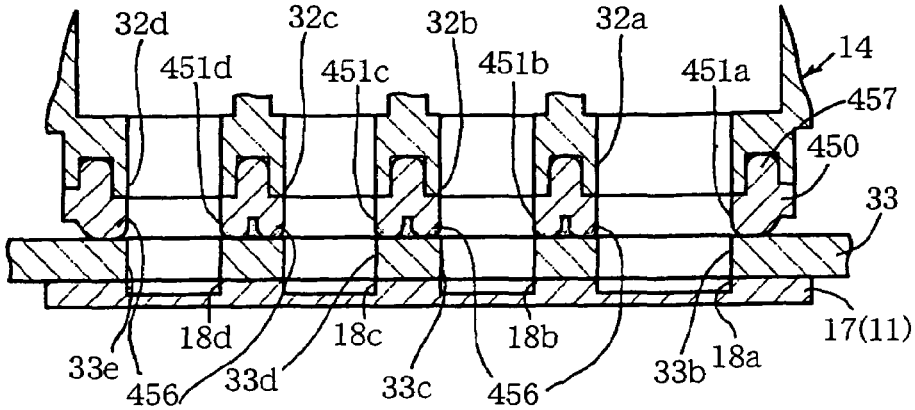
FIG. 21C is a cross-sectioned view showing a state in which the damping device, the rubber bush of FIG. 21A, the reinforcing frame, and the recording head are connected to each other.

In the state in which the elastic member 450 is assembled with the damping device 14 and the recording head 11 (or the reinforcing member 33), the elastic member 450 is compressed in the vertical direction, i.e., the direction parallel to the respective axis lines B of the through-holes 451*a* through 451*d*, as shown in FIG. 21C. More specifically described, the inner and outer ribs 61 through 64, 70 are held in close contact with the upper surface of the base portion 455, and the respective lower portions of the four first annular projections 456 are elastically deformed or compressed. The respective lower portions of the four first annular projections 456 have a semi-circular cross section, except that the respective thick portions 456*a* of the two outer first projections 456 have the inverted-triangular cross section. Thus, each of the four ink flow outlets 32*a* through 32*d* communicates with a corresponding one of the four ink flow inlets 18*a* through 18*d*, respectively, via a corresponding one of the four through-holes 151*a* through 151*d* and a corresponding one of the four ink flow holes 33*b* through 33*e*, respectively, such that respective inner circumferential surfaces of the each ink flow outlet, the one through-hole, the one flow hole, and the one ink flow inlet are substantially continuous with each other. Therefore, connection portions where the ink flow outlets 32*a* through 32*d*, the through-holes 151*a* through 151*d*, the ink flow holes 33*b* through 33*e*, and the ink flow inlets 18*a* through 18*d* are connected to each other are free of stepped portions and accordingly air bubbles generated from the inks can be effectively prevented from being trapped in those stepped portions.

In the elastic member 450, each pair of first annular projections 456 adjacent to each other in the first direction include the respective inner straight portions that are located between the corresponding pair of adjacent through-holes 451*a* and 451*b*, 451*b* and 451*c*, or 451*c* and 451*d* and extend parallel to each other, and each pair of second annular projections 457 adjacent to each other in the first direction include the respective inner straight portions that are connected or integrated with each other and are located right above the middle position between the respective inner, parallel straight portions of the corresponding pair of adjacent first projections 456. Thus, the compressive force applied to the elastic member 450 is uniformly distributed to the four first projections 456, and accordingly the six inner parallel straight portions of the four first projections 456 can be compressed in a well-balanced manner without being tilted down. Therefore, the elastic member 450 can be held in close contact with the reinforcing member 33, and the degree of liquid tightness between the two members 450, 33 is highly improved.

Meanwhile, each of the respective thick portions 456*a* of the two outer first annular projections 456 is located at a position offset from the outer portion of the corresponding second annular projection 457, in the direction toward the corresponding one of the two outer through-holes 451*a*, 451*d*, as shown in FIG. 21A. Thus, when the elastic member 450 is compressed by the damping device 14 and the reinforcing member 33, each thick portion 456*a* might tilt in the direction toward the corresponding through-hole 451*a* or 451*d*. However, as described above, each thick portion 456*a* has the characteristic shape that can prevent itself from being tilted. Thus, all of the thick portions 456*a*, and the remaining portions, of the two outer first projections 456 and the other, two inner first projections 456 can be uniformly compressed and can be held in close contact with the flat surface of the reinforcing member 33. Therefore, the entirety of each of the first annular projections 456 can exhibit a high degree of liquid tightness.

The four second annular projections 457 are compressed between the damping device 14 and the base portion 455, such that the respective lower end surfaces of the inner and outer ribs 61 through 64, 70 that have a substantially same width are held in close contact with the upper surface of the base portion 455, inside and outside the entire circumference of each of the second annular projections 457. Thus, each of the second annular projections 457 can exhibit a high degree of liquid tightness.

Thus, the elastic body 450 can be connected to the damping device 14 and the recording head 11 (or the reinforcing frame 33) with the high degree of liquid tightness and without leakage of the inks.

In the present embodiment, the elastic member 450 has the first annular projections 456 on the lower surface of the base portion 455 that faces the ink flow inlets 18*a* through 18*d* of the recording head 11. However, the elastic member 450 may be modified to have the first annular projections 456 on the upper surface of the base portion 455 that faces the ink flow outlets 32*a* through 32*d* of the damping device 14, or on each of the upper and lower surfaces of the base portion 455.

Back to FIG. 10, the sealing member 56 is formed of an elastic material such as rubber, and includes a flat base portion 56*e* and four cylindrical sealing portions 57*a*, 57*b*, 57*c*, 57*d* projecting upward and downward from the base portion 56*e*. Respective upper openings of the four sealing portions 57*a* through 57*d* are aligned with the four ink outlet ports 30*a* through 30*b* of the tube joint 36 as a first connection portion or member 85, respectively, and respective lower openings of the four sealing portions 57*a* through 57*d* are aligned with the four ink inlet ports 55*a* through 55*d* of the extension portion 27*a* (of the damping device 14) as a second connection portion or member 86, respectively.

The tube joint 36 as the first connection portion, the extension portion 27*a* as the second connection portion, and the spring member 37, described in detail below, cooperate with each other to provide a connecting device that connects the ink supply tubes 13*a* through 13*d* to the damping device 14 functioning as the ink delivering tanks.

As shown in FIGS. 8 through 11, the four ink outlet ports 30*a* through 30*d* of the first connection member 85 are enlarged to receive the respective upper end portions of the four sealing portions 57*a* through 57*d*, and the four ink inlet ports 55*a* through 55*d* of the second connection member 86 are enlarged to receive the respective lower end portions of the four sealing portions 57*a* through 57*d*. In a state in which the respective upper end portions of the four sealing portions 57*a* through 57*d* fit in the respective enlarged portions of the four ink outlet ports 30*a* through 30*d* and contact the respective stepped surfaces of the same 30*a* through 30*d* and the respective lower end portions of the four sealing portions 57*a* through 57*d* fit in the respective enlarged portions of the four ink inlet ports 55*a* through 55*d* and contact the respective stepped surfaces of the same 55*a* through 55*d*, the sealing portions 57*a* through 57*d* are compressed between the first and second connection members 85, 86 by the elastic force of the spring member 37. Thus, the four ink outlet ports 30*a* through 30*d* liquid-tightly communicate with the four ink inlet ports 55*a* through 55*d*, respectively.

The spring member 37 is obtained by bending a metallic wire having an appropriate degree of elasticity. More specifically described, as shown in FIG. 10, the spring member 37 includes two hook-like free end portions 91, 99; two upper horizontal arm portions 92, 98 that extend substantially horizontally from the two free end portions 91, 99, respectively; two vertical portions 93, 97 that are bent downward from the two upper horizontal arm portions 92, 98, respectively; two lower horizontal arm portions 94, 96 that extend substantially horizontally from respective lower ends of the two vertical portions 93, 97, respectively; and a connection portion 95 that connects between respective ends of the two lower horizontal arm portions 94, 96. Thus, the spring member 37 has a shape in which respective one ends of two generally U-shaped portions are connected to each other by a connection portion.

Figure 22A:
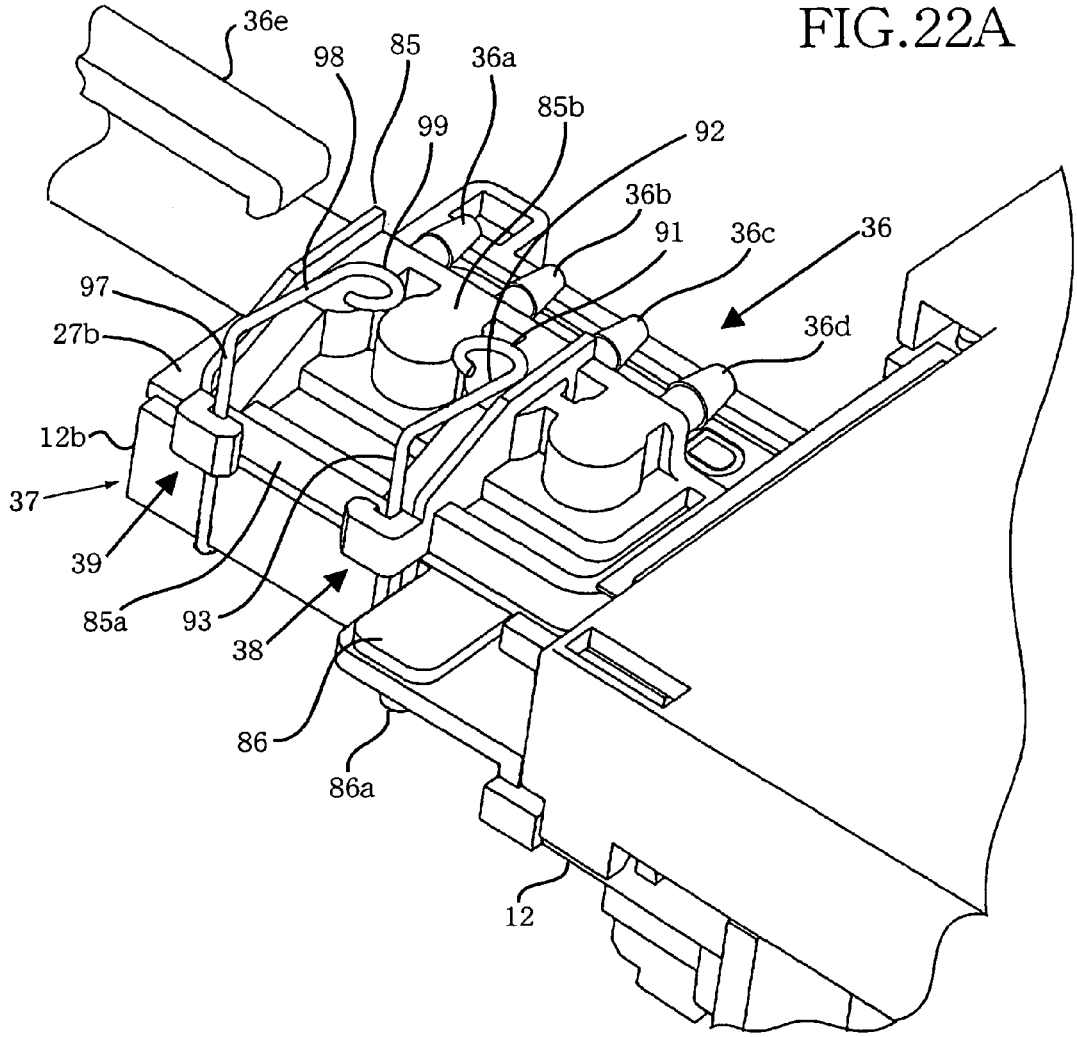
FIG. 22A is an enlarged perspective view of a tube joint of the ink jet printer 1.

As shown in FIG. 22A, the spring member 37 engages an upper surface of the tube joint 36 as the first connection member 85, respective side surfaces of the tube joint 36 and the extension portion 12*b* of the head holder 12, and a lower surface of the extension portion 12*b*. Thus, the two upper horizontal arm portions 92, 98 of the spring member 37 cooperate with each other to press downward the upper surface of the first connection member 85, and the two lower horizontal arm portions 94, 96 and the connection portion 95 of the spring member 37 cooperate with each other to press upward the lower surface of the extension portion 12*b*, so that the first and second connection members 85, 86 are kept connected to each other while being liquid-tightly sealed by the sealing member 56 sandwiched by the two connection members 85, 86. In addition, the tube joint 36 and the extension portion 12*b* are kept connected to each other.

Figure 22B:
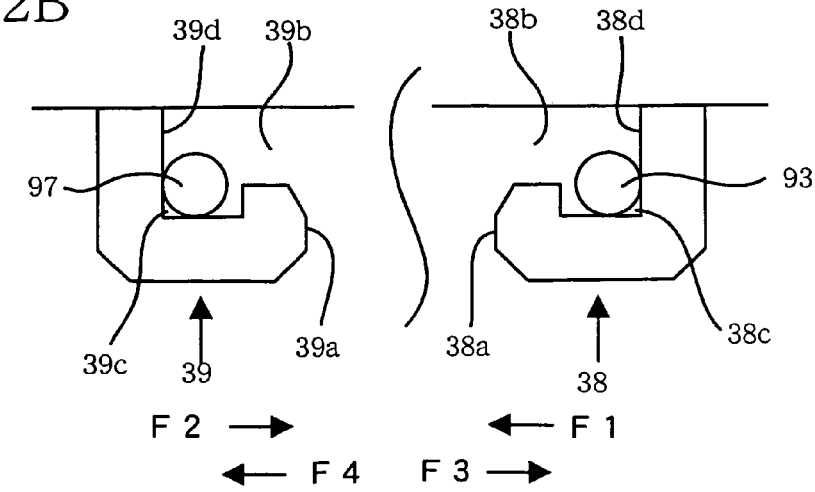
FIG. 22B is a plan view of a spring member and two spring holding portions of the ink jet printer 1.

In addition, as shown in FIG. 22A, the first connection member 85 has, on a side surface 85*a* thereof, a pair of spring holding portions 38, 39 as engageable portions that are engageable with the two vertical portions 93, 97 of the spring member 37, respectively. As shown in FIG. 22B. the two spring holding portions 38, 39 include respective hook-like portions 38*a*, 39*a* that are spaced from the side surface 85*a* by respective gaps 38*b*, 39*b* that are opposed to each other along the side surface 85*a*.

In a state in which the spring member 37 is elastically deformed such that the two vertical portions 93, 97 are moved toward each other in opposite directions indicated at arrows F1, F2 in FIG. 22B, the two vertical portions 93, 97 are inserted through the two gaps 38*b*, 39*b* into respective inner spaces 38*c*, 39*c* of the two hook-like portions 38*a*, 39*a*, and then the vertical portions 93, 97 are released, i.e., allowed to be moved away from each other in opposite directions indicated at arrows F3, F4, so that the vertical portions 93, 97 are engaged with respective inner surfaces 38*d*, 39*d* of the spring holding portions 38, 39 that are opposed to each other along the side surface 85*a*. Thus, the spring member 37 is prevented from being moved or removed away from the first and second connection members 85, 86.

In addition, as shown in FIG. 9, the two free end portions 91, 99, and the connection portion 95, of the spring member 37 are vertically aligned with a reference centerline which extends in a direction perpendicular to the drawing sheet of FIG. 9 and on which the four sealing portions 57*a* through 57*d* of the sealing member 56 are arranged. The two free end portions 91, 99 press downward respective portions of an upper surface 85*b* of a base portion of the first connection member 85 that are distant from each other along the reference centerline, and the connection portion 95 presses upward a linear portion of the lower surface of the extension portion 12*b* that extends along the reference centerline.

The four tube connection portions 36*a* through 36*d*, and the four ink outlet ports 30*a* through 30*d*, of the tube joint 36 as the first connection member 85, and the four ink inlet ports 55*a* through 55*d* of the extension portion 27*a* as the second connection member 86 are located on respective planes that are perpendicular to the direction in which the spring member 37 pinches the two connection members 85, 86. Thus, the elastic force of the spring member 37 is uniformly applied to the four sealing portions 57*a* through 57*d* of the sealing member 56, so that the four tube connection portions 36*a* through 36*d*, the four ink outlet ports 30*a* through 30*d*, or the four ink inlet ports 55*a* through 55*d* are uniformly sealed by the four sealing portions 57*a* through 57*d*, respectively.

The extension portion 12*b* of the head holder 12 extends parallel to the first and second connection members 85, 86. The second connection member 86 has, on a lower surface thereof, two projecting portions 86*a*, 86*b* that fit in two through-holes 12*r*, 12*s* that are vertically formed through a thickness of the extension portion 12*b*. The first connection member 85 has, on a lower surface thereof, four projecting portions, including a projecting portion 85*c*, which extend in four through-holes 58, respectively, that are vertically formed through a thickness of the flat base portion 56*e* of the sealing member 56, and two of which fit in two holes 59, 59, respectively, that open in an upper surface of the second connection member 86. The other projecting portions, e.g., the projecting portion 85*c*, engages the upper surface of the second connection member 86 (i.e., the extension portion 27*a*), thereby keeping an appropriate distance between the first and second connection members 85, 86. Thus, on the extension portion 12*b*, there are stacked the second connection member 86, the sealing member 56, and the first connection member 85 in the order of description, such that the three members 86, 56, 85 are placed in position relative to each other. That is, the tube joint 36 is provided on the extension portion 12*b*.

Then, the spring member 37 pinches the tube joint 36 and the extension portion 12*b*. Thus, the first and second connection members 85, 86 are connected to each other with the sealing member 56 being interposed therebetween, and the tube joint 36 and the extension portion 12*b* are also connected to each other. That is, the three members, i.e., the first and second connection members 85, 86 and the extension portion 12*b* are connected to each other.

As is apparent from the foregoing description of the ink jet printer 1, the first and second connection members 85, 86 are connected to each other by the elastic force of the spring member 37. Thus, as compared with a case where the two connection members 85, 86 are connected to each other by bolts and nuts, it is not needed to form holes through which the bolts are passed, or form the bolts and the nuts. Thus, the tube joint 36 can enjoy a simple structure. In addition, since it is not needed to engage the bolts and the nuts with each other, a time needed to manufacture the printer 1 can be reduced.

Since the spring member 37 is detachably attached, the first and second connection members 85, 86 can be released from each other by just detaching the spring member 37 from those members 85, 86. Thus, the maintenance and replacement of the connection members 85, 86 can be easily carried out.

The first connection member 85 includes the two spring holding portions 38, 39 as the engageble portions with which the spring member 37 is detachably engageable. That is, in the state in which the spring member 37 is engaged with the spring holding portions 38, 39, the spring member 37 can not naturally come off the first and second connection members 85, 85. In addition, since the spring holding portions 38, 39 can be used as indices in attaching the spring member 37 to those members 85, 86, the spring member 37 can be easily attached.

In addition, the second connection member 86 can be produced as an integral portion of the damping device 14. Since the total number of steps needed to produce the second connection member 86 can be reduced as compared with a case where the second connection member 86 is produced separately from the damping device 14, the production cost of the ink jet printer 1 can be reduced.

Moreover, the head holder 12 includes the extension portion 12*b* that extends parallel to the first and second connection members 85, 86, and the spring member 37 pinches the two connection members 85, 86 and the extension portion 12*b* and thereby fixes the three members 85, 86, 12*b* to each other. Since the spring member 37 suffices for fixing the three members 85, 86, 12*b*, the fixing means for fixing the three members 85, 86, 12*b* can be simplified as compared with a case where a plurality of members are employed to fix the three members 85, 86, 12*b*, and additionally a time needed to fix those members 85, 86, 12*b* can be shortened.

Furthermore, the four tube connection portions 36*a* through 36*d*, and the four ink outlet ports 30*a* through 30*d*, of the first connection member 85, and the four ink inlet ports 55*a* through 55*d* of the second connection member 86 are located on the respective planes that are perpendicular to the direction in which the spring member 37 pinches the two connection members 85, 86. Thus, the elastic force of the spring member 37 is uniformly applied to the four sealing portions 57*a* through 57*d* of the sealing member 56, so that the four tube connection portions 36*a* through 36*d*, the four ink outlet ports 30*a* through 30*d*, or the four ink inlet ports 55*a* through 55*d* are uniformly sealed by the four sealing portions 57*a* through 57*d*, respectively. Therefore, the elastic force of the spring member 37 can be prevented from being locally lowered with respect to only one or two of the four sealing portions 57*a* through 57*d* and accordingly the liquid tightness of the sealing member 56 can be prevented from being locally lowered with respect to only the corresponding one or ones of the four ink outlet ports 30*a* through 30*d* or the four ink inlet ports 55*a* through 55*d*.

Figure 23:
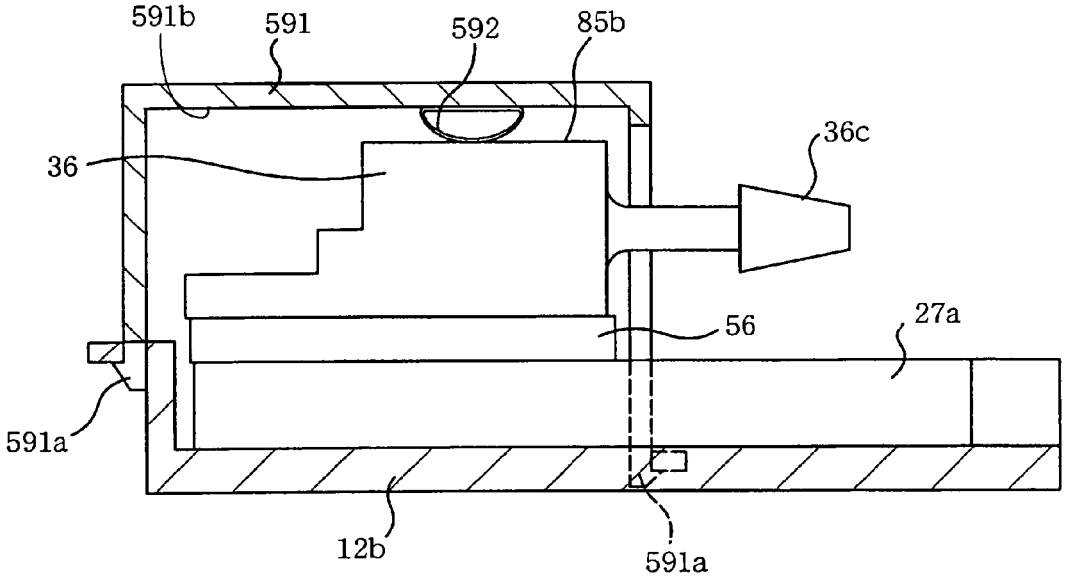
FIG. 23 is a cross-sectioned view of another spring member and a cover case that are employed by a modified embodiment of the ink jet printer 1.

FIG. 23 shows a modified embodiment of the ink jet printer 1, wherein a plurality of spring members 592 are employed in place of the spring member 37. In this embodiment, the upper surface 85*b* of the first connection member 85 (the tube joint 36) is covered with a cover member 591. The cover member 591 has, in respective lower end portions of two side walls thereof, two engageable portions 591*a* that are engageable with two engageable portions of the extension portion 12*b*, respectively. The spring members 592 are provided between a lower surface 591*b* of the cover member 591 and the upper surface 85*b* of the first connection member 85. The spring members 592 are each constituted by, e.g., a sheet spring, and are arranged in the direction in which the four ink outlet ports 30*a* through 30*d* are arranged. In the state in which the spring members 592 are interposed between the lower surface 591*b* of the cover member 591 and the upper surface 85*b* of the first connection member 85, the spring members 592 are compressed in the vertical direction. An elastic restoring force of each of the spring members 592 presses downward the upper surface 85*b* of the first connection member 85. Thus, the cover member 591 and the spring members 592 cooperate with each other to attach the tube joint 36 to the extension portion 12*b*. Each of the spring members 592 may be formed of any suitable material such as a metal wire, a sheet spring, or a resin, and may be formed to have any suitable shape.

The single spring member 37 employed by the ink jet printer 1 may be replaced with a plurality of identical spring members 37 that cooperate with each other pinch the tube joint 36 and the extension portion 12*b*, at a plurality of pinching positions, respectively. In this case, even if the pinching positions may be distant from each other, each of the spring members 37 may be constituted by one that can apply only a considerably small elastic force at a corresponding one of the pinching positions. As compared with a case where a single spring that can apply a considerably great elastic force is used, each of the spring members 37 can be attached, with a small force, to the tube joint 36 and the extension portion 12*b*, because the each spring member can apply only the considerably small elastic force.

The spring member 37 may be modified to have three or more hook-like end portions that are similar to the hook-like end portions 91, 99. In this case, since the modified spring member engages the upper surface 85*b* of the first connection member 85, at three or more positions, the modified spring member can press a wider area as compared with the spring member 37 having the two hook-like end portions 91, 99 only, and accordingly the elastic or pinching force of the modified spring member can be distributed to the wider area.

The two vertical portions 93, 97 of the spring member 37 may be provided with respective fin members that project outward therefrom and can be grasped by fingers or a tool. In this case, even if the spring member 37 may be one that produces a great elastic force, the spring member 37 can be easily attached to pinch the tube joint 36 and the extension portion 12*b*.

The spring holding portions 38, 39 may be provided on a side surface of either one of the second connection member 86 and the extension portion 12*b*.

The spring member 37 may be used to pinch the first and second connection portions 85, 86 only. In this case, the respective lengths of the vertical portions 93, 97 of the spring member 37 can be changed depending upon the height (or thickness) of the tube joint 36, without taking the height (or thickness) of the extension portion 12*b* into account.

FIGS. 24, 25, 26 and 27A show a modified embodiment of the ink jet printer 1. In the following description, the same reference numerals as used in the ink jet printer 1 are used to designate the corresponding elements and parts of the modified embodiment and the description thereof is omitted.

In the vicinity of an upper opening of the head holder 12, i.e., on an upper side of the damping device (e.g., a buffer tank) 14 that is opposite to the recording head 11, there is provided an electric-circuit substrate 22 that is formed of a rigid material and supports one or more electric circuits. More specifically described, the circuit substrate 22 is supported by an upper end of a holder case 12*c* of the head holder 12, and is detachably attached, with a known attaching device (not shown), to the head holder 12. Between the circuit substrate 22 and the damping device 14, there is provided a horizontal space 14*e*. A cover member 24 is fixed to the head holder 12 so as to cover the circuit substrate 22.

Figure 25:
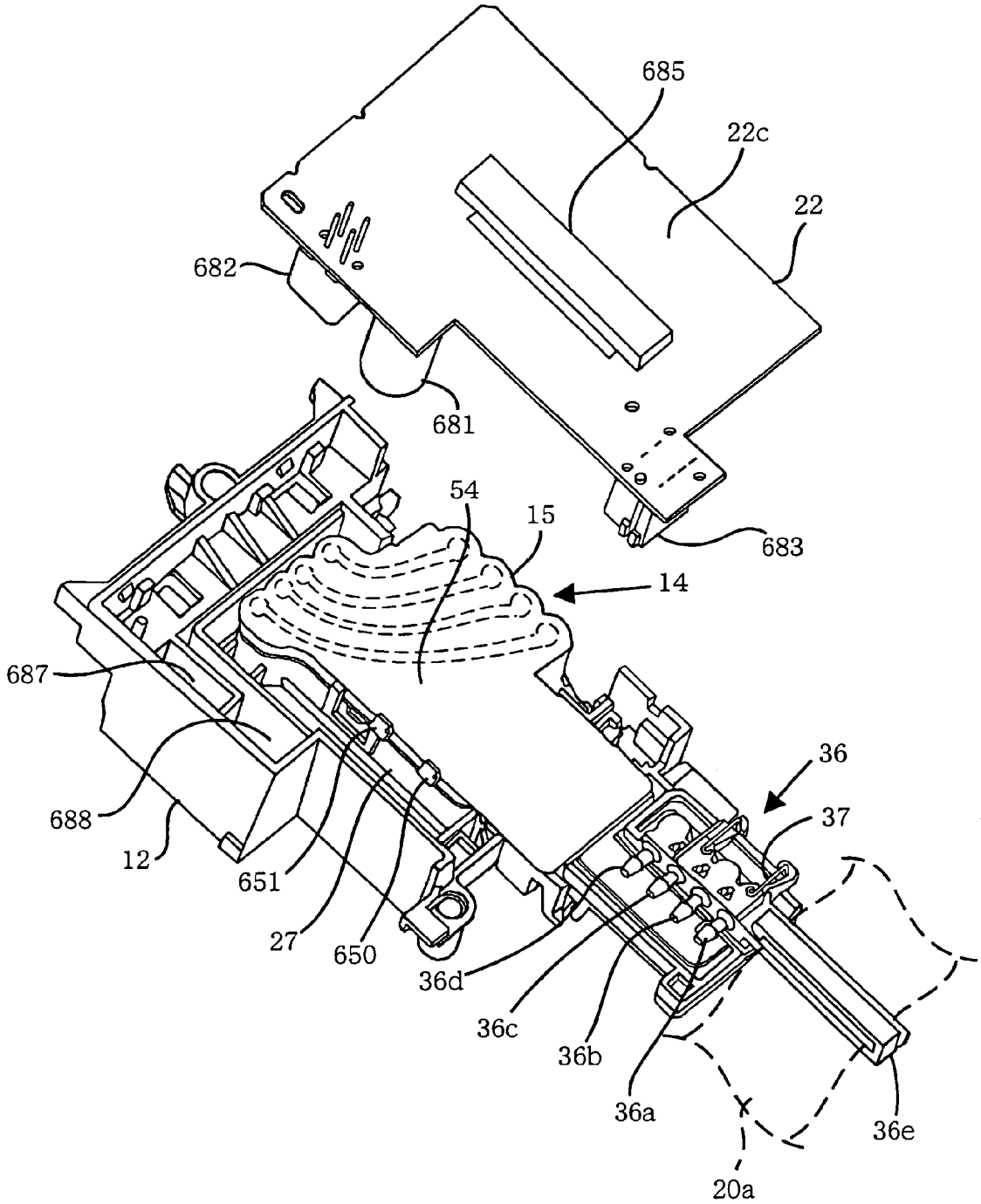
FIG. 25 is an exploded perspective view of a head holder and an electric-circuit substrate of the modified ink jet printer of FIG. 24.

The electric circuits supported by the circuit substrate 22 includes electronic components 681, 682, 683 that project downward from a lower surface of the substrate 22 on one of opposite sides of the damping device 14 that is opposite to the air-discharging-valve device 15. More specifically described, as shown in FIG. 25, the electronic components include a by-pass capacitor 681 that stores electric charges needed to drive an IC chip 21; a sheet detector 682 that detects a recording sheet P, i.e., judges whether the sheet P is present; and an encoder 683 that reads timing indices or marks provided on a belt-like timing-index member (not shown) fixed to the housing. Those electronic components 681, 682, 683 project, like pendants, downward from the lower surface of the circuit substrate 24, such that the components 681, 682, 683 are spaced from each other. The head holder 12 has two inner rooms 687, 688 that accommodate the sheet detector 682 and the by-pass capacitor 681, respectively, in a state in which the circuit substrate 22 is attached to the head holder 12.

The piezoelectric actuator 19 of the recording head 11 is electrically connected to the circuit substrate 22 (i.e., the electric circuits supported thereby) by the flexible flat cable 20. The IC chip 21 is electrically connected to the cable 20. The IC chip 21 converts recording data in the form of serial data supplied from a main control device (not shown) fixed to the housing, into parallel data corresponding to the arrays of nozzles 16*a* through 16*d*, and additionally converts the parallel data into electric-voltage signals suitable to drive the piezoelectric actuator 19.

The flexible flat cable 20 passes through the slit 12*e* formed through the bottom wall 12*a* of the head holder 12, and enters the inner space of the head holder 12. The cable 20 is further extended through a vertical space 14*d* provided between the heat sink 23 and the holder case 12*c* of the head holder 12 and the horizontal space 14*e* provided between the circuit substrate 22 and the damping device 14, is folded up around an end surface 22*b* of the substrate 22, and is detachably attached to a connector 685 provided on an upper surface 22*c* of the substrate 22. Since the cable 20 is provided in the above-described manner, the cable 20 does not contact any of the electronic components 681, 682, 683 provided on the lower surface of the circuit substrate 84.

Figure 24:
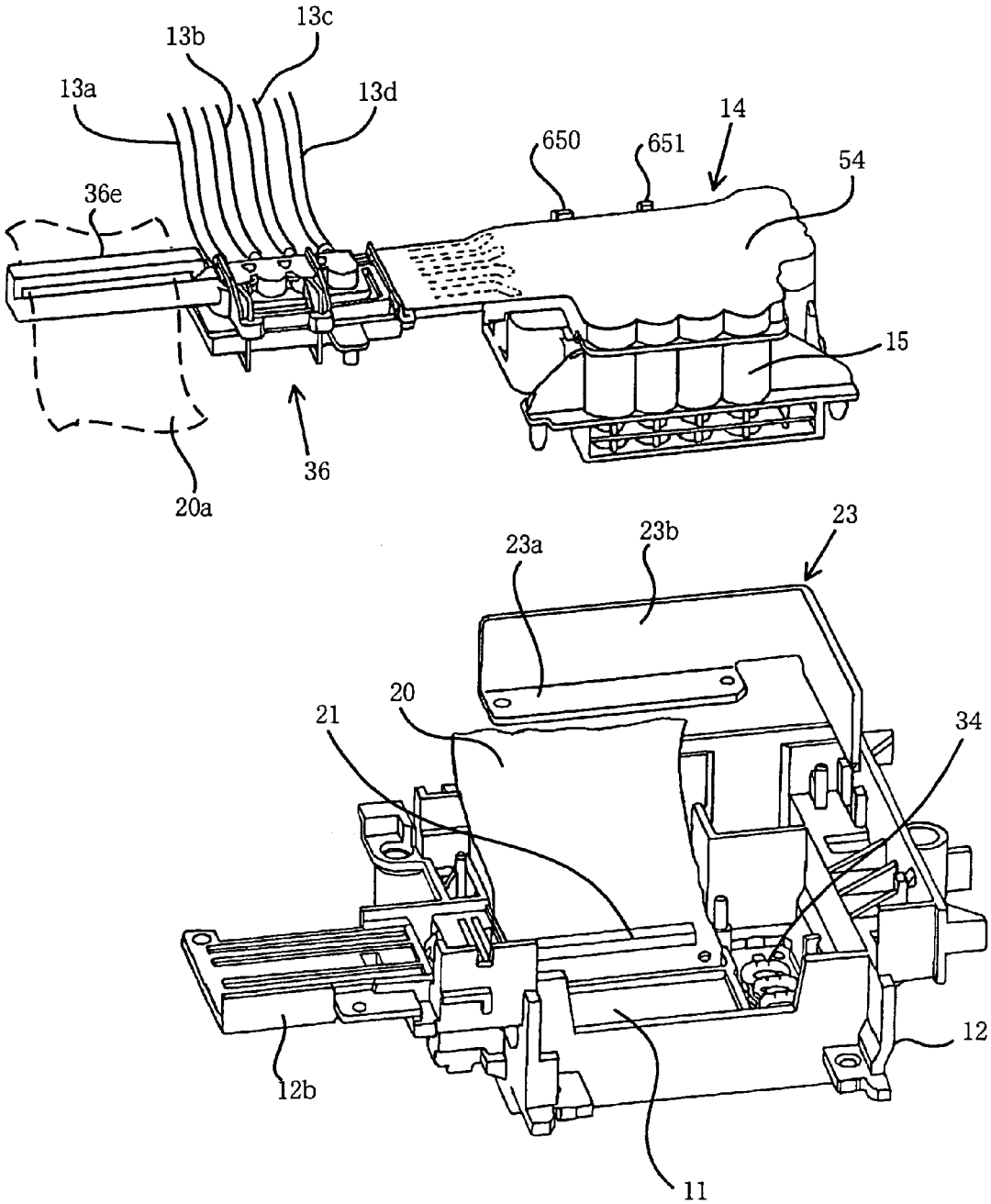
FIG. 24 is a perspective view of another modified embodiment of the ink jet printer 1.

The heat sink 23 is fixed at a position near the slit 12*e*, and above the bottom wall 12*a*, of the head holder 12. As shown in FIG. 24, the heat sink 23 includes a bottom portion 23*a* extending parallel to the bottom wall 12*a*, and a side portion 23*b* extending upward from the bottom portion 23*a*. An elastic member 686 formed of rubber presses the IC chip 21 against the bottom portion 23*a*, so that heat generated by the IC chip 21 can be conducted to the bottom portion 23*a*. Thus, the heat generated by the IC chip 21 can be efficiently radiated.

The electric circuits (i.e., wiring patterns) supported by the circuit substrate 22 are connected, on one hand, to the connector 685 and the electronic components 681, 682, 683, and are connected, on the other hand, to the main control device via another flexible flat cable 20*a*.

Figure 26:
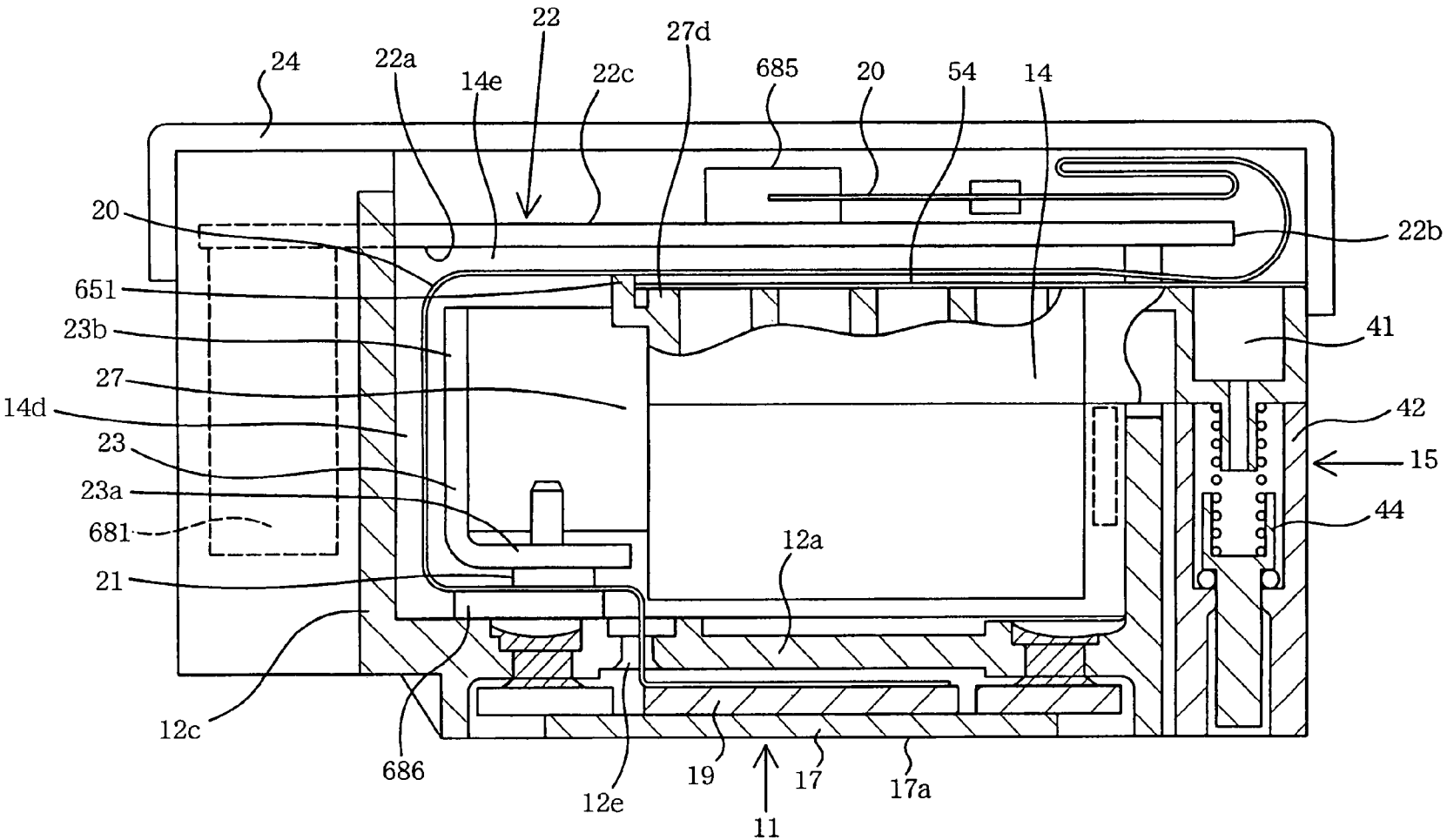
FIG. 26 is a cross-sectioned view of the head holder and various components held thereby.
Figure 27A:
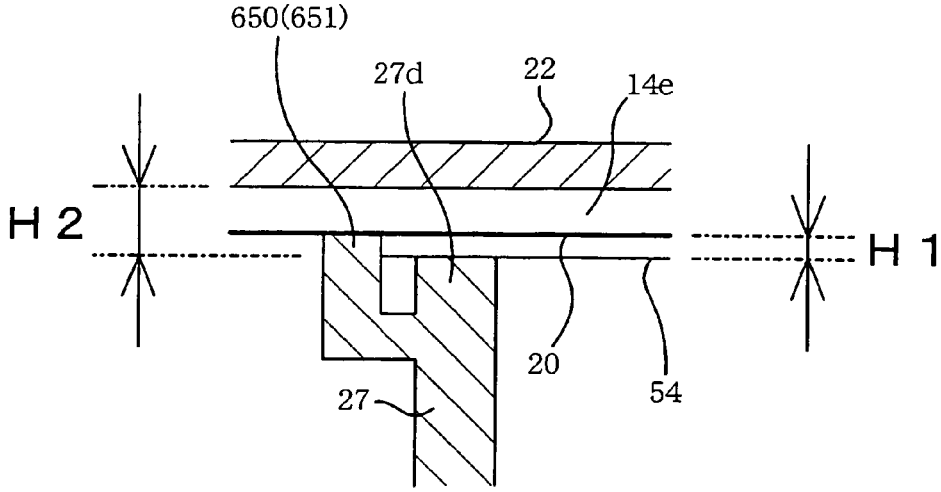
FIG. 27A is a cross-sectioned view of ribs and a flexible flat cable of the modified ink jet printer of FIG. 24.

As shown in FIGS. 24 25, 26, and 27A, two ribs 650, 651 as cable supporting portions project upward from an upper end 27*d* of the upper case 27 of the damping device 14. More specifically descried, as shown in FIGS. 26 and 27A, the two ribs 650, 651 first project horizontally from the upper end of the upper case 27 of the damping device 14 and then project upward into the horizontal space 14*e* between the circuit substrate 22 and the flexible membrane 54. Thus, the ribs 650, 651 are integral with the upper case 27 of the damping device 14.

As shown in FIG. 27A, the two ribs 650, 651 project upward from the upper end 27*d* of the upper case 27 of the damping device 14, by a height H1. The height H1 is predetermined such that even if the flexible flat cable 20 may sag downward, a lower surface of the cable 20 does not contact an upper surface of the flexible membrane 54. For example, the height H1 is 1 mm. Since the two ribs 650, 651 are arranged in a widthwise direction of the cable 20 and cooperate with each other to support the lower surface of the cable 20, a distance of the two ribs 650, 651 is so pre-determined not to exceed the width of the cable 20. The lower surface 22*a* of the circuit substrate 22 is spaced from the flexible membrane 54 by a space having a height H2 greater than the height H1.

That is, the two ribs 650, 651 cooperate with each other to keep the lower surface of the flexible flat cable 20 above the upper surface of the flexible membrane 54, when the cable 20 extends through the horizontal space 14*e* between the circuit substrate 22 an the membrane 54. Thus, even if the cable 20 may sag downward, the lower surface of the cable 20 is prevented from contacting the upper surface of the membrane 54.

As is apparent from the foregoing description of the modified embodiment of the ink jet printer 1, the electronic components 681, 682, 683 are fixed to the circuit substrate 22 such that the components 681 through 683 project downward from the substrate 22 and are located on the laterally outer side of the damping device 14, and the flexible flat cable 20 extends from the piezoelectric actuator 19 to the circuit substrate 22 via the vertical space 14*d* between the damping device 14 and the electronic components 681 through 63 and the horizontal space 14*e* between the damping device 14 and the circuit substrate 22. Thus, the recording head 11, the damping device 14, the circuit substrate 22, and the electronic components 681 through 683 can be provided in a small space and accordingly those elements as a whole can be reduced in size. In this arrangement, the cable 20 can be provided without interfering with any of those elements.

In addition, the two ribs 650, 651 project upward from the upper end 27*d* of the upper case 27 of the damping device 14, into the horizontal space 14*e* between the circuit substrate 22 and the flexible membrane 54. Since the two ribs 650, 651 cooperate with each other to lift up the flexible flat cable 20 extending through the horizontal space 14*e*, the lower surface of the cable 20 can be prevented from sagging downward and contacting the upper surface of the membrane 54.

Thus, the flexible membrane 54 is allowed to be displaced without being restrained or limited by the flexible flat cable 20, and accordingly the dynamic changes of respective pressures of the inks in the damping device 14 can be effectively absorbed by the membrane 54. In addition, the flexible membrane 54 and the flexible flat cable 20 can be prevented from being damaged.

The damping device 14 has the two ribs 650, 651 that are spaced from each other in the widthwise direction of the flexible flat cable 20. However, the two ribs 650, 651 may be replaced with a single rib, not shown, that projects from the upper end 27*d* of the upper case 27 of the damping device 14, at a position corresponding to the widthwise middle position of the cable 20. The single rib can prevent the lower surface of the cable 20 from contacting the upper surface of the flexible membrane 54 even if the cable 20 may sag downward.

The slit 12*e* may be surrounded by walls identical with the surrounding walls 12*f*, 12*g* shown in 7, and filled with a sealing material identical with the sealing material F.

Next, there will be described other modified embodiments of the ink jet printer 1 by reference to FIGS. 7B and 7C.

Figure 27B:
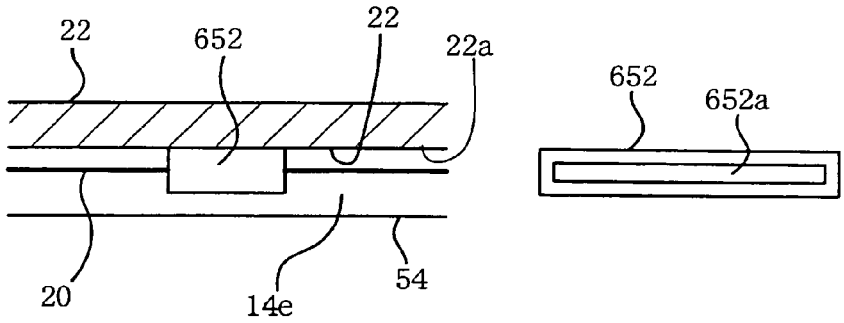
FIG. 27B is another modified embodiment of the ink jet printer 1.

As shown in FIG. 27B, the two ribs 650, 651 may be replaced with a guide member 652 that is fixed to the lower surface 22*a* of the circuit substrate 22. The guide member 652 has a through-hole 652*a* that supports the flexible flat cable 20 by allowing the cable 20 to extend therethrough. Thus, the guide member 652 can prevent the cable 20 from contacting the flexible membrane 54. Two or more guide members 652 may be fixed to the lower surface 22*a* of the circuit substrate 22 such that the guide members 652 are spaced from each other in the direction in which the cable 20 extends in the horizontal space 14*e*. In this case, the guide members 652 cooperate with each other to support the cable 20 in a wider range and thereby more reliably prevent the cable 20 from sagging downward or contacting the membrane 54.

Figure 27C:
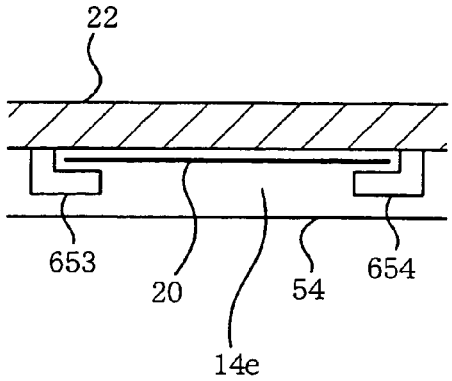
FIG. 27C is another modified embodiment of the ink jet printer 1.

In addition, as shown in FIG. 27C, the two ribs 650, 651 may be replaced with a pair of guide members 653, 654 that are fixed to the lower surface 22*a* of the circuit substrate 22 so as to be opposed to each other in the widthwise direction of the flexible flat cable 20 and are engaged with the widthwise opposite end portions of the cable 20, respectively. Thus, the two guide members 653, 654 cooperate with each other to support the cable 20 and thereby prevent the cable 20 from contacting the flexible membrane 54. Two or more pairs of guide members 653, 654 may be fixed to the circuit substrate 22 such that the pairs of guide members 653, 654 are spaced from each other in the direction in which the cable 20 extends in the horizontal space 14*b*. In this case, the pairs of guide members 653, 654 cooperate with each other to support the cable 20 in a wider range and thereby more reliably prevent the cable 20 from sagging downward or contacting the membrane 54. The two guide members 653, 654 may be fixed to the circuit substrate 22 such that the two guide members 653, 654 are not opposed to each other in the widthwise direction of the cable 20, i.e., are offset from each other in the direction in which the cable 20 extends. In this case, too, the two guide members 653, 654 cooperate with each other to support the cable 20 in a wider range and thereby prevent the cable 20 from sagging downward or contacting the membrane 54.

Two or more support members may be selected from the above-described ribs 650, 651, the guide member 652, and the pair of guide members 653, 654, and may be used together with each other.

The ribs 650, 651, the guide member 652, or the pair of guide members 653, 654 provide or provides a cable supporting portion.

It is to be understood that the present invention may be embodied with other changes and improvements that may occur to a person skilled in the art, without departing from the spirit and scope of the invention defined in the appended claims.

What is claimed is:

1. An ink jet printer, comprising:

a stationary frame;

a tank supporter which is provided in the stationary frame and which supports at least one ink storing tank storing at least one sort of ink;

a recording head which records an image on a recording medium by ejecting at least one droplet of said at least one sort of ink, and which has at least one ink flow inlet;

at least one ink delivering tank which delivers said at least one sort of ink and has at least one ink flow outlet;

at least one ink supply tube which is provided between the tank supporter and said at least one ink delivering tank and through which said at least one sort of ink is supplied from said at least one ink storing tank to the recording head via said at least one ink delivering tank, wherein said at least one ink delivering tank provides at least a portion of at least one ink delivering channel connecting between said at least one ink supply tube and the recording head;

a head holder which includes a holder main portion holding the recording head and said at least one ink delivering tank, and which is movable horizontally relative to the stationary frame so that the recording head records the image on the recording medium; and an ink-contact preventing portion which prevents the ink that leaks from said at least one ink delivering channel, from contacting the recording head, wherein the ink-contact preventing portion comprises at least one tube connection portion to which said at least one ink supply tube is connected and which communicates with said at least one ink delivering tank and is located, in a horizontal direction, outside the recording head held by the holder main portion of the head holder.

2. The ink jet printer according to claim 1, wherein said at least one ink delivering tank includes at least one tank main portion which delivers said at least one sort of ink, wherein the holder main portion of the head holder holds the recording head and supports said at least one tank main portion of said at least one ink delivering tank, wherein said at least one ink delivering tank additionally includes at least one tank extension portion which extends outward from said at least one tank main portion and is located outside the holder main portion of the head holder in the horizontal direction, and wherein said at least one tank extension portion of said at least one ink delivering tank comprises said at least one tube connection portion to which said at least one ink supply tube is connected.

3. The ink jet printer according to claim 2, wherein said at least one tank main portion of said at least one ink delivering tank comprises at least one air-bubble collecting chamber which collects air bubbles separating from said at least one sort of ink, and said at least one tank extension portion of said at least one ink delivering tank has at least one ink flow passage which communicates with said at least one air-bubble collecting chamber, and wherein said at least one tank extension portion comprises at least one tube joint which is provided in at least one end portion of said at least one tank extension portion that is remote from said at least one tank main portion and which includes said at least one tube connection portion to which said at least one ink supply tube is connected so that said at least one ink supply tube communicates with said at least one ink flow passage via said at least one tube connection portion.

4. The ink jet printer according to claim 3, wherein said at least one end portion of said at least one tank extension portion of said at least one ink delivering tank has at least one upper surface, and the head holder includes a head extension portion which extends outward from the head main portion thereof such that the head extension portion is located below said at least one tank extension portion, and wherein at least one of (a) said at least one upper surface of said at least one end portion of said at least one tank extension portion and (b) the head extension portion is located right below said at least one tube connection portion of said at least one tube joint.

5. The ink jet printer according to claim 4, wherein the ink-contact preventing portion further comprises a first ink dam which projects upward from an upper surface of the head extension portion of the head holder and which prevents the ink that has leaked from at least one of(a) said at least one ink supply tube and (b) said at least one tube connection portion of said at least one ink delivering tank, from moving toward the head main portion of the head holder.

6. The ink jet printer according to claim 5, wherein the ink-contact preventing portion further comprises a projecting portion which horizontally extends along the first ink dam of the head extension portion of the head holder and which projects downward, from a lower surface of said at least one tank extension portion of said at least one ink delivering tank, at a position nearer to the head main portion of the head holder than a position where the first ink dam is provided.

7. The ink jet printer according to claim 6, wherein the ink-contact preventing portion further comprises a second ink dam which projects upward from the upper surface of the head extension portion of the head holder and is provided at a position nearer to the head main portion of the head holder than a position where the projecting portion of said at least one tank extension portion of said at least one ink delivering tank is provided, and which prevents the ink from moving toward the head main portion of the head holder.

8. The ink jet printer according to claim 3, wherein said at least one tank extension portion of said at least one ink delivering tank has at least one groove and includes a flexible membrane which liquid-tightly closes said at least one groove and thereby defines said at least one ink flow passage.

9. The ink jet printer according to claim 4, wherein the ink-contact preventing portion further comprises an ink-movement preventing portion which is provided between said at least one tank extension portion of said at least one ink delivering tank and the head extension portion of the head holder and which prevents the ink that has leaked from at least one of (a) said at least one ink supply tube and (b) said at least one tube connection portion of said at least one ink delivering tank, from moving toward the head main portion of the head holder, and wherein the ink-movement preventing portion includes at least one of a projecting wall and a groove.

10. The ink jet printer according to claim 1, wherein the head holder includes a bottom wall and holds the recording head below the bottom wall, wherein the bottom wall has at least one opening which is formed through a thickness of the bottom wall, and wherein the ink-contact preventing portion comprises an ink-movement preventing portion which prevents the ink that has leaked from said at least one ink delivering channel, from moving into said at least one opening.

11. The ink jet printer according to claim 10, wherein the ink-movement preventing portion comprises at least one projecting wall which projects upward from the bottom wall of the head holder, at least partly surrounds said at least one opening, and prevents the ink from moving into said at least one opening.

12. The ink jet printer according to claim 11, wherein said at least one opening comprises at least one adhesion hole which is filled with an adhesive to fix, by adhesion, an upper surface of the recording head to a lower surface of the bottom wall of the head holder.

13. The ink jet printer according to claim 10, further comprising:

an electric-circuit substrate which supports an electric circuit and which is spaced from said at least one ink delivering tank; and an electric cable which extends through a space between said at least one ink delivering tank and the electric-circuit substrate and thereby electrically connects the recording head to the electric circuit.

14. The ink jet printer according to claim 11, further comprising an electric cable which is electrically connected to the recording head, wherein said at least one opening comprises a slit through which the electric cable extends.

15. The ink jet printer according to claim 14, wherein the bottom wall of the head holder has at least three said openings which include the slit and at least two openings of which are arranged in an array along the slit, wherein each of said at least two openings is filled with an adhesive to fix, by adhesion, an upper surface of the recording head to a lower surface of the bottom wall of the head holder, and wherein said at least one projecting wall includes a common projecting wall which is located between the slit and said at least two openings and which prevents the ink from moving into each of the slit and said at least two openings.

16. The ink jet printer according to claim 14, wherein said at least one projecting wall fully surrounds said at least one opening such that at least one flat portion is located between said at least one projecting wall and said at least one opening.

17. The ink jet printer according to claim 14, wherein a space left between the slit and the electric cable is filled with a sealing material.

18. The ink jet printer according to claim 1, further comprising a connecting device which is provided between one of opposite ends of said at least one ink supply tube and said at least one ink delivering tank and connects said one end of said at least one ink supply tube to said at least one ink delivering tank, wherein the connecting device includes a first connecting portion which has said at least one tube connection portion to which said one end of said at least one tube is connected, and at least one ink outlet port from which said at least one sort of ink flows, a second connecting portion which has at least one ink inlet port through which said at least one sort of ink flows from said at least one ink outlet port to said at least one ink delivering tank, and at least one spring member which applies an elastic force to pinch the first and second connecting portions, and thereby connects the first and second connecting portions to each other.

19. The ink jet printer according to claim 18, wherein said at least one spring member is detachable from the first and second connecting portions, without using a tool.

20. The ink jet printer according to claim 19, wherein at least one of the first and second connecting portions includes at least one engageable portion which is engageable with said at least one spring member so that said at least one spring member is detachably attached to said at least one of the first and second connecting portions.

21. The ink jet printer according to claim 18, wherein the second connecting portion of the connecting device is provided by at least one tank extension portion of said at least one ink delivering tank.

22. The ink jet printer according to claim 18, wherein the head holder includes a holder extension portion which extends parallel to the first and second connecting portions of the connecting device, and wherein said at least one spring member applies the elastic force to pinch the first and second connecting portions and the holder extension portion, and thereby fixes the first and second connecting portions to the holder extension portion.

23. The ink jet printer according to claim 18, comprising a plurality of said ink storing tanks which store a plurality of said sorts of inks, respectively, and supply the inks to the recoding head; a plurality of said ink supply tubes which supplies the inks from the ink storing tanks to the recording head; a plurality of said ink delivering tanks which are attached to the head holder and which deliver the inks supplied from the ink storing tanks via the ink supply tubes, wherein the first connecting portion of the connecting device has a plurality of said tube connection portions to which the ink supply tubes are connected, respectively, and a plurality of said ink outlet ports from which the inks flow, respectively, and the second connecting portion has a plurality of said ink inlet ports through which the inks flow from the ink outlet ports to the ink delivering tanks, respectively, and wherein the tube connection portions are provided on a first plane perpendicular to a pinching direction in which the spring applies the elastic force to pinch the first and second connecting portions, the ink outlet ports are provided on a second plane perpendicular to the pinching direction, and the ink inlet ports are provided on a third plane perpendicular to the pinching direction.

24. An ink jet printer comprising:

a stationary frame;

a tank supporter which is provided in the stationary frame and which supports a plurality of ink storing tanks storing a plurality of sorts of inks, respectively;

a recording head which records an image on a recording medium by ejecting respective droplets of the sorts of inks, wherein the recording head has a plurality of ink ejection nozzles and a plurality of ink flow inlets to which the sorts of inks are supplied, respectively, and which communicate with the ink ejection nozzles, respectively;

a plurality of ink delivering tanks which deliver the sorts of inks, respectively, and have a plurality of ink flow outlets;

a plurality of ink supply tubes which are provided between the tank supporter and the ink delivering tanks and through which the sorts of inks are supplied from the ink storing tanks to the recording head via the ink delivering tanks, respectively, wherein the ink delivering tanks provide at least respective portions of a plurality of ink delivering channels connecting between the ink supply tubes and the recording head;

a head holder which includes a main portion holding the recording head and the ink delivering tanks, and which is movable relative to the stationary frame so that the recording head records the image on the recording medium;

an ink-contact preventing portion which prevents the inks that leak from the ink delivering channels, from contacting the recording head;

an ink delivering case defining the ink delivering tanks having the ink flow outlets from which the inks flow toward the ink flow inlets of the recording head, respectively; and an elastic member having a plurality of through-holes having respective shapes corresponding to respective shapes of the ink flow outlets and respective shapes of the ink flow inlets, wherein the elastic member is interposed between the recording head and the ink delivering case, such that the ink flow outlets communicate with the ink flow inlets via the through-holes, respectively, wherein the ink-contact preventing portion comprises:

a plurality of inner ribs which project from one of (a) the ink delivering case and (b) the recording head, surround respective open ends of corresponding ones of (a) the ink flow outlets of the ink delivering case and (b) the ink flow inlets of the recording head, and cooperate with each other to define at least one first space therebetween; and at least one outer rib which projects from said one of (a) the ink delivering case and (b) the recording head and cooperates with at least one portion of at least one of the inner ribs to define at least one second space therebetween, and wherein the elastic member includes a plurality of sealing portions which continuously surround the through-holes thereof, respectively, and fit in said at least one first space and said at least one second space such that the through-holes of the elastic member are aligned with the respective open ends of said corresponding ones of (a) the ink flow outlets of the ink delivering case and (b) the ink flow inlets of the recording head.

25. The ink jet printer according to claim 24, wherein the inner ribs have respective annular shapes surrounding the respective open ends of said corresponding ones of (a) the ink flow outlets of the ink delivering case and (b) the ink flow inlets of the recording head, and wherein the sealing portions of the elastic member fit in said at least one first space and said at least one second space such that respective inner surfaces of the sealing portions are held in contact with respective outer surfaces of the inner ribs.

26. The ink jet printer according to claim 24, wherein said at least one outer rib is located outside said at least one portion of each one of the inner ribs which portion is not adjacent to the other inner rib or ribs.

27. The ink jet printer according to claim 24, wherein the inner ribs are arranged in an array in a first direction, and wherein said at least one outer rib is located outside an outer portion of each one of two inner ribs that are located at respective opposite ends of the array of inner ribs in the first direction, said outer portion of said each one of said two inner ribs being opposite, in the first direction, to an inner portion thereof adjacent to one of the other inner ribs, and extending in a second direction perpendicular to the first direction.

28. The ink jet printer according to claim 27, wherein said at least one outer rib is located outside two opposite portions of each one of the inner ribs of the array that are opposite to each other in the second direction and extend in the first direction.

29. The ink jet printer according to claim 24, wherein said at least one outer rib includes a continuous rib which continuously surrounds the inner ribs and cooperates with the inner ribs to define a continuous groove as said at least one second space.

30. An ink jet printer comprising:

a stationary frame;

a tank supporter which is provided in the stationary frame and which supports a plurality of ink storing tanks storing a plurality of sorts of inks, respectively;

a recording head which records an image on a recording medium by ejecting respective droplets of the sorts of inks, wherein the recording head has a plurality of ink ejection nozzles and a plurality of ink flow inlets communicating with the ink ejection nozzles, respectively;

a plurality of ink delivering tanks which deliver the sorts of inks, respectively, and have a plurality of ink flow outlets;

a plurality of ink supply tubes which are provided between the tank supporter and the ink delivering tanks and through which the sorts of inks are supplied from the ink storing tanks to the recording head via the ink delivering tanks, respectively, wherein the ink delivering tanks provide at least respective portions of a plurality of ink delivering channels connecting between the ink supply tubes and the recording head;

a head holder which includes a main portion holding the recording head and the ink delivering tanks, and which is movable relative to the stationary frame so that the recording head records the image on the recording medium;

an ink-contact preventing portion which prevents the inks that leak from the ink delivering channels, from contacting the recording head;

an ink delivering case defining the ink delivering tanks having the ink flow outlets corresponding to the ink flow inlets of the recording head, respectively; and an elastic member which has a plurality of through-holes arranged in an array in a first direction, and which is sandwiched by the recording head and the ink delivering case such that the through-holes communicate with the ink flow outlets, respectively, and communicate with the ink flow inlets, respectively, wherein the elastic member includes a base portion through which the through-holes are formed such that respective axis lines of the through-holes are substantially perpendicular to a plane along which the base portion extends, and additionally includes at least one array of first annular projections which project, parallel to the respective axis lines of the through-holes, from at least one of opposite surfaces of the base portion that are opposed to the recording head and the ink delivering case, respectively, and which surround the through-holes, respectively, and wherein each of two outer first annular projections located at respective opposite ends of said at least one array of first annular projections in the first direction includes an outer portion which is located outside a corresponding one of two outer through-holes located at respective opposite ends of the array of through-holes in the first direction, and has a first thickness greater than a second thickness of an other portion of said each outer first annular projection, the first thickness being measured, in a vicinity of the base portion, in the first direction, the second thickness being measured, in the vicinity of the base portion, in a direction parallel to the base portion and perpendicular to said other portion.

31. The ink jet printer according to claim 30, wherein each of the through-holes of the elastic member is elongate in a second direction perpendicular to the first direction, and wherein the outer portion of said each outer first annular projection extends along said corresponding outer through-hole, and has the first thickness at a substantially middle portion thereof in the second direction.

32. The ink jet printer according to claim 31, wherein the outer portion of said each outer first annular projection has, at the substantially middle portion thereof in the second direction, a trapezoidal cross section whose thickness in the first direction decreases in a direction from the base portion toward a ridge line of the outer portion.

33. The ink jet printer according to claim 32, wherein said each outer first annular projection projects from the base portion such that a distance in the first direction between the ridge line of the outer portion of said each outer first annular projection and an inner circumferential surface of said corresponding outer through-hole increases as the ridge line approaches from each of opposite ends of the outer portion in the second direction to the substantially middle portion of the outer portion.

34. The ink jet printer according to claim 30, wherein the elastic member includes one said array of first annular projections which project from one of the opposite surfaces of the base portion that are opposed to the recording head and the ink delivering case, respectively, and which surround the through-holes, respectively, such that the first annular projections are separate from each other in the first direction, wherein each pair of first annular projections located adjacent to each other in the first direction in said one array of first annular projections include respective inner portions which are located adjacent to each other in the first direction and extend parallel to each other in the second direction, and wherein the outer portion of said each outer first annular projection projects from a corresponding one of opposite end portions of the base portion in the first direction, such that the outer portion is nearer to said corresponding outer through-hole than to a corresponding one of opposite side surfaces of the base portion in the first direction.

35. The ink jet printer according to claim 34, wherein the elastic member additionally includes an array of second annular projections which project, parallel to the respective axis lines of the through-holes, from an other of the opposite surfaces of the base portion and which surround the through-holes, respectively, wherein each pair of second annular projections located adjacent to each other in the first direction in the array of second annular projections include respective inner portions which are located at a position corresponding to a middle position between the two parallel inner portions of the corresponding pair of first annular projections located adjacent to each other, and wherein each of two outer second annular projections located at respective opposite ends of the array of second annular projections in the first direction includes an outer portion which projects from a substantially middle portion in the first direction of a corresponding one of the opposite end portions of the base portion.

36. The ink jet printer according to claim 30, wherein the first annular projections project from said one of the opposite surfaces of the base portion, and surround the through-holes, respectively, such that an inner circumferential surface of each of the first annular projections is substantially continuous with an inner circumferential surface of a corresponding one of the through-holes, wherein the elastic member additionally includes a plurality of second annular projections which project, parallel to the respective axis lines of the through-holes, from an other of the opposite surfaces of the base portion and which surround the through-holes, respectively, such that an inner circumferential surface of each of the second annular projections is offset outward from the inner circumferential surface of a corresponding one of the through-holes, wherein one of the recording head and the ink delivering case that is opposed to the second annular projections of the elastic member has at least one groove which receives the second annular projections, wherein at least one of the first annular projections includes the outer portion which is opposite to said other portion thereof adjacent to an other of the first annular projections in the first direction, and which has the first thickness greater than the second thickness of said other portion, each of the first thickness and the second thickness being measured, in the vicinity of the base portion, in the first direction, and wherein in a state in which the elastic member is sandwiched by the recording head and the ink delivering case, the first annular projections are compressed by an other of the recording head and the ink delivering case, and the second annular projections are compressed by said at least one groove of said one of the recording head and the ink delivering case, so that the inner circumferential surface of each of the through-holes is substantially continuous with an inner circumferential surface of a corresponding one of the ink flow outlets and with an inner circumferential surface of a corresponding one of the ink flow inlets.

37. The ink jet printer according to claim 36, wherein the first annular projections surround the through-holes, respectively, such that the first annular projections are separate from each other in the first direction, and wherein the second annular projections include respective portions which are located at a position corresponding to a middle position between the first annular projections adjacent to each other in the first direction.

38. The ink jet printer according to claim 36, wherein each of the through-holes of the elastic member is elongate in a second direction perpendicular to the first direction, and wherein the first portion of said at least one first annular projection is located outside a corresponding one of the through-holes in the first direction, extends along the corresponding through-hole, and has, at a substantially middle portion thereof in the second direction, the first thickness.

39. The ink jet printer according to claim 36, wherein said at least one first annular projection projects from the base portion such that a distance in the first direction between a ridge line of the outer portion of said at least one first annular projection and an inner circumferential surface of said corresponding through-hole increases as the ridge line approaches from each of opposite ends of the outer portion in the second direction to a substantially middle portion of the outer portion in the second direction.

40. An ink jet printer comprising:

a stationary frame;

a tank supporter which is provided in the stationary frame and which supports at least one ink storing tank storing at least one sort of ink;

a recording head which records an image on a recording medium by ejecting a droplet of said at least one sort of ink, and which has at least one ink flow inlet;

at least one ink delivering tank which delivers said at least one sort of ink and has at least one ink flow outlet;

at least one ink supply tube which is provided between the tank supporter and said at least one ink delivering tank and through which said at least one sort of ink is supplied from said at least one ink storing tank to the recording head via said at least one ink delivering tank, wherein said at least one ink delivering tank provides at least a portion of at least one ink delivering channel connecting between said at least one ink supply tube and the recording head;

a head holder which includes a main portion holding the recording head and said at least one ink delivering tank, and which is movable relative to the stationary frame so that the recording head records the image on the recording medium; and an ink-contact preventing portion which prevents the ink that leaks from said at least one ink delivering channel, from contacting the recording head;

wherein the head holder includes a bottom wall and holds the recording head below the bottom wall, wherein the bottom wall has at least one opening which is formed through a thickness of the bottom wall, wherein the ink-contact preventing portion comprises and ink-movement preventing portion which prevents the ink that has leaked from said at least one ink delivering channel, from moving into said at least one opening, wherein the ink jet printer further comprises an electric-circuit substrate which supports an electric circuit and which is spaced from said at least one ink delivering tank; and an electric cable which extends through a space between said at least one ink delivering tank and the electric-circuit substrate and thereby electrically connects the recording head to the electric circuit, wherein the recording head includes an actuator and at least one nozzle which ejects, upon operation of the actuator, the droplet of said at least one sort of ink toward the recording medium, wherein said at least one ink delivering tank has at least one upper opening, wherein the ink jet printer further comprises a flexible membrane which closes said at least one upper opening of said at least one ink delivering tank, wherein the electric-circuit substrate is spaced from the flexible membrane, wherein the electric cable extends through the space between the flexible membrane and the electric-circuit substrate and thereby electrically connects the actuator of the recording head to the electric circuit, and wherein the ink jet printer further comprises at least one cable supporting portion which supports the electric cable such that the cable extends through the space between the flexible membrane and the electric-circuit substrate, without contacting the flexible membrane.

41. The ink jet printer according to claim 40, wherein said at least one cable supporting portion includes at least one projecting portion which projects upward from said at least one ink delivering tank so that said at least one projecting portion supports the electric cable at least one position higher than an upper surface of the flexible membrane.

42. An ink jet printer comprising:

a stationary frame;

a tank supporter which is provided in the stationary frame and which supports at least one ink storing tank storing at least one sort of ink;

a recording head which records an image on a recording medium by ejecting a droplet of said at least one sort of ink, and which has at least one ink flow inlet;

at least one ink delivering tank which delivers said at least one sort of ink and has at least one ink flow outlet;

at least one ink supply tube which is provided between the tank supporter and said at least one ink delivering tank and through which said at least one sort of ink is supplied from said at least one ink storing tank to the recording head via said at least one ink delivering tank, wherein said at least one ink delivering tank provides at least a portion of at least one ink delivering channel connecting between said at least one ink supply tube and the recording head;

a head holder which includes a main portion holding the recording head and said at least one ink delivering tank, and which is movable relative to the stationary frame so that the recording head records the image on the recording medium; and an ink-contact preventing portion which prevents the ink that leaks from said at least one ink delivering channel, from contacting the recording head;

wherein the head holder includes a bottom wall and holds the recording head below the bottom wall, wherein the bottom wall has at least one opening which is formed through a thickness of the bottom wall, wherein the ink-contact preventing portion comprises an ink-movement preventing portion which prevents the ink that has leaked from said at least one ink delivering channel, from moving into said at least one opening, wherein the ink jet printer further comprises an electric-circuit substrate which supports an electric circuit and which is spaced from said at least one ink delivering tank; and an electric cable which extends through a space between said at least one ink delivering tank and the electric-circuit substrate and thereby electrically connects the recording head to the electric circuit, wherein the recording head includes an actuator and at least one ink ejection nozzle which ejects, upon operation of the actuator, said at least one droplet of said at least one sort of ink toward the recording medium, wherein the electric-circuit substrate is supported by the head holder such that the recording head and the electric-circuit substrate are located on either side of said at least one ink delivering tank, wherein the ink jet printer further comprises at least one electronic component which is electrically connected to the electric circuit such that said at least one electronic component projects from the electric-circuit substrate and is located in a vicinity of said at least one ink delivering tank, and wherein the electric cable electrically connects the actuator of the recording head to the electric circuit, while extending through a first space between said at least one ink delivering tank and said at least one electronic component and a second space between said at least one ink delivering tank and the electric-circuit substrate.

43. The ink jet printer according to claim 42, further comprising:

a flexible membrane which closes an opening of said at least one ink delivering tank; and at least one cable supporting portion which supports the electric cable such that the cable extends through the first and second spaces without contacting the flexible membrane.

* * * * *